US009339432B2

(12) United States Patent
Liu et al.

(10) Patent No.: US 9,339,432 B2
(45) Date of Patent: May 17, 2016

(54) WALKER APPARATUS AND BACKREST THEREFOR

(71) Applicant: Evolution Technologies Inc., Port Coquitlam (CA)

(72) Inventors: Julian Liu, Port Moody (CA); Nicolas Cinguino, Shanghai (CN)

(73) Assignee: Evolution Technologies Inc. (CA)

( * ) Notice: Subject to any disclaimer, the term of this patent is extended or adjusted under 35 U.S.C. 154(b) by 27 days.

(21) Appl. No.: 14/193,806

(22) Filed: Feb. 28, 2014

(65) Prior Publication Data

US 2015/0245973 A1 Sep. 3, 2015

(51) Int. Cl.
*A61G 5/10* (2006.01)
*A61H 3/04* (2006.01)

(52) U.S. Cl.
CPC ..... *A61H 3/04* (2013.01)

(58) Field of Classification Search
CPC ..... A61G 5/10; A61H 3/04
USPC ..... 280/250.1, 304.1, 47.34, 642, 650, 280/87.021, 87.041, 87.05
See application file for complete search history.

(56) References Cited

U.S. PATENT DOCUMENTS

| | | | | |
|---|---|---|---|---|
| 188,835 | A | 3/1877 | Allen | |
| 291,351 | A | 1/1884 | Jackson | |
| 522,117 | A | 6/1894 | Humphrey | |
| 534,443 | A | 2/1895 | Manguine | |
| 879,803 | A | 2/1908 | Vlasak | |
| 1,767,925 | A | 6/1930 | Hargreaves | |
| 2,169,860 | A | 8/1939 | Von Hoorn | |
| 2,483,307 | A | 9/1949 | Wheary, Jr. | |
| 2,631,655 | A | 3/1953 | Jannello | |
| 2,656,881 | A | 10/1953 | Hamilton | |
| 2,681,809 | A | 6/1954 | Hamill | |
| 2,732,047 | A | 1/1956 | Finkelstein | |
| 2,864,466 | A | 12/1958 | Taylor | |
| 2,866,495 | A | 12/1958 | Diehl et al. | |
| 2,937,248 | A | 5/1960 | Michetti | |
| 2,987,149 | A | 6/1961 | Finkelstein | |
| 3,018,506 | A | 1/1962 | Haydock | |
| 3,061,049 | A | 10/1962 | Bramley | |
| 3,109,899 | A | 11/1963 | Pastene | |
| 3,142,351 | A * | 7/1964 | Green | 180/8.2 |

(Continued)

FOREIGN PATENT DOCUMENTS

| | | |
|---|---|---|
| AT | 214095 B | 3/1961 |
| AT | 242315 B | 9/1965 |

(Continued)

OTHER PUBLICATIONS

International Search Report and Written Opinion for PCT/CA2015/050058, dated May 1, 2015.

(Continued)

*Primary Examiner* — Bryan Evans
(74) *Attorney, Agent, or Firm* — Berenato & White, LLC

(57) ABSTRACT

There is provided a walker apparatus having a pair of spaced-apart, upright frame members. The walker apparatus includes a seat operatively connected to the upright frame members. The walker apparatus has a backrest cantilevered from the frame members. The backrest has at least one opening extending therethrough for permitting a user's vision past the backrest when the user grips the upright frame members.

34 Claims, 40 Drawing Sheets

(56) References Cited

U.S. PATENT DOCUMENTS 3,194,577 A 7/1965 Berlin
3,268,965 A 8/1966 Arthur
3,288,250 A 11/1966 Oja et al.
3,376,400 A 4/1968 Batt et al.
3,409,105 A 11/1968 Clinton
3,690,652 A 9/1972 Schneider
3,692,155 A 9/1972 Laurita
3,890,668 A 6/1975 Stosberg et al.
3,903,944 A 9/1975 Montgomery et al.
3,927,727 A 12/1975 Hanagan
3,969,964 A 7/1976 George et al.
4,029,279 A 6/1977 Nakatani
4,029,311 A 6/1977 Chanslor et al.
4,056,115 A 11/1977 Thomas
4,087,141 A 5/1978 Roberts
4,116,464 A 9/1978 Haley
4,149,721 A 4/1979 Strickland
4,184,618 A 1/1980 Jones
4,185,936 A 1/1980 Takahashi
4,261,561 A 4/1981 Ilon
4,286,401 A 9/1981 Pachmayr et al.
4,325,561 A 4/1982 Lynn
4,371,183 A 2/1983 Dion
4,384,713 A 5/1983 Deutsch et al.
4,414,702 A 11/1983 Neumann
4,415,198 A 11/1983 Brearley
4,449,750 A 5/1984 Pultman
4,460,188 A 7/1984 Maloof
4,462,138 A 7/1984 Black
4,477,098 A 10/1984 Minnebraker
4,493,488 A 1/1985 Panaia et al.
4,494,271 A 1/1985 Perlin et al.
4,509,662 A 4/1985 Weiss
4,570,370 A 2/1986 Smith et al.
4,572,409 A 2/1986 Finnegan
4,596,484 A 6/1986 Nakatani
4,659,099 A 4/1987 Malone
4,669,146 A 6/1987 Saito et al.
4,676,416 A 6/1987 Harmon
4,722,114 A 2/1988 Neumann
4,740,010 A 4/1988 Moskovitz
4,761,092 A 8/1988 Nakatani
4,765,644 A 8/1988 Bell
4,800,911 A 1/1989 Endres et al.
4,800,991 A 1/1989 Miller
4,830,035 A 5/1989 Liu
4,856,123 A 8/1989 Henderson et al.
4,883,317 A 11/1989 Davenport
4,890,355 A 1/1990 Schulten
4,907,794 A 3/1990 Rose
4,907,839 A 3/1990 Rose et al.
4,913,452 A 4/1990 Zun
4,930,697 A 6/1990 Takahashi et al.
4,974,760 A 12/1990 Miller
5,012,963 A 5/1991 Rosenbaum
5,020,560 A * 6/1991 Turbeville ..... 135/67
5,046,748 A 9/1991 Oat-Judge
5,052,075 A 10/1991 Harris
5,103,530 A 4/1992 Andrisin, III et al.
5,109,569 A 5/1992 Shaw
5,158,313 A 10/1992 Becker
5,167,048 A 12/1992 Geiger et al.
5,188,139 A 2/1993 Garelick
5,269,157 A 12/1993 Ciminelli et al.
5,279,180 A 1/1994 Henriksson
5,293,965 A 3/1994 Nagano
5,294,027 A 3/1994 Plastina
5,348,336 A 9/1994 Fernie et al.
5,353,824 A 10/1994 Woods et al.
5,356,237 A 10/1994 Sung
5,380,034 A 1/1995 Wilson
2,710,084 A 6/1995 Braverman
5,429,377 A 7/1995 Duer
5,433,235 A 7/1995 Miric et al.
5,465,745 A 11/1995 Davis
5,465,986 A 11/1995 MacRae
5,475,896 A 12/1995 Wang
5,482,189 A 1/1996 Dentler et al.
5,499,697 A 3/1996 Trimble et al.
5,513,789 A 5/1996 Woods et al.
5,527,096 A 6/1996 Shimer
5,531,238 A 7/1996 Azzarelli et al.
5,551,413 A 9/1996 Walk
5,593,461 A 1/1997 Reppert et al.
5,594,974 A 1/1997 Wattron et al.
5,605,345 A 2/1997 Erfurth et al.
5,621,997 A 4/1997 Pearce
5,622,404 A 4/1997 Menne
5,632,362 A 5/1997 Leitner
5,639,052 A 6/1997 Sauve
5,640,741 A 6/1997 Yano
5,662,342 A 9/1997 Basharat
5,687,984 A 11/1997 Samuel
5,692,762 A 12/1997 Obitts
5,722,717 A 3/1998 Rettenberger
5,772,234 A 6/1998 Luo
5,774,936 A 7/1998 Vetter
5,775,352 A 7/1998 Obitts
5,813,582 A 9/1998 Wright
5,816,650 A 10/1998 Lucas, Jr.
5,865,065 A 2/1999 Chiu
5,896,779 A 4/1999 Biersteker et al.
5,901,891 A 5/1999 Douglass
5,915,712 A 6/1999 Stephenson et al.
5,927,441 A 7/1999 Luo
5,953,962 A 9/1999 Hewson
5,954,161 A 9/1999 Lee
6,032,765 A 3/2000 Hsi-Chia
6,047,439 A 4/2000 Stearn
6,079,290 A 6/2000 Li
6,079,894 A 6/2000 Obitts
6,082,468 A 7/2000 Pusateri et al.
6,098,487 A 8/2000 Chien
6,099,002 A 8/2000 Uchiyama
6,112,446 A 9/2000 Förster et al.
6,135,475 A 10/2000 Brown et al.
6,142,526 A 11/2000 Katz
6,161,896 A 12/2000 Johnson et al.
6,189,914 B1 2/2001 Worth et al.
6,192,772 B1 2/2001 Huang
6,196,562 B1 3/2001 Zhuang
6,202,502 B1 3/2001 Chung-Che
6,216,825 B1 4/2001 Hung
6,283,484 B1 9/2001 Malmström
6,296,261 B1 10/2001 deGoma
6,296,263 B1 10/2001 Schultz et al.
6,311,708 B1 11/2001 Howle
6,318,392 B1 11/2001 Chen
6,338,355 B1 1/2002 Cheng
6,338,493 B1 1/2002 Wohlgemuth et al.
6,340,168 B1 1/2002 Woleen
6,354,619 B1 3/2002 Kim
6,364,070 B1 4/2002 Chen
6,371,142 B1 4/2002 Battiston
6,378,883 B1 4/2002 Epstein
6,386,575 B1 5/2002 Turner
6,401,321 B2 6/2002 Carey et al.
6,409,196 B1 6/2002 McFarland
6,442,797 B1 9/2002 Yang et al.
6,467,785 B2 10/2002 Toppses
6,491,318 B1 12/2002 Galt et al.
6,494,469 B1 12/2002 Hara et al.
6,502,280 B2 1/2003 Looker
6,527,136 B1 3/2003 Sabounjian
6,584,641 B1 7/2003 Milbredt
6,604,789 B1 8/2003 Downing
6,647,825 B1 11/2003 Lin
6,651,994 B2 11/2003 Hallgrimsson et al.
6,655,702 B2 12/2003 Senger
6,659,478 B2 12/2003 Hallgrimsson et al.
6,688,633 B2 2/2004 van't Schip
6,754,936 B2 6/2004 Ereñaga
6,755,285 B1 6/2004 Wu
6,769,701 B1 8/2004 Clausen

(56) References Cited

U.S. PATENT DOCUMENTS

| | | | |
|---|---|---|---|
| 6,810,560 | B1 | 11/2004 | Tsai |
| 6,817,066 | B1 | 11/2004 | Williams et al. |
| 6,837,503 | B2 | 1/2005 | Chen et al. |
| D501,432 | S | 2/2005 | Møller |
| 6,877,519 | B2 | 4/2005 | Fink |
| 6,886,216 | B2 | 5/2005 | Graham et al. |
| 6,886,575 | B2 | 5/2005 | Diamond |
| 6,889,998 | B2 | 5/2005 | Sterns et al. |
| 7,052,030 | B2 | 5/2006 | Serhan |
| 7,090,239 | B2 | 8/2006 | Yoshie et al. |
| 7,108,004 | B2 | 9/2006 | Cowie et al. |
| 7,182,179 | B2 | 2/2007 | Tolfsen |
| 7,211,744 | B2 | 5/2007 | Jorgensen |
| 7,219,906 | B2 | 5/2007 | Hallgrimsson et al. |
| 7,231,689 | B2 | 6/2007 | Scheiber et al. |
| 7,278,436 | B2 | 10/2007 | Gale et al. |
| 7,306,246 | B2 | 12/2007 | Gale |
| 7,353,566 | B2 | 4/2008 | Scheiber et al. |
| 7,377,285 | B2 | 5/2008 | Karasin et al. |
| 7,383,611 | B2 | 6/2008 | Foster |
| 7,384,058 | B2 | 6/2008 | Munsey et al. |
| 7,410,179 | B2 | 8/2008 | Lönkvist |
| 7,422,550 | B1 | 9/2008 | Pinero et al. |
| 7,445,216 | B1 | 11/2008 | Chou |
| 7,494,138 | B2 | 2/2009 | Graham |
| 7,500,689 | B2 | 3/2009 | Pasternak et al. |
| 7,559,560 | B2 | 7/2009 | Li et al. |
| 7,587,852 | B1 | 9/2009 | Harms |
| 7,775,547 | B2 | 8/2010 | Dotsey et al. |
| 7,828,305 | B2 | 11/2010 | Meyers et al. |
| 7,837,205 | B2 | 11/2010 | Simard |
| 7,926,834 | B2 | 4/2011 | Willis |
| 7,980,415 | B2 | 7/2011 | Crawley |
| 7,984,724 | B1 * | 7/2011 | Eberle ..... 135/67 |
| 8,002,363 | B2 | 8/2011 | Cheng |
| 8,020,679 | B2 | 9/2011 | Wu |
| 8,083,239 | B2 | 12/2011 | Liu |
| 8,087,127 | B2 | 1/2012 | Dayt |
| 8,157,273 | B2 | 4/2012 | Bar-Lev |
| 8,167,351 | B2 | 5/2012 | Plowman |
| 8,251,380 | B2 | 8/2012 | Liu |
| 8,251,391 | B2 | 8/2012 | Kohler et al. |
| 8,313,066 | B2 | 11/2012 | Hampton et al. |
| 8,424,215 | B2 | 4/2013 | Quintiliani et al. |
| 8,434,171 | B2 | 5/2013 | Wang |
| 8,448,960 | B2 | 5/2013 | Liu |
| 8,505,936 | B2 | 8/2013 | Liu |
| 8,511,694 | B2 | 8/2013 | Bradshaw et al. |
| 8,517,399 | B2 | 8/2013 | Liu |
| 8,573,613 | B2 | 11/2013 | Liu |
| 8,602,424 | B2 | 12/2013 | Liu |
| D697,163 | S | 1/2014 | Bietsch |
| 8,801,073 | B1 | 8/2014 | Gray, Jr. et al. |
| 8,857,093 | B2 | 10/2014 | Hogue |
| 8,864,151 | B1 | 10/2014 | Liu |
| 8,936,256 | B2 | 1/2015 | Liu |
| 9,022,397 | B1 | 5/2015 | Prettyman |
| 9,022,413 | B2 | 5/2015 | Liu |
| 2002/0079663 | A1 | 6/2002 | Hallgrimsson et al. |
| 2002/0093178 | A1 | 7/2002 | Turner et al. |
| 2002/0140196 | A1 | 10/2002 | Crouch et al. |
| 2003/0010368 | A1 | 1/2003 | MacKinnon |
| 2003/0226584 | A1 | 12/2003 | Serhan |
| 2004/0094999 | A1 | 5/2004 | Volotsenko |
| 2004/0111830 | A1 | 6/2004 | Cooper et al. |
| 2005/0001398 | A1 | 1/2005 | Serhan |
| 2005/0057021 | A1 | 3/2005 | Miyoshi |
| 2005/0121481 | A1 | 6/2005 | Chiu |
| 2005/0156395 | A1 | 7/2005 | Bohn |
| 2005/0156404 | A1 | 7/2005 | Lauren et al. |
| 2005/0211285 | A1 | 9/2005 | Cowie et al. |
| 2005/0250605 | A1 | 11/2005 | Moore et al. |
| 2006/0059656 | A1 | 3/2006 | Hackett |
| 2006/0156511 | A1 | 7/2006 | Li |
| 2007/0170699 | A1 | 7/2007 | Li et al. |
| 2007/0199586 | A1 | 8/2007 | Cheng |
| 2007/0227570 | A1 | 10/2007 | Gale et al. |
| 2007/0235067 | A1 | 10/2007 | Gale et al. |
| 2007/0267054 | A1 | 11/2007 | Meyers et al. |
| 2007/0267453 | A1 | 11/2007 | Carroll |
| 2007/0278271 | A1 | 12/2007 | Koren |
| 2007/0278768 | A1 | 12/2007 | Lynam |
| 2007/0283990 | A1 | 12/2007 | Fernandez et al. |
| 2008/0042476 | A1 | 2/2008 | Hei et al. |
| 2008/0079230 | A1 | 4/2008 | Graham |
| 2008/0111349 | A1 | 5/2008 | Willis |
| 2008/0121258 | A1 | 5/2008 | Lin |
| 2008/0129016 | A1 | 6/2008 | Willis |
| 2008/0174084 | A1 | 7/2008 | Gee |
| 2009/0033052 | A1 | 2/2009 | Bradshaw et al. |
| 2009/0206578 | A1 | 8/2009 | Pizmony et al. |
| 2010/0083994 | A1 | 4/2010 | Liu |
| 2010/0301574 | A1 | 12/2010 | Derks |
| 2011/0146027 | A1 | 6/2011 | Tsai |
| 2011/0173861 | A1 | 7/2011 | Roth |
| 2011/0187067 | A1 | 8/2011 | Staggs |
| 2011/0241303 | A1 | 10/2011 | Campbell |
| 2012/0043739 | A1 | 2/2012 | Liu |
| 2012/0084940 | A1 | 4/2012 | Tsai |
| 2012/0104710 | A1 | 5/2012 | Liu |
| 2012/0133106 | A1 | 5/2012 | Liu |
| 2012/0205882 | A1 | 8/2012 | Staggs |
| 2012/0280463 | A1 | 11/2012 | Liu |
| 2012/0299272 | A1 | 11/2012 | Liu |
| 2013/0062864 | A1 | 3/2013 | Huang |
| 2013/0168947 | A1 | 7/2013 | Offord |
| 2013/0187356 | A1 | 7/2013 | Hazeleger |
| 2013/0264787 | A1 | 10/2013 | Cheng et al. |
| 2013/0320640 | A1 | 12/2013 | Liu |
| 2014/0125037 | A1 | 5/2014 | Andersen |
| 2014/0175841 | A1 | 6/2014 | Liu |
| 2014/0284891 | A1 | 9/2014 | Llu |
| 2014/0305249 | A1 | 10/2014 | Liu |
| 2014/0312586 | A1 | 10/2014 | Cheng et al. |
| 2014/0333040 | A1 | 11/2014 | Liu |
| 2015/0048582 | A1 | 2/2015 | Liu |

FOREIGN PATENT DOCUMENTS

| | | | |
|---|---|---|---|
| CA | 2137650 | | 6/1995 |
| CA | 2285305 | | 10/1998 |
| CA | 2352801 | | 6/2000 |
| CA | 2329485 | | 6/2002 |
| CA | 2513558 | | 9/2004 |
| CA | 2492392 | | 9/2005 |
| CN | 2551232 | Y | 5/2003 |
| CN | 202490148 | U | 10/2012 |
| DE | 4328875 | | 2/1995 |
| DE | 29818710 | | 10/1999 |
| DE | 102010031954 | | 1/2012 |
| DE | 202011003227 | U1 | 4/2012 |
| EP | 1092411 | | 4/2001 |
| EP | 2090276 | | 8/2009 |
| EP | 2090276 | A1 | 8/2009 |
| EP | 2522404 | A1 | 11/2012 |
| GB | 23483 | | 0/1913 |
| GB | 365901 | | 1/1932 |
| GB | 984025 | | 2/1965 |
| GB | 1396227 | A | 6/1975 |
| GB | 2180508 | | 4/1987 |
| JP | 09123915 | | 5/1997 |
| JP | 10291401 | | 11/1998 |
| NL | 1022512 | | 8/2004 |
| WO | 9206661 | | 4/1992 |
| WO | 9851557 | | 11/1998 |
| WO | 0222070 | | 3/2002 |
| WO | 2008019454 | | 2/2008 |

OTHER PUBLICATIONS

Translated English Abstract of CN2551232.
Translated English Abstract of CN202490148.
Translated English Abstract of DE202011003227.
English Abstract web printout of JP9123915.

(56) References Cited

OTHER PUBLICATIONS

English Abstract web printout of JP10291401.

English Abstract web printout of NL1022512.

English Abstract web printout of DE4328875.

Thelma Thibodeau, "Affidavit of Thelma Thibodeau", signed on Nov. 20, 2012, 113 pages, Montreal, Canada, listing the following.

A web printout screen shot of http://web.archive.org/web/20080512005035/http://www.handicat.com/at-num-18827. html (exhibits TT-16, 17) dated May 12, 2008.

A web printout screen shot of http://web.archive.org/web/20080512005035/http://www.handicat.com/at-num-18827. html (translated) (exhibit TT-18) dated May 12, 2008.

"Pruefprotokoll/test protocol Rollatoren 07/05", signed on Oct. 30, 2007 (exhibit TT-25), Hannover, Germany.

A web printout screen shot of http://web.archive.org/web/20080214151414/http://www.dolomite.biz/ (exhibit TT-32) dated Feb. 14, 2008.

A web printout screen shot of http://web.archive.org/web/20080919040758/http://www.dolomite.biz/dolomite/dolomite-jazz.php (exhibit TT-34) dated Feb. 14, 2008.

A web printout screen shot of http://web.archive.org/web/20080608193327/http://www.dolomite.biz/dolomite/products. php (exhibit TT-33) dated Feb. 14, 2008.

English Abstract web printout of DE102010031954.

A web screen shot printout from doclibrary.invacare.fr . . . (?) dated Aug. 6, 2013, in which adjacent to the heading "Dolomite Jazz", a "Jazz Sales Brochure" is listed as having a "start date of validity" of May 1, 2008, and in which a "Jazz spare parts list" is listed as having a "start date of validity" of May 1, 2008.

Two web screen shot printouts from handicat.com/classif4-num-03-09-06.html, dated Aug. 6, 2013, in which adjacent to a "Dolomite Jazz" heading, the words "Crée le . . . May 7, 2008—Modifiée: Jul. 24, 2013", which may mean "Created on May 7, 2008—Modified: Jul. 24, 2013".

A web screen shot printout of: web.archive.org/web/20080508194602/http://www.dolomite.biz/, dated May 8, 2008.

US 7,364,173, 04/2008, Meyers et al. (withdrawn)

* cited by examiner

WALKER APPARATUS AND BACKREST THEREFOR

FIELD OF THE INVENTION

There is provided a walker apparatus. In particular, there is provided a walker apparatus and a backrest therefor.

DESCRIPTION OF THE RELATED ART

It is known to have foldable walkers that include backrests. On the one hand, it may be desirable to provide a walker that is light weight and which includes relatively few parts. However, users with mobility issues may also have other medical deficiencies and walkers that include backrests in the form of a single band may be relatively uncomfortable for the user's back.

On the other hand, walkers with large backrests, while offering more back support, may be relatively bulky and may hamper the user's ability to fold the walker. Also, such backrests may inhibit the ability of the user to see past the walker, which may be particularly dangerous for users who may already have visual impairment challenges, for example.

There is accordingly a need for a backrest that promotes greater comfort to the user while at the same time not unduly hindering the foldability of the walker apparatus or impairing the user's field of vision while pushing the walker apparatus.

BRIEF SUMMARY OF INVENTION

There is provided a walker apparatus disclosed herein that overcomes the above disadvantages.

There is accordingly provided a walker apparatus having a pair of spaced-apart, upright frame members. The walker apparatus includes a seat operatively connected to the upright frame members. The walker apparatus has a backrest cantilevered from the frame members. The backrest includes a pair of spaced-apart straps.

There is further provided a walker apparatus having a pair of spaced-apart, upright frame members. The walker apparatus includes a seat operatively connected to the upright frame members. The walker apparatus has a backrest cantilevered from the frame members. The backrest is horizontally-split.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
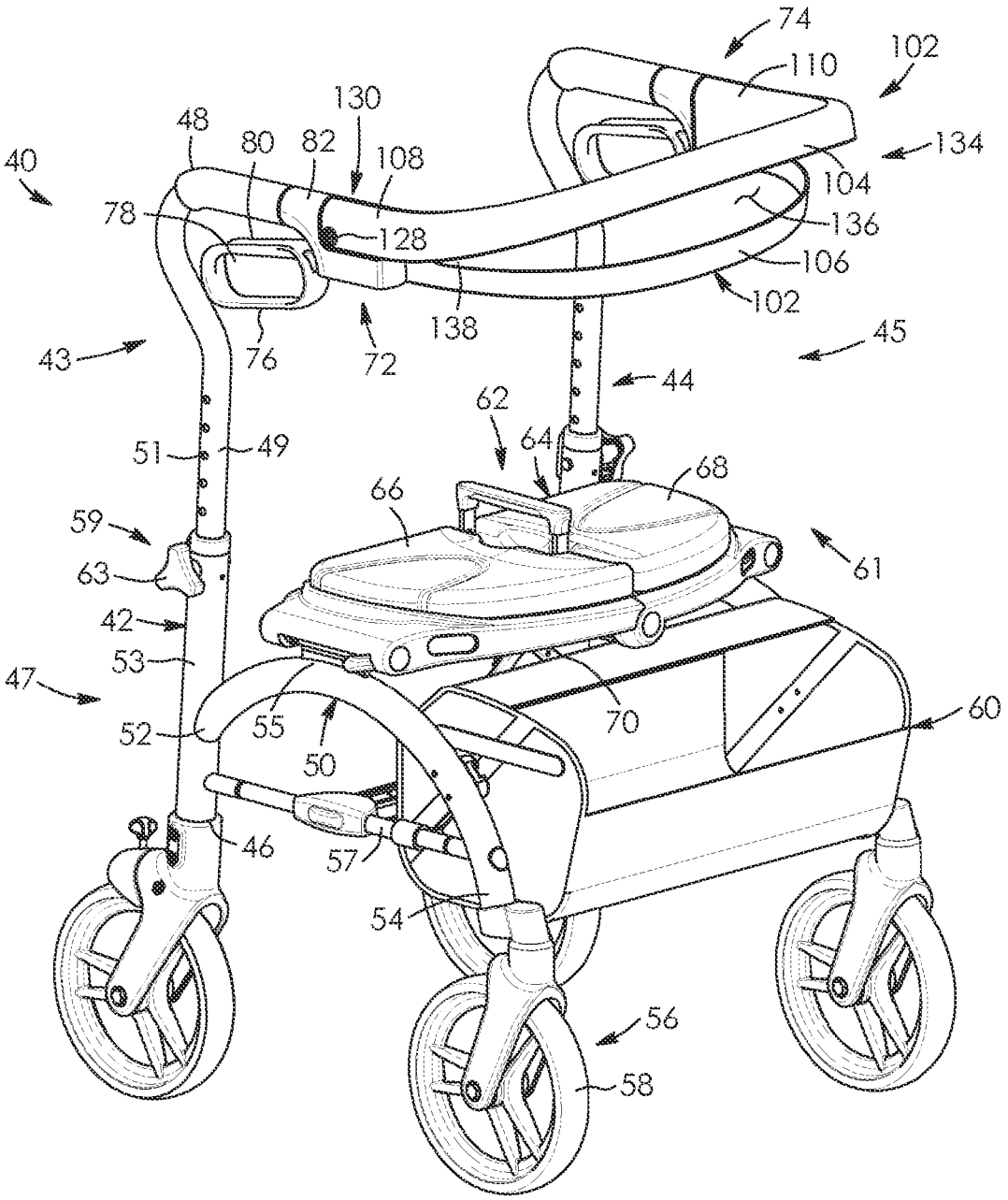
FIG. 1 is a front, side perspective view of a walker apparatus having a backrest according to one aspect, the walker apparatus being shown in an unfolded position.

Referring to the drawings and first to FIG. 1, there is shown a mobility aid device, in this example a walker apparatus 40 according to a first aspect. The walker apparatus is shown in FIGS. 1 to 21. As seen in FIG. 1, the walker apparatus 40 includes a pair of spaced-apart upright, frame members 42 and 44 positioned at respective spaced-apart sides 43 and 45 of the walker apparatus adjacent the rear 47 of the walker apparatus. Each of the frame members includes a lower end and an upper end spaced-apart from the lower end, as shown by lower end 46 and upper end 48 for frame member 42.

Each of the frame members 42 and 44 is telescoping and includes an inner tube 49 through which extend a plurality of apertures 51 and an outer tube 53 shaped to receive the inner tube. The walker apparatus 40 includes an adjustment mechanism 59 for selectively adjusting and locking the telescoping tubes together. In this example the adjustment mechanism includes thumb screws 63. The thumb screws may be inserted through selective ones of the apertures 51 to fixedly adjust the height of the telescoping tubes 49 and 53. This enables the height of the walker apparatus 40 to be adjusted to provide an optimized height for the user.

The walker apparatus 40 includes a pair of support members that are arc-shaped in this example, as shown by support member 50. The support members include proximal ends connected to respective ones of the frame members, distal ends spaced-apart the proximal ends, and apexes positioned between the ends. This is shown by support member 50 which extends from frame member 42 via its proximal end 52 to a distal end 54 and which includes an apex 55. The proximal ends of the support members connect to the frame members at locations adjacent to and spaced-apart from the lower ends 46 of the frame members in this example. Rods 57 extend from the lower ends 46 of respective ones of the frame members 42 and connect to respective ones of the support members 50 adjacent to the distal ends 54 of the support members in this example.

The walker apparatus 40 includes a plurality of wheel assemblies connected to the lower ends 46 of the frame members 42 and 44 and distal ends of the support members, as shown by wheel assembly 56 connecting to the distal end 54 of support member 50. Each of the wheel assemblies includes a ground-engaging wheel 58. The walker apparatus 40 includes a collapsible basket 60 in this example, which selectively connects to and extends between the support members 50 adjacent to the distal ends 54 of the support members. The basket is positioned adjacent to the front 61 of the walker apparatus in this example. The walker apparatus 40 further includes a seat assembly 62, in this example comprising a seat 64 having two substantially planar portions 66 and 68 pivotally connected together. Portions 66 and 68 of the seat assembly pivotally connect to respective ones of the support members 50 at the apexes 55 of the support members in this example. Seat 64 thus operatively connects to the upright frame members 42 and 44.

Figure 2:
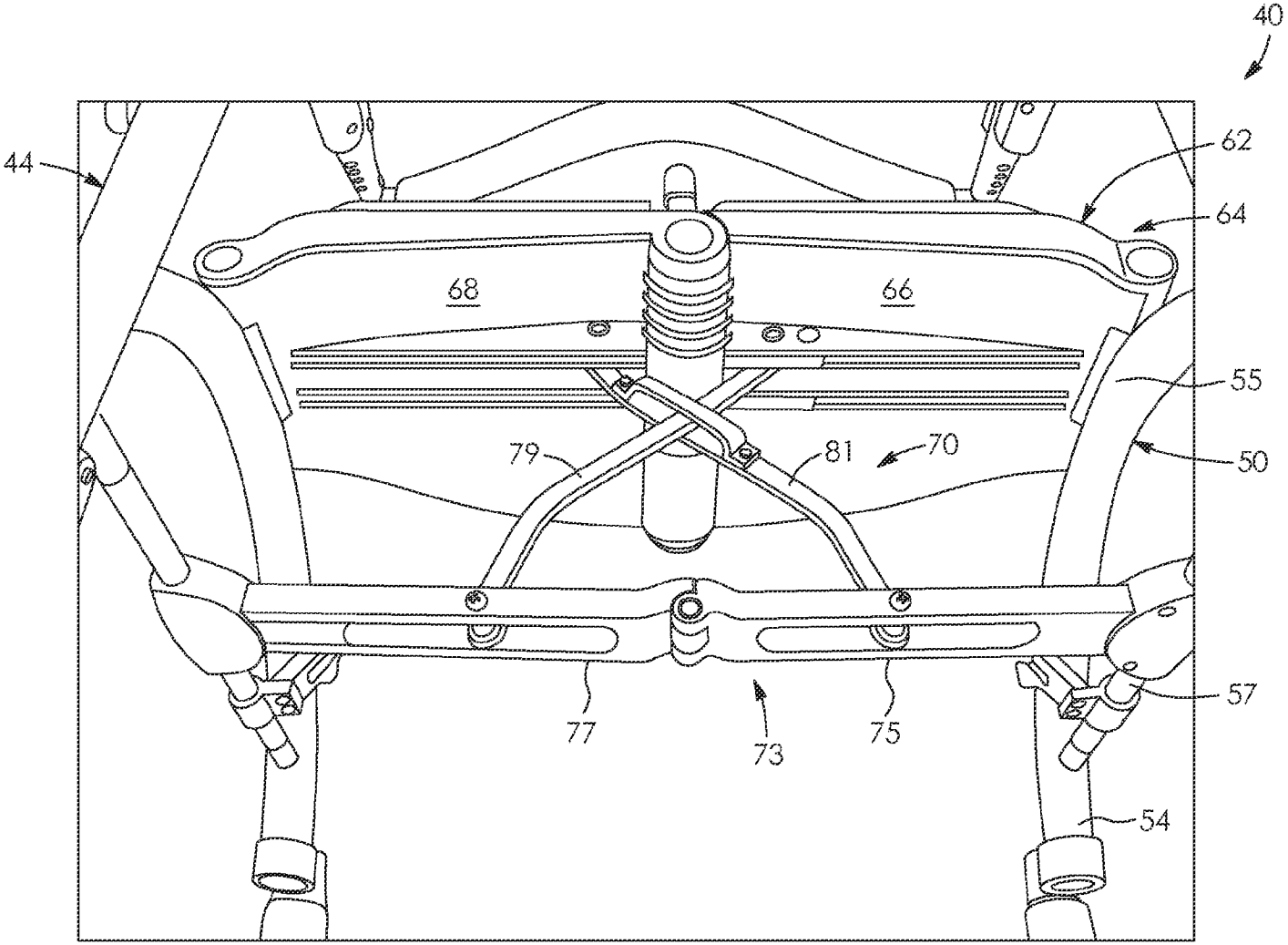
FIG. 2 is a fragmentary, bottom, rear perspective view of the walker apparatus of FIG. 1, showing the folding mechanism of the walker apparatus, the walker apparatus being shown with its collapsible basket being removed.

The walker apparatus 40 includes a folding mechanism 70, best seen in FIG. 2. The folding mechanism includes in this example an inner frame assembly 73 formed of two inner frame members 75 and 77 which are hingedly connected together and which pivotally connect to and extend from respective ones of the rods 57. The folding mechanism 70 in this example includes a pair of intercrossing link members 79 and 81 that pivotally connect to and extend from respective portions 66 and 68 of the seat assembly 62 and rods 57 in this example. The link members 79 and 81 also pivotally connect to inner frame members 77 and 75, respectively of the inner frame assembly 73. The folding mechanism 70 thus operatively connects to and is interposed between the frame members 42 and 44.

Figure 13:
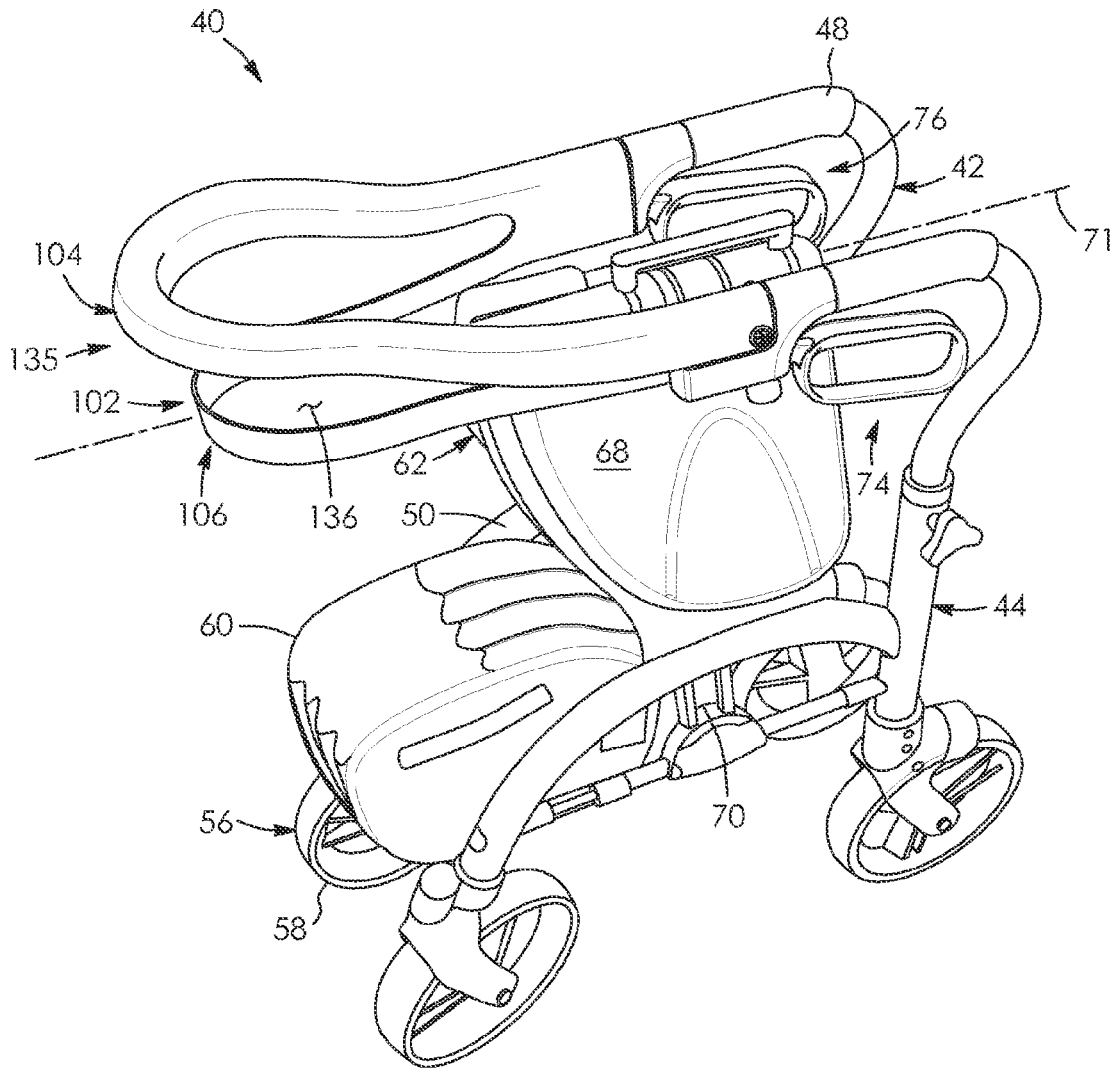
FIG. 13 is a rear perspective view of the walker apparatus of FIG. 11 shown in a folded position.
Figure 14:
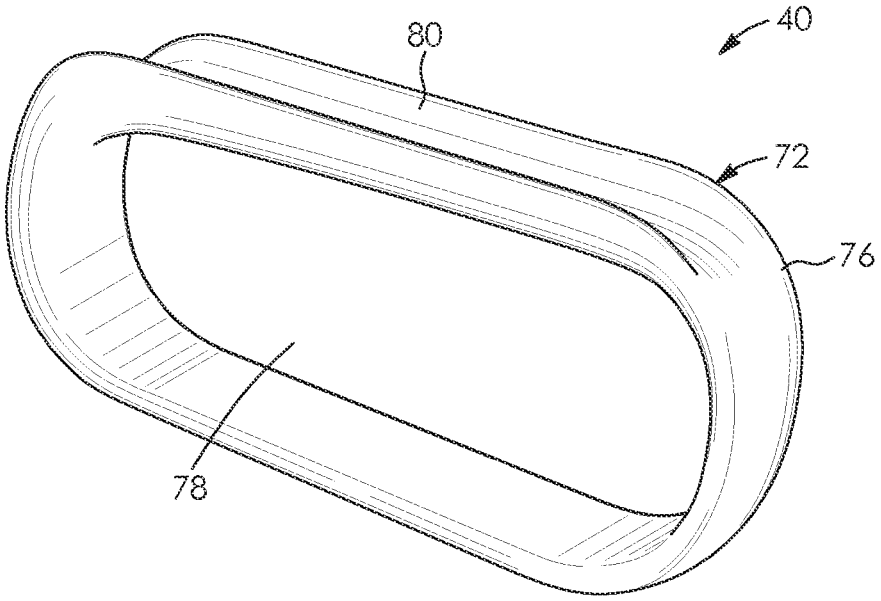
FIG. 14 is a front, side perspective view of a handle for the walker apparatus of FIG. 1.
Figure 15:
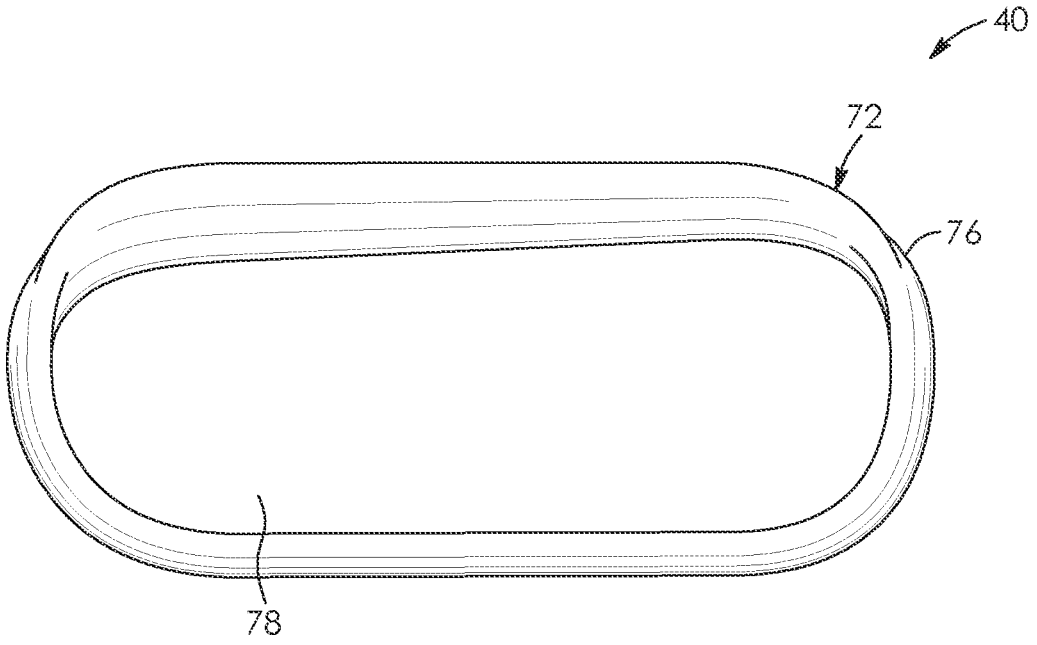
FIG. 15 is a first side elevation view of the handle of FIG. 14.
Figure 16:
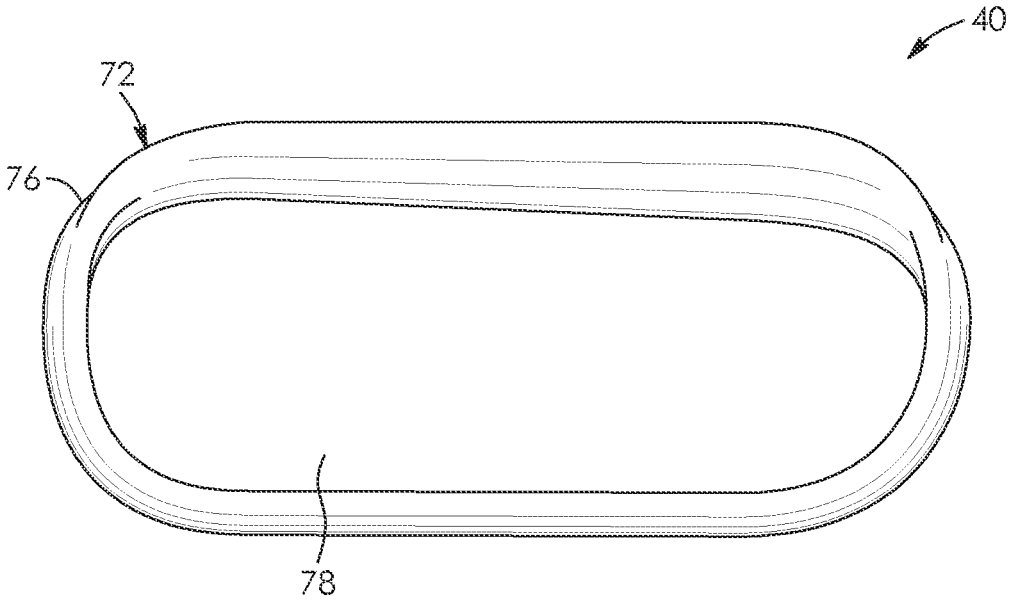
FIG. 16 is a second side elevation view of the handle of FIG. 14.
Figure 17:
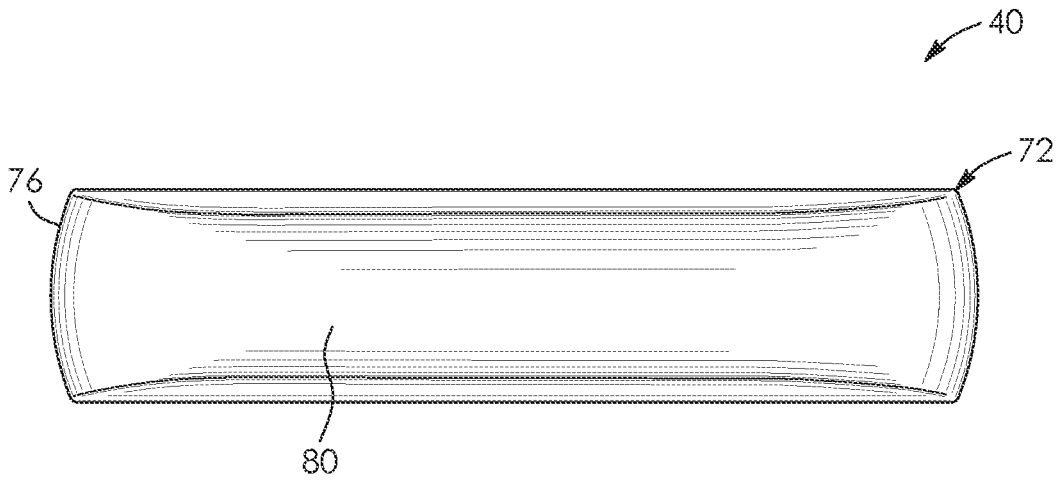
FIG. 17 is a top plan view of the handle of FIG. 14.
Figure 18:
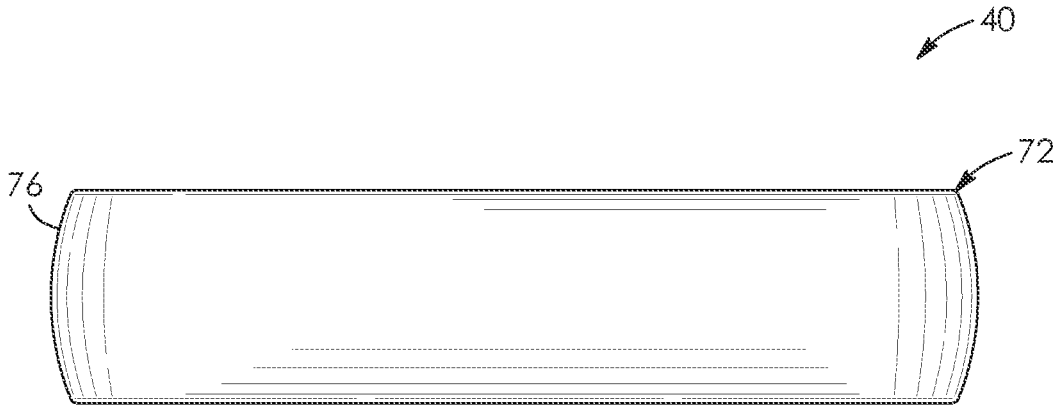
FIG. 18 is a bottom plan view of the handle of FIG. 14.
Figure 19:
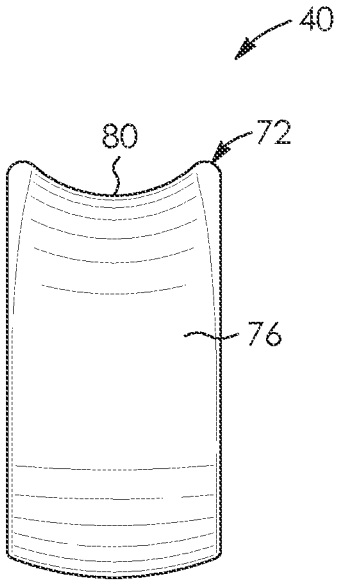
FIG. 19 is a front elevation view of the handle of FIG. 14.
Figure 20:
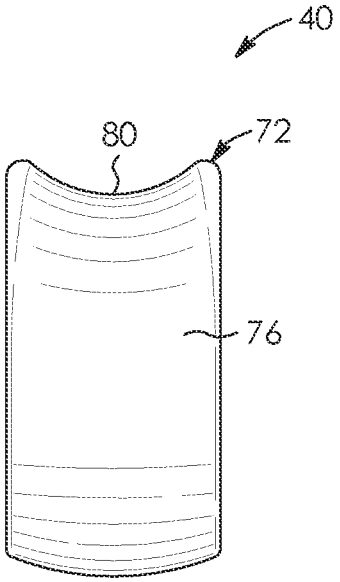
FIG. 20 is a rear elevation view of the handle of FIG. 14.
Figure 21:
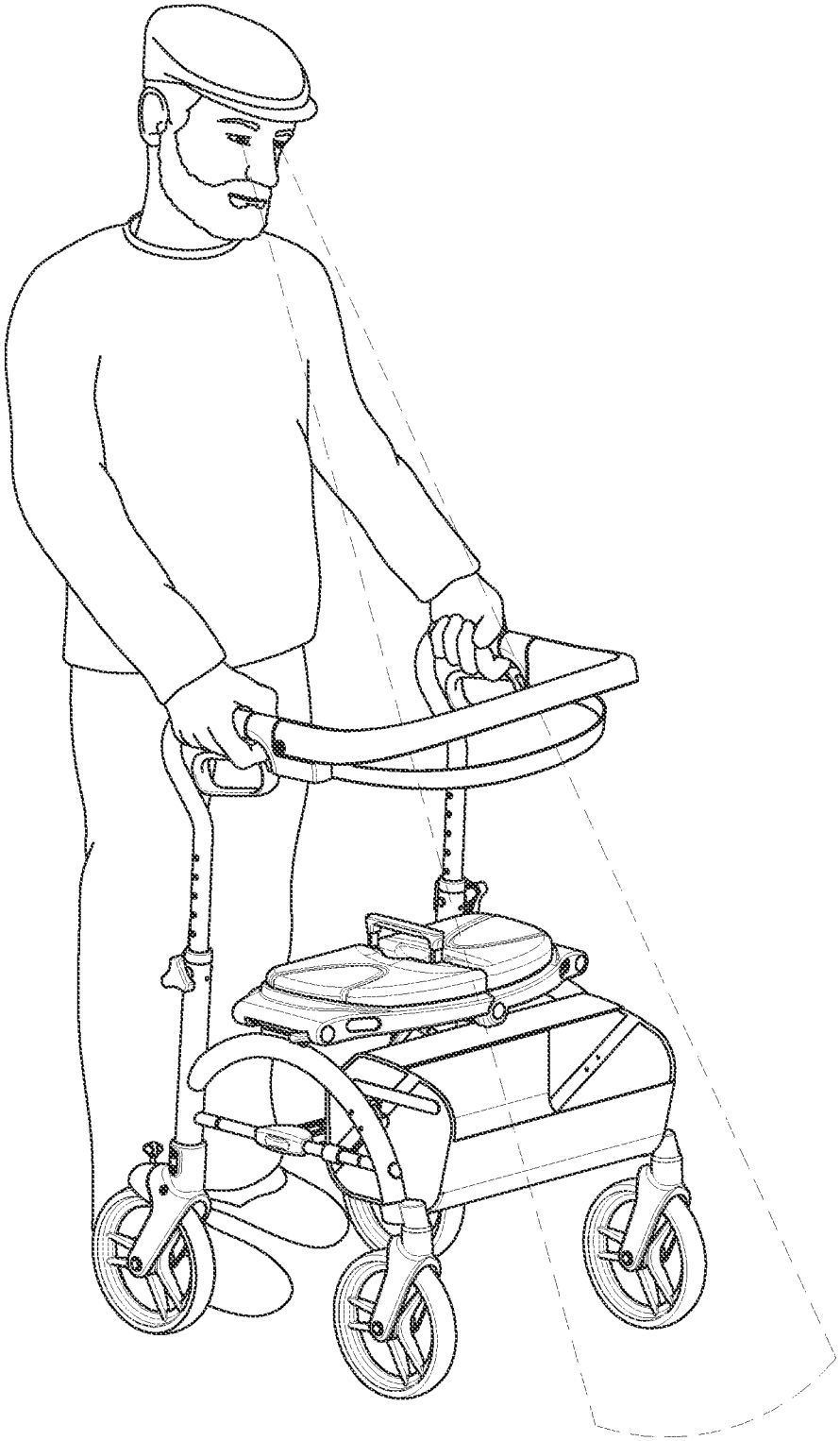
FIG. 21 is a front, side perspective view of the walker apparatus of FIG. 1 with a user gripping the upper ends of its upright frame members and looking through the backrest and past the walker apparatus towards the front thereof.

The folding mechanism is configured to selectively enable the walker apparatus to fold laterally, with the frame members 42 and 44 and support members 50 coming together thereby, as shown in FIG. 13. The folding mechanism thus enables the walker apparatus 40 to be laterally-foldable along a folding axis 71 seen in FIG. 13. Folding mechanism per se for walker apparatuses, including their various parts and functionings, are well known to those skilled in the art and thus folding mechanism 70 will not be described in further detail.

Referring back to FIG. 1, the walker apparatus 40 includes a pair of handle brake assemblies 72 and 74 that connect to and extend from respective ones of the upper ends 48 of the frame members 42 and 44. Actuation of the handle brake assemblies selectively causes at least one of the wheels 58 to brake.

The walker apparatus to this point in the description is described in further detail in U.S. Pat. No. 8,083,239 to Liu, the disclosure of which is incorporated herein by reference. Examples of telescoping tubes, wheel assemblies, folding mechanisms and braking assemblies for walkers per se, including their various parts and functionings, are well known to those skilled in the art and thus will not be described in further detail.

Referring to FIG. 1, each of the handle brake assemblies 72 and 74 includes a handle 76, actuation of which selectively causes at least one of the wheels 58 to brake. The handles are best shown in FIGS. 14 to 20. Each handle 76 is generally an elongate loop in shape and encloses an aperture 78 through which a user's hands may partially extend. Each handle has an elongated top potion 80 which is u-shaped in cross-section for receiving a thumb of the user. The operation of handle brake assemblies per se, including their various parts and their functionings, is well known to those skilled in the art and therefore will not be described in detail.

Figure 10:
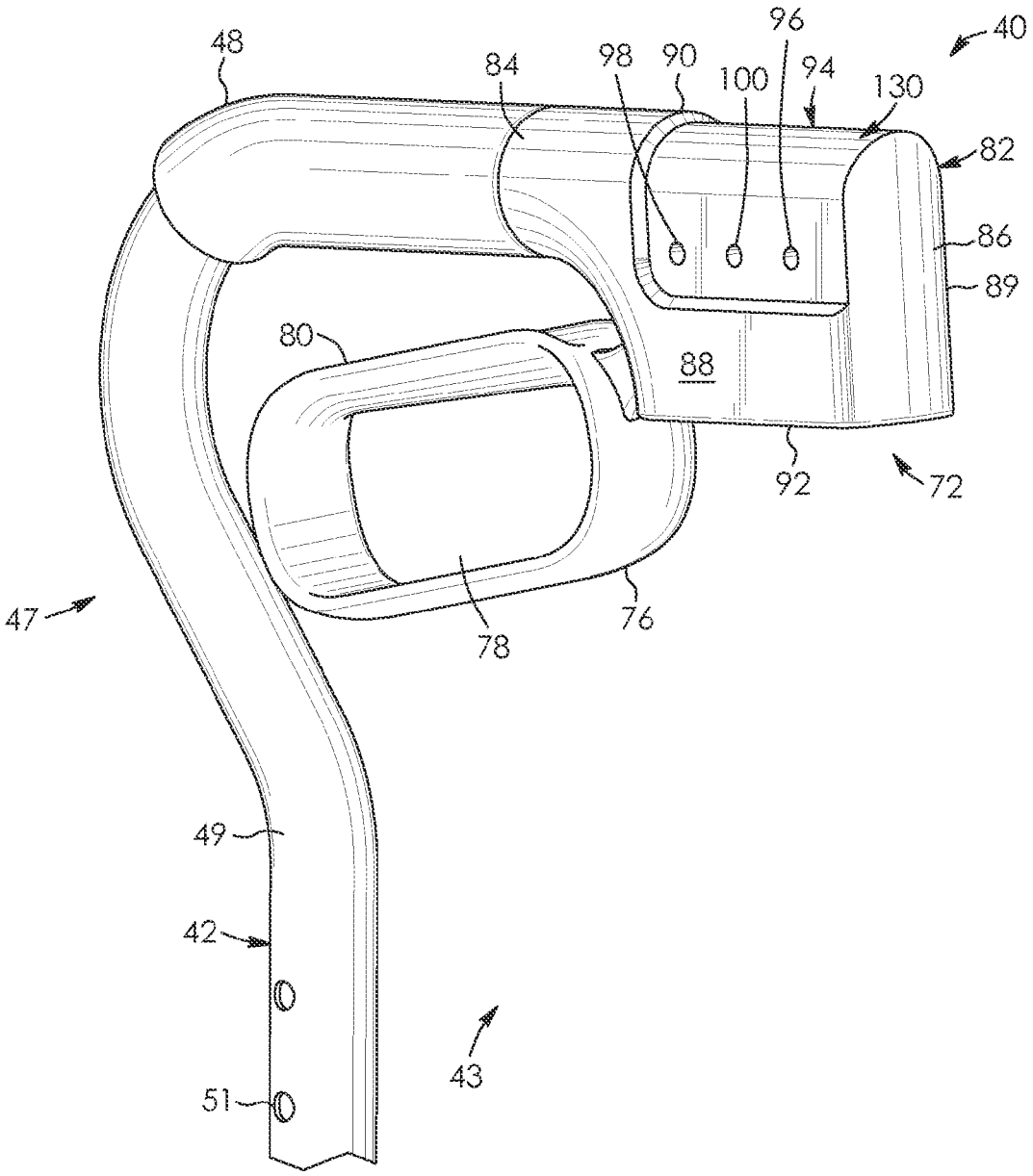
FIG. 10 is a side perspective view of a handle brake assembly of the walker apparatus of FIG. 1, together with an upright frame member thereof shown in fragment.
Figure 12:
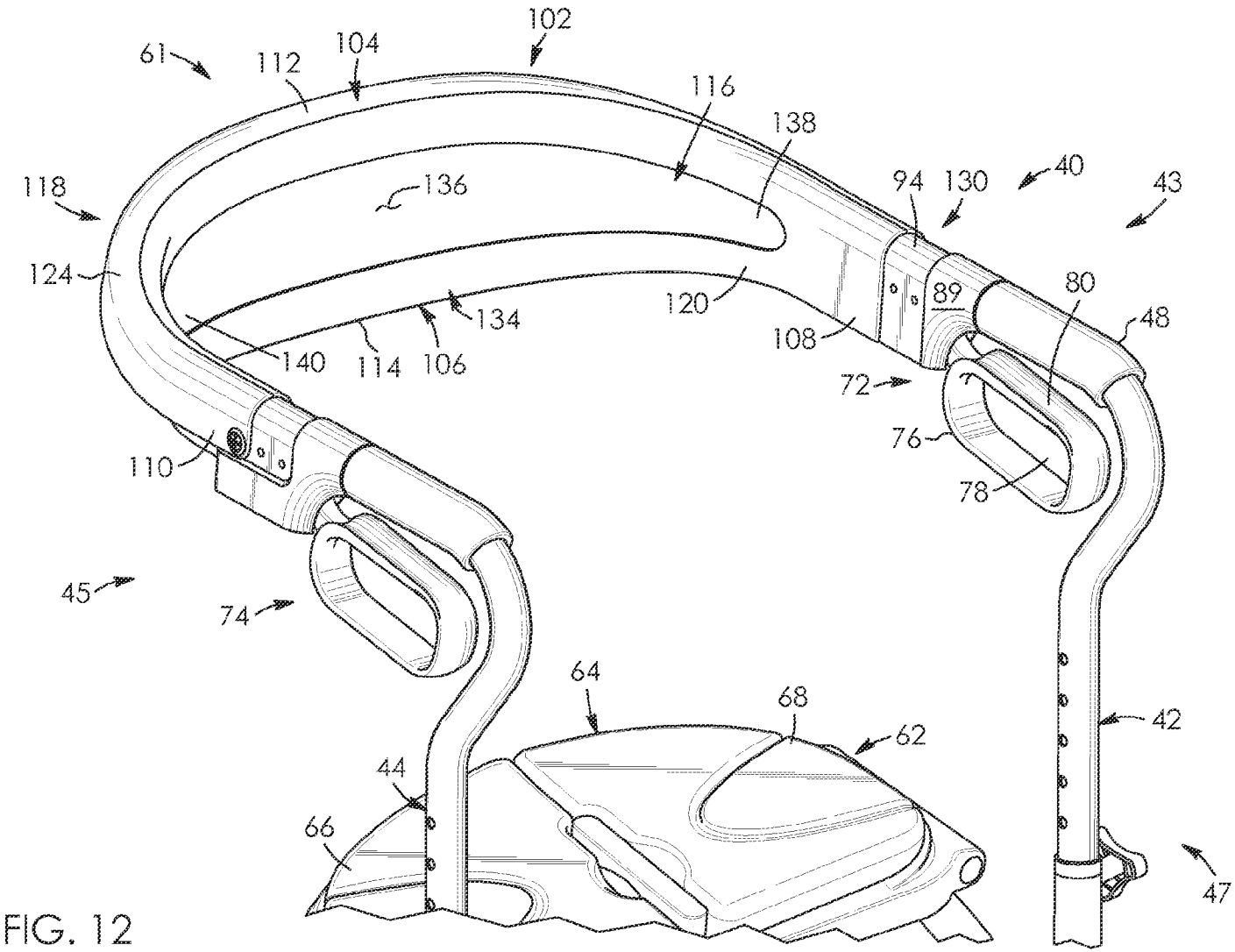
FIG. 12 is a side, rear perspective view of the walker apparatus of FIG. 11, with the backrest being shown in a second, extended position.

As seen in FIG. 1, each of the handle brake assemblies has a housing to which respective ones of the handles 76 pivotally connect, as shown by housing 82 for assembly 72. As seen in FIG. 10, each housing is generally a rectangular prism in shape with a proximal end 84 which operatively connects to the upper end 48 of its respective frame member 42, a distal end 86 which is spaced-apart from its proximal end, and a pair of spaced-apart outer and inner sides 88 and 89, which are generally rectangular in shape. Each housing 82 includes a rounded top 90 and flat bottom 92 in this example. The sides, tops and bottoms of the housings extend from the proximal ends 84 to the distal ends 86 of the housings. The sides 88 and 89 of the housings 82 extend from the tops 90 to the bottoms 92 of the housings. Each brake assembly 72 includes a recessed portion 94 which extends from the distal end 86 of the housing 82 towards the proximal end 84 of the housing. The recessed portion also extends downwards from the top 90 of the housing towards the bottom 92 of the housing by outer side 88 seen in FIG. 10 in this example. Referring to FIG. 12, the recessed portion 94 extends fully downwards from the top of the housing 82 to the bottom of the housing adjacent side 89 in this example.

As seen in FIG. 10, each handle brake assembly 72 includes a plurality of apertures extending therein at the recessed portions 94 and adjacent the outer side 88 of its housing 82. This is shown for assembly 72 by an outer aperture 96 adjacent to distal end 86 of the housing 82, an inner aperture 98 spaced-apart from aperture 96 in the direction of proximal end 84 of the housing, and an intermediate aperture 100 positioned between apertures 96 and 98.

As seen in FIG. 1, the walker apparatus 40 includes a backrest 102 cantilevered from the frame members 42 and 44. The backrest is flexible in this example and is arcuate-shaped when the walker apparatus is in its unfolded mode seen in FIG. 1. The backrest 102 according to one aspect comprises a pair of spaced-apart, arcuate-shaped elongate members, in this example in the form of straps including an upper strap 104 and a lower strap 106. The straps connect together at common respective ends, in this example proximal ends 108 and 110 of the backrest 102. The straps 104 and 106 extend along the front 61 and sides 43 and 45 of the walker apparatus 40 in this example.

Figure 3:
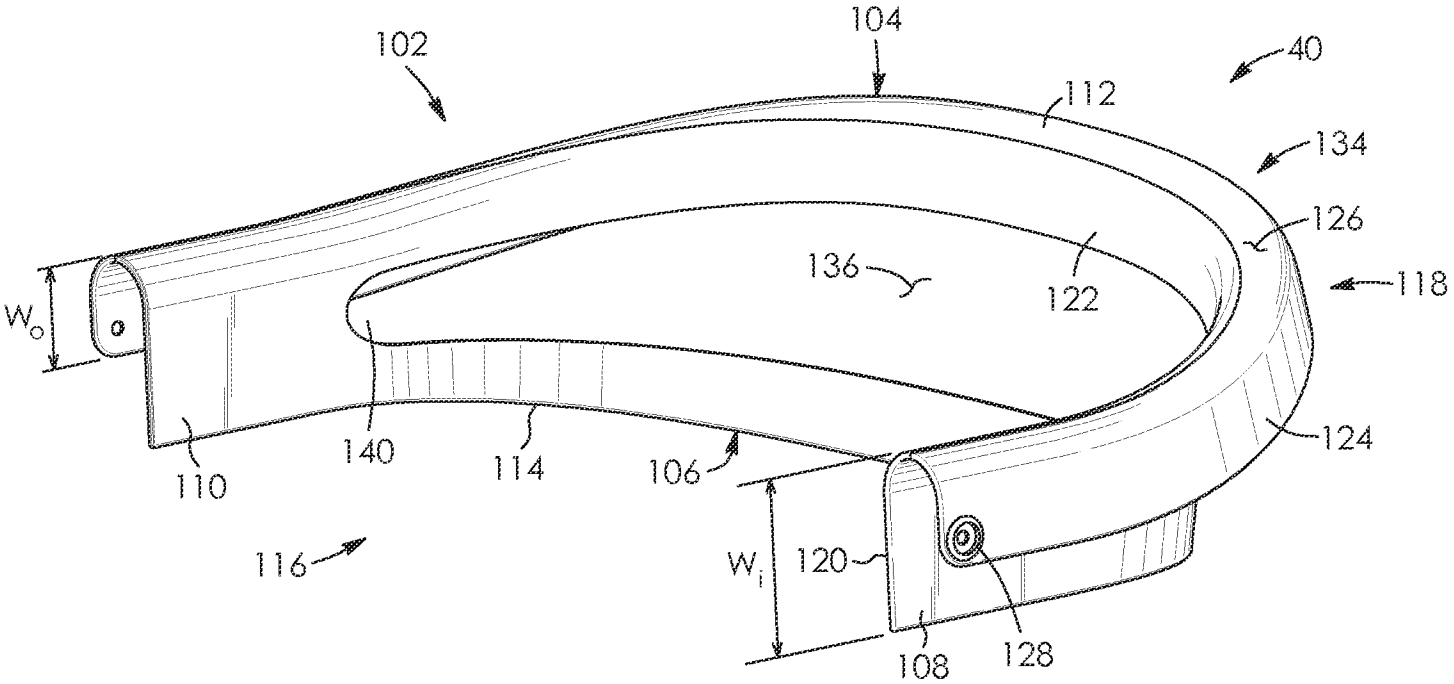
FIG. 3 is a rear, side perspective view of the backrest of FIG. 1.
Figure 6:
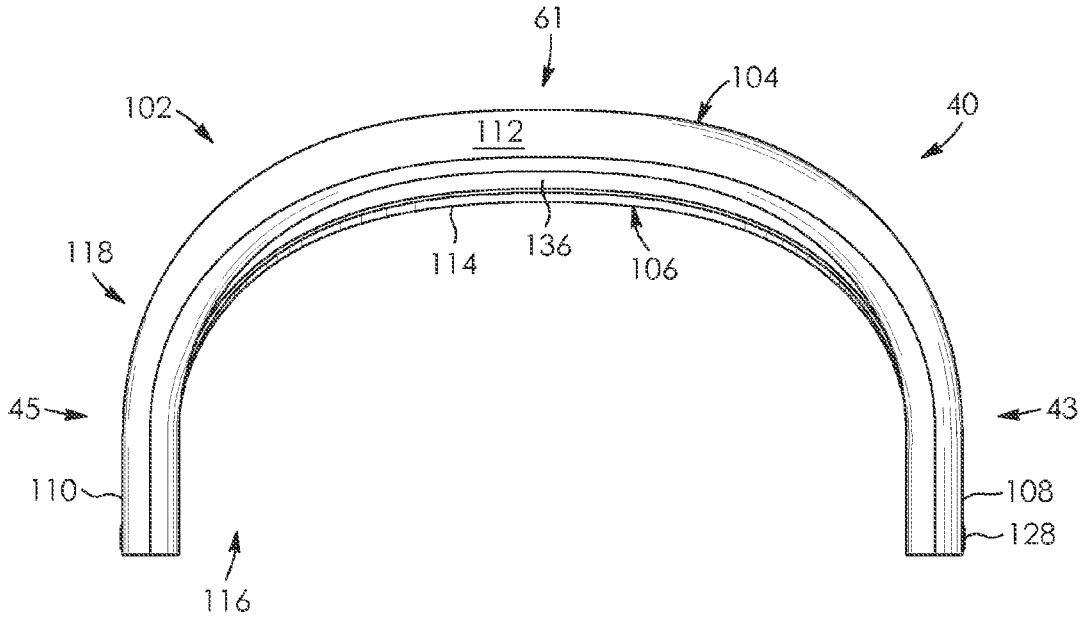
FIG. 6 is a top plan view of the backrest of FIG. 3.
Figure 7:
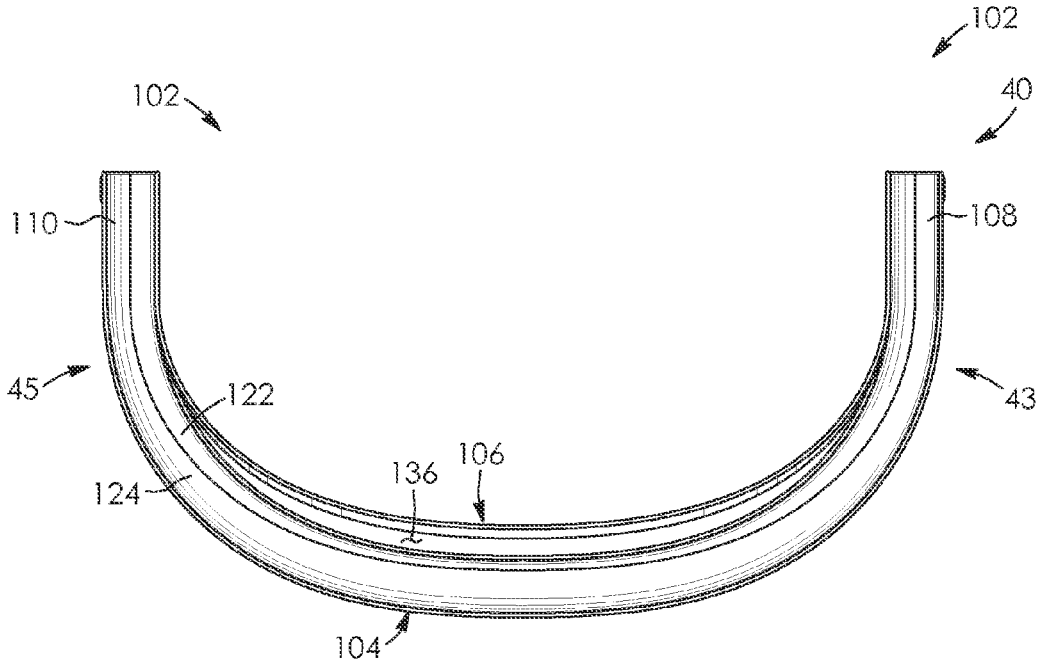
FIG. 7 is a bottom plan view of the backrest of FIG. 3.
Figure 8:
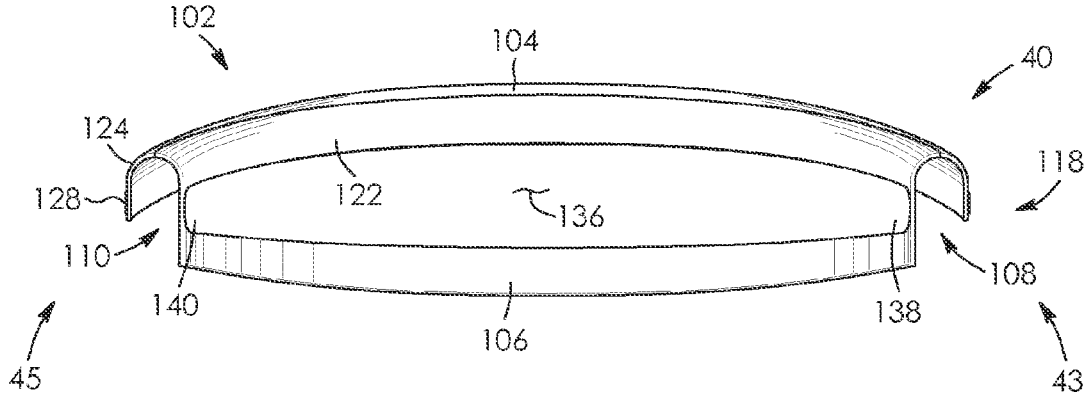
FIG. 8 is a rear elevation view of the backrest of FIG. 3.

Referring to FIG. 3, the backrest includes a top 112 on the upper strap 104 and a bottom 114 on lower strap 106. The top and bottom of the backrest 102 are generally arcuate or u-shaped, as seen in FIGS. 6 and 7. As best seen in FIG. 3, the upper strap 104, as well as top 112, are u-shaped and upwardly-convex in cross-section in this example. The lower strap 106 is substantially rectangular in cross-section in this case. Referring to FIG. 6, the backrest 102 includes a concave-shaped interior 116 and a convex-shaped exterior 118. As seen in FIG. 3, the interior and exterior of the backrest extend from the top 112 to the bottom 114 of the backrest.

Referring to FIG. 3, the backrest has an inner portion 120 which in this example is formed of polypropylene, though is not strictly required and other materials may be used in other embodiments. The inner portion of the backrest 102 includes lower strap 106. Inner half 122 of the upper strap 104 is within the interior 116 of the backrest. The inner portion 120 of the backrest is positioned within the interior 116 of the backrest. The inner portion of the backrest 102 has a width $W_i$, extending from the top 112 to the bottom 114 of the backrest. The inner portion of the backrest is substantially rectangular in cross-section with the exception of at the top 112 of the backrest, where the inner portion at least partially curves outwards towards exterior 118 of the backrest.

Figure 11:
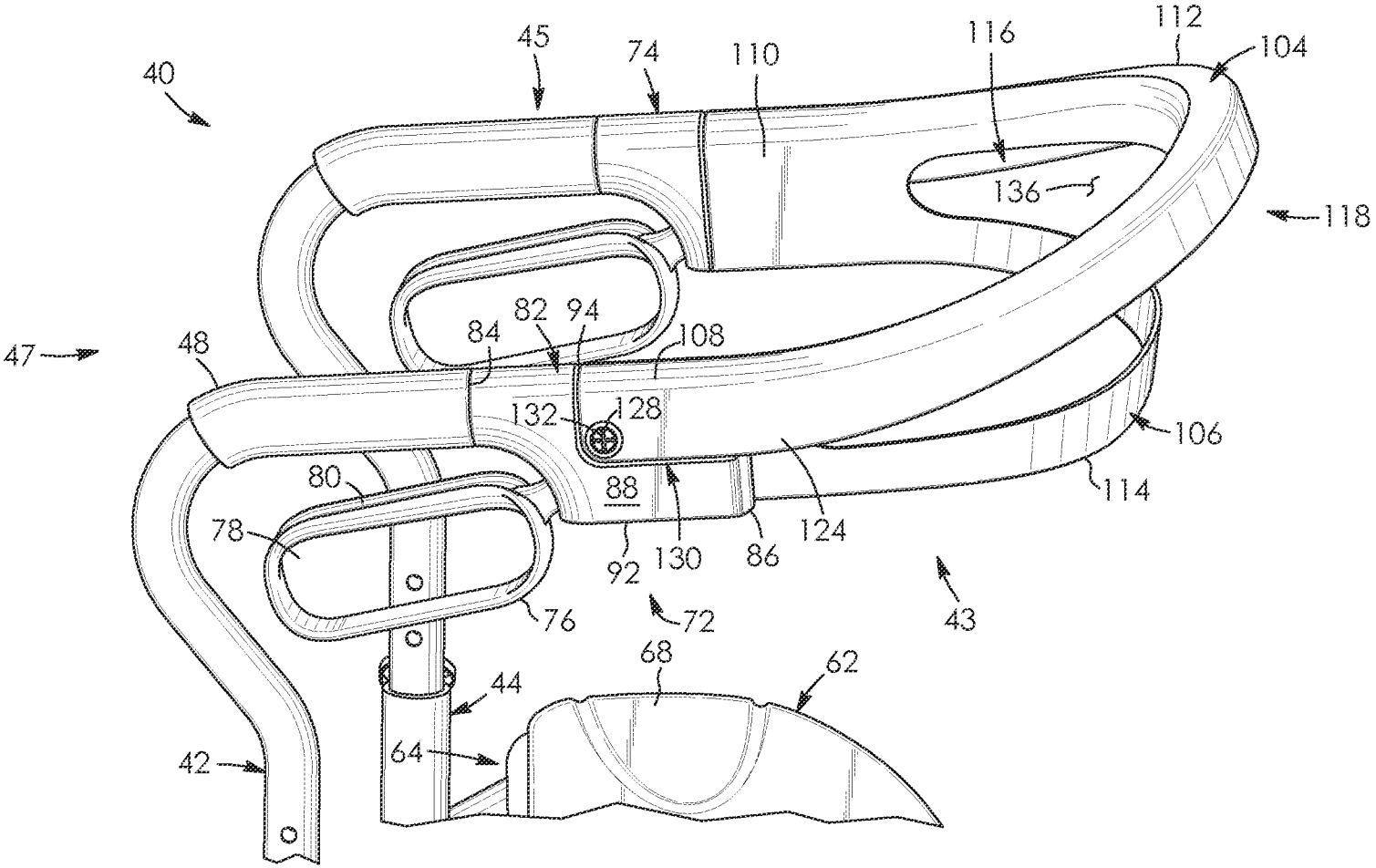
FIG. 11 is a side perspective view of the walker apparatus in fragment showing its handle brake assemblies and backrest connected thereto as well as its upright frame members in fragment, the backrest being shown in a first, retracted position.

The inner portion 120 of the backrest 102, is shaped at the proximal ends 108 and 110 of the backrest, to be received over recessed portions 94 of the handle brake assemblies at sides 89 of the housings. This is shown in FIG. 12 by inner portion 120 at proximal end 108 of the backrest being received over recessed portion 94 of assembly 72. Referring to FIG. 11, the cross-sectional thickness of the backrest 102, at its ends 108 and 110, is generally equal to the extent to which recessed portions 94 are recessed from the rest of the housings 82 of the handle brake assemblies in this example.

Referring back to FIG. 3, the backrest has an outer portion 124 connected to and extending outwards from its inner portion 120. The outer portion of the backrest 102 comprises an outer half 126 of the upper strap 104. The outer half 126 is positioned adjacent to the exterior 118 of the backrest. The outer portion 124 of the backrest 102 in this example is formed by thermoplastic polyurethane, though this is not strictly required and other materials may be used in other embodiments. The outer portion of the backrest has a width $W_o$ extending from top 112 in a downwards direction. The width of the outer portion 124 of the backrest 102 is generally about half of the width $W_i$, of the inner portion 120 of the backrest in this example. The outer portion of the backrest is substantially rectangular in cross-section with the exception of at the top 112 of the backrest, where it curves inwards towards interior 116 of the backrest and connects to the inner portion 120 of the backrest. The outer portion 124 of the backrest 102, at the proximal ends 108 and 110 of the backrest, is shaped to be received over recessed portions 94 of respective ones of the handle brake assemblies at sides 88. This is shown in FIG. 11 by outer portion 124 at proximal end 108 of the backrest 102 being received over recessed portion 94 of assembly 72.

The backrest 102 includes a pair of apertures, each extending through the outer portion 124 of the backrest at locations adjacent to respective ones of the proximal ends 108 and 110 of the backrest. This is seen in FIG. 3 by aperture 128 extending through the outer portion 124 of the backrest adjacent end 108.

As seen with reference to FIGS. 1 and 10, the backrest includes an adjustment mechanism 130 that enables a user to adjust the extent to which the backrest 102 extends from the frame members 42 and 44 to accommodate different body types. In this case, the adjustment mechanism includes a plurality of female connectors, in this example in the form of horizontally spaced-apart apertures 96, 98 and 100 seen in FIG. 10, portions of assembly 72 adjacent to said apertures, apertures 128 seen in FIG. 11 and portions of the backrest 102 adjacent to apertures 128. The adjustment mechanism 130 also includes a plurality of male connectors, in this case fasteners, in this example screws 132 which extend through respective ones of apertures 128 and engage with selectively ones of apertures 96, 98 and 100. When screws 132 extend through inner apertures 98 seen in FIG. 10, the backrest 102 may be in a first, retracted position, seen in FIG. 11, in which the proximal ends 108 and 110 of the backrest fully extend around the recessed portions 94 of the assemblies 72 and 74.

When the screws 132 extend through outer apertures 96 seen in FIG. 10, the backrest may be in a second, extended position, seen in FIG. 12. The extended position of the backrest seen in FIG. 12 is more spaced-apart from frame members 42 and 44 compared to the retracted position of the backrest shown in FIG. 11. The backrest 102 is thus selectively connectable to a plurality of different spaced-apart positions along the handle brake assembly 72, with positioning of the straps 104 and 106 being adjustable thereby.

Figure 4:
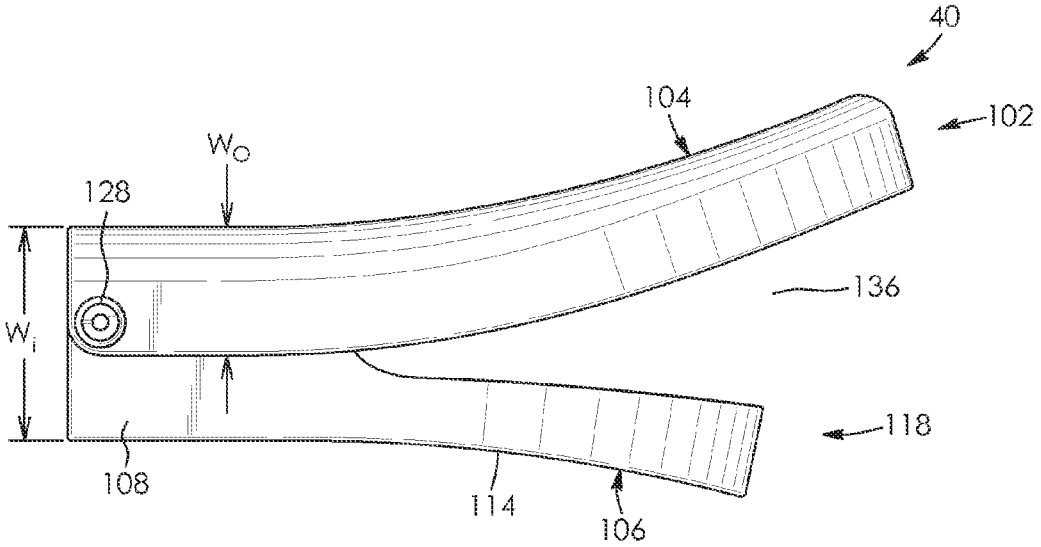
FIG. 4 is a first side elevation view of the backrest of FIG. 3.
Figure 5:
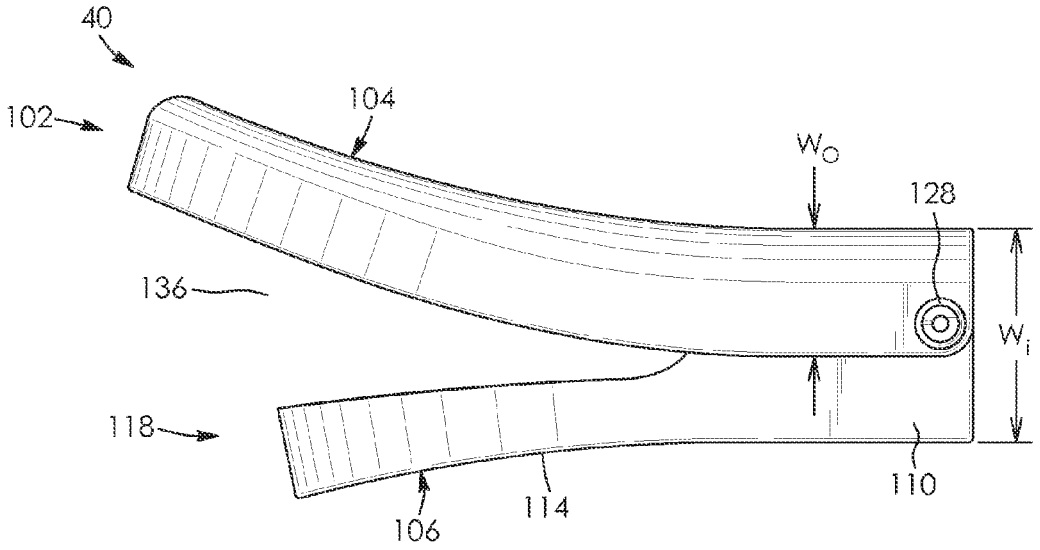
FIG. 5 is a second side elevation view of the backrest of FIG. 3.

As seen in FIG. 11, the upper strap 104 thus extends from the upper ends 48 of the frame members 42 and 44. As seen in FIG. 4, the upper strap in this example extends in an upwardly curved manner, in this case in an upwardly-concave manner, from respective ones of the frame members. Lower strap 106 extends in this example in a downwardly curved manner, and in this case, a downwardly-concave manner. The straps 104 and 106 thus extend from the frame members 42 and 44 in outwardly divergent directions relative to each other.

As best seen in FIG. 12, the backrest 102 has a central portion 134 positioned between the frame members 42 and 44. The straps 104 and 106 are increasingly spaced-apart away from their ends 108 and 110 and towards the central portion 134 of the backrest. As seen in FIG. 13, the straps are most spaced-apart relative to each other in a region 135 aligning with the folding axis 71 of the walker apparatus.

Figure 9:
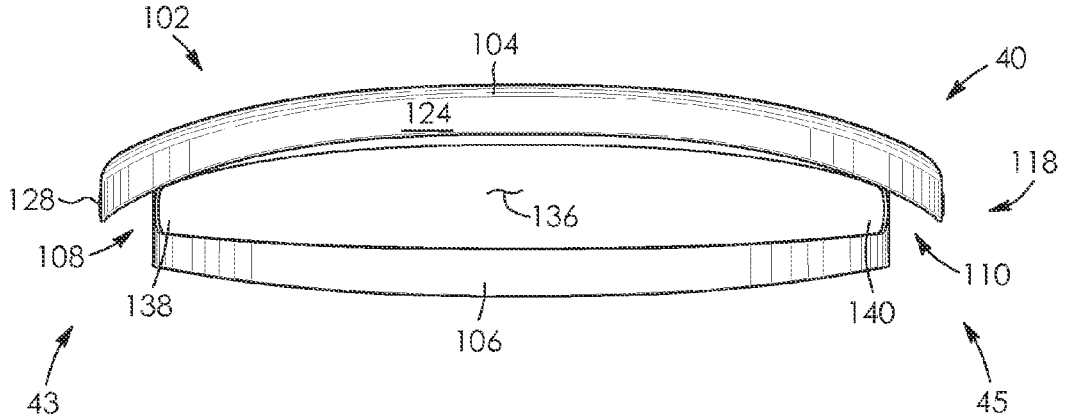
FIG. 9 is a front elevation view of the backrest of FIG. 3.

Referring now to FIG. 9, the backrest 102 has at least one opening extending therethrough for permitting a user's vision past the backrest when the user grips the upright frame members 42 and 44. The at least one opening in this example is in the form of an elongated aperture 136 extending therethrough. The aperture is oval-shaped in this example, is positioned between the straps 104 and 106, shown in FIG. 1, and extends in a substantially horizontal direction in this example. The aperture 136 has spaced-apart ends 138 and 140 which are tapered and rounded in this example. Ends 138 and 140 are positioned adjacent to proximal ends 108 and 110, respectively, of the backrest 102 in this example. The tapered ends of the aperture and proximal ends of the backrest are positioned adjacent to the sides 43 and 45 of the walker apparatus 40. Straps 104 and 106 may be said to comprise a single backrest that is horizontally-split.

The above set out structure may result in a backrest that is more compact, lighter, and more ergonomically friendly, resulting in a walker apparatus that may be easier and safer to use, and easier to fold compared to walker backrests and walkers of the known prior art.

Figure 22:
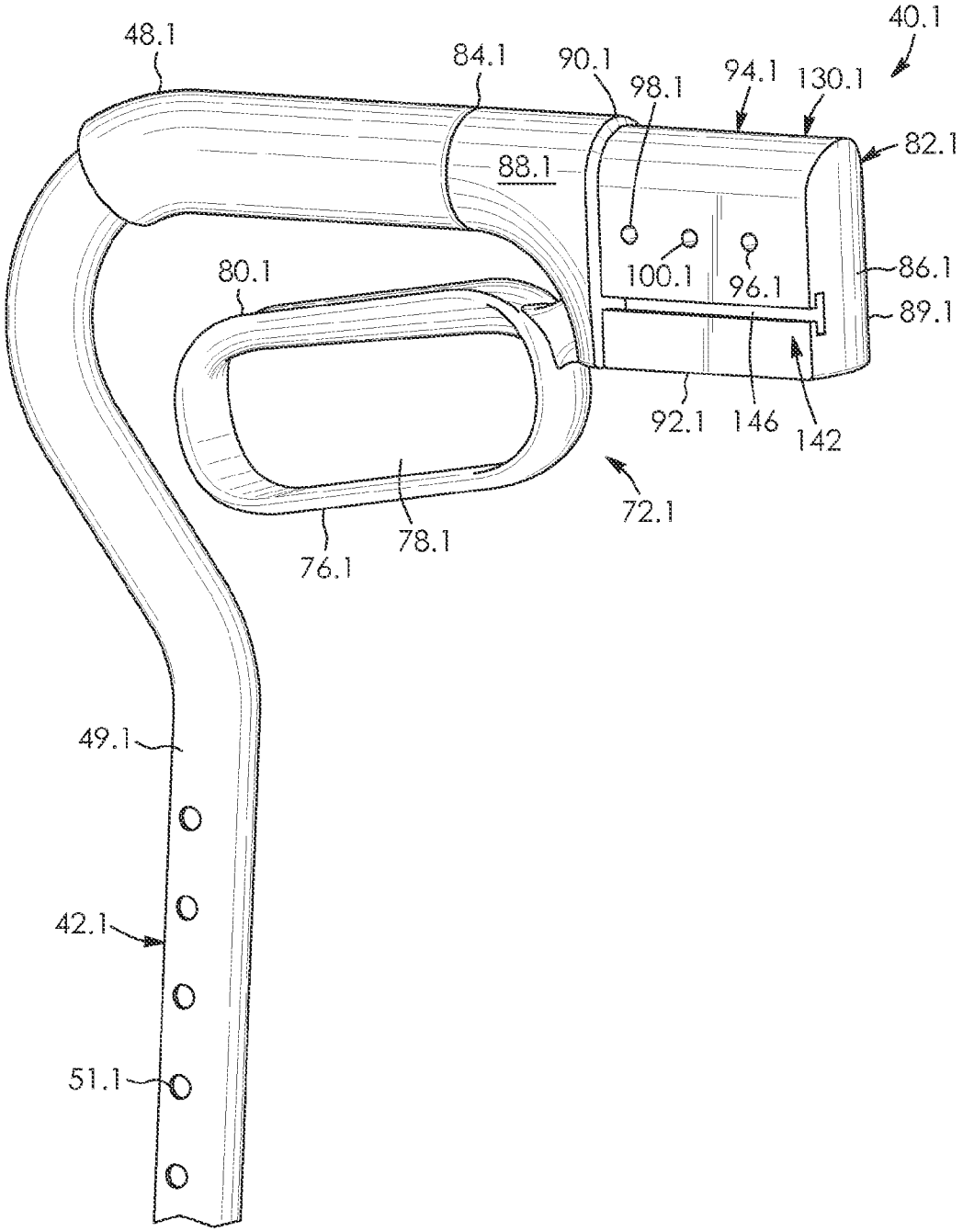
FIG. 22 is a side perspective view of a handle brake assembly, together with an upright frame member shown in fragment, for a walker apparatus according to a second aspect.
Figure 23:
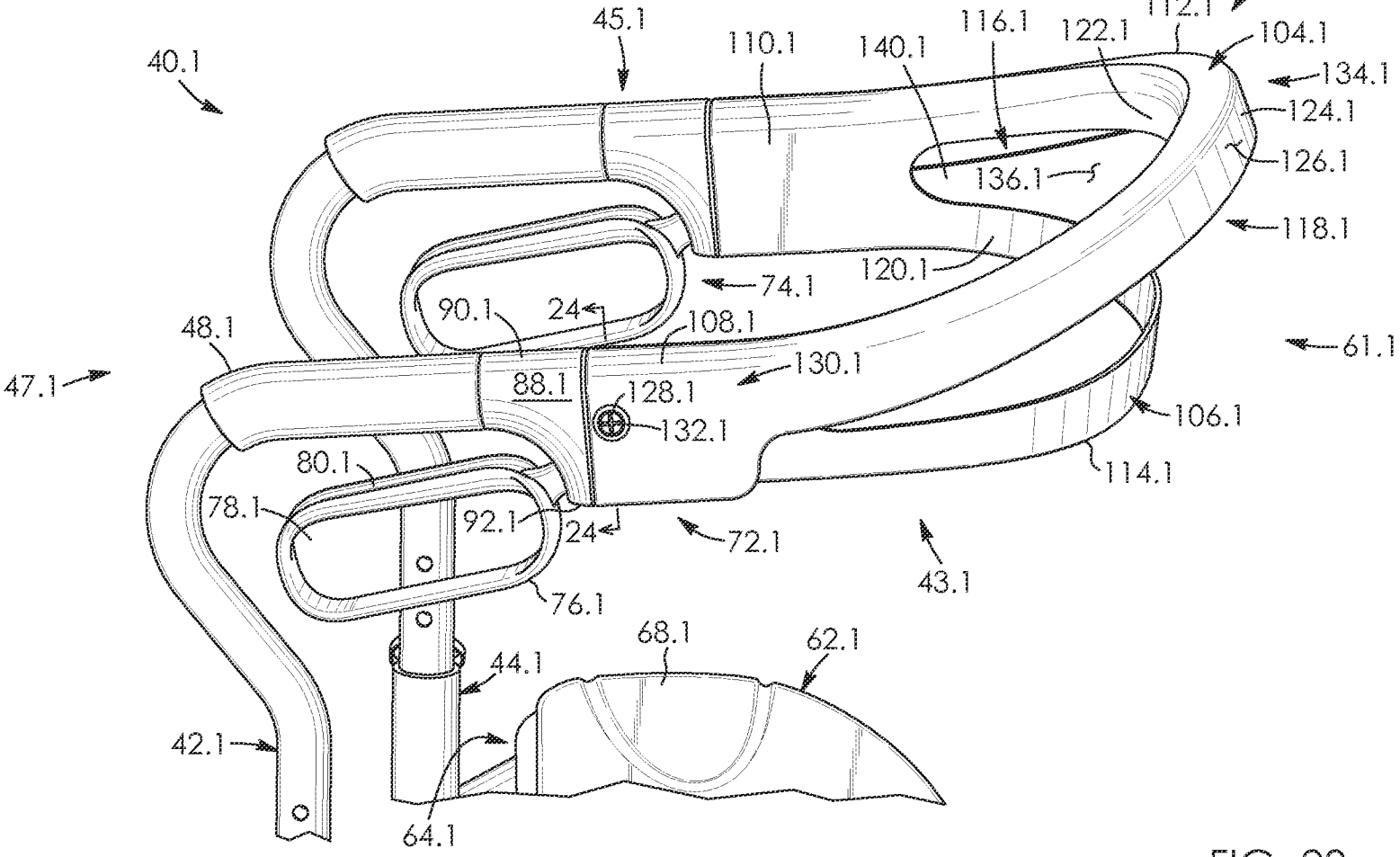
FIG. 23 is a side perspective view of the walker apparatus of FIG. 22 showing its handle brake assemblies and backrest connected thereto as well as its upright frame members in fragment.
Figure 24:
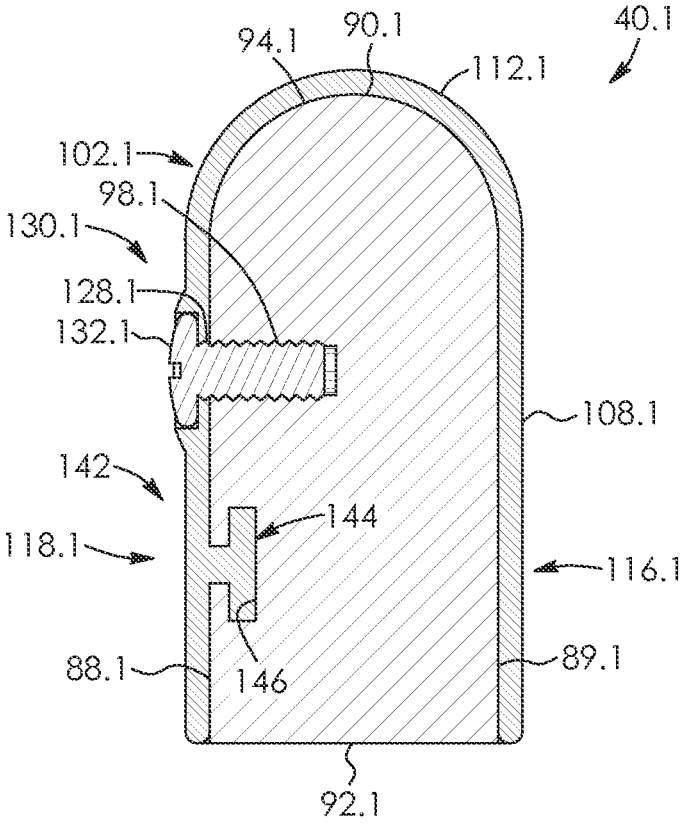
FIG. 24 is a sectional view of the handle brake assemblies of the walker apparatus taken along line 23-23 of FIG. 22.

FIGS. 22 to 24 show a walker apparatus 40.1 according to a second aspect. Like parts have like numbers and functions as the apparatus shown in FIGS. 1 to 21 with the addition of decimal extension "0.1". Walker apparatus 40.1 is substantially the same as walker apparatus 40 shown in FIGS. 1 to 21, with backrest 102.1 being cantilevered to upper ends 48.1 of frame members 42.1 and 44.1 and having an aperture 136.1 extending therethrough, but with the apparatus having at least the following exceptions. As seen in FIG. 22, recessed portions 94.1 of the housings 82.1 extend from the top 90.1 to the bottom 92.1 of the housings in this example. The proximal ends of the backrest 102.1 at the exterior 118.1 of the backrest 102.1 extend over the recessed portions of the housing 82.1 from the top to the bottom of the housing, as shown by proximal end 108.1 of the backrest in FIG. 23.

Walker apparatus 40.1 further includes a pair of slide rail assemblies connected to respective ones of the handle brake assemblies, as shown by slide rail assembly 142 seen in FIGS. 22 and 24 for handle brake assembly 72.1. Referring to FIG. 24, each slide rail assembly comprises an elongate male portion, in this example a bracket 144 which, in this example, is connected to and which extends along the proximal end 108.1 of the backrest 102.1. Each slide rail assembly 142 includes an elongate female portion, in this example in the form of a recess 146, which, in this example, extends parallel to and inward from side 88.1 of housing 82.1 adjacent to recessed portion 94.1 of the housing. Recess 146 is positioned adjacent to and is spaced-apart from bottom 92.1 of the housing in this example. The recess is shaped to slidably receive bracket 144 and is T-shaped in cross-section in this example, as seen in FIG. 22. The backrest 102.1 thus connects to and is extendable from the frame members 42.1 via the slide rail assemblies 142. Alternatively, brackets 144 may connect to the housing 82.1 and an elongate female portion may connect to, or alternatively, be a part of the proximal ends 108.1 of the backrest 102.1.

Figure 25:
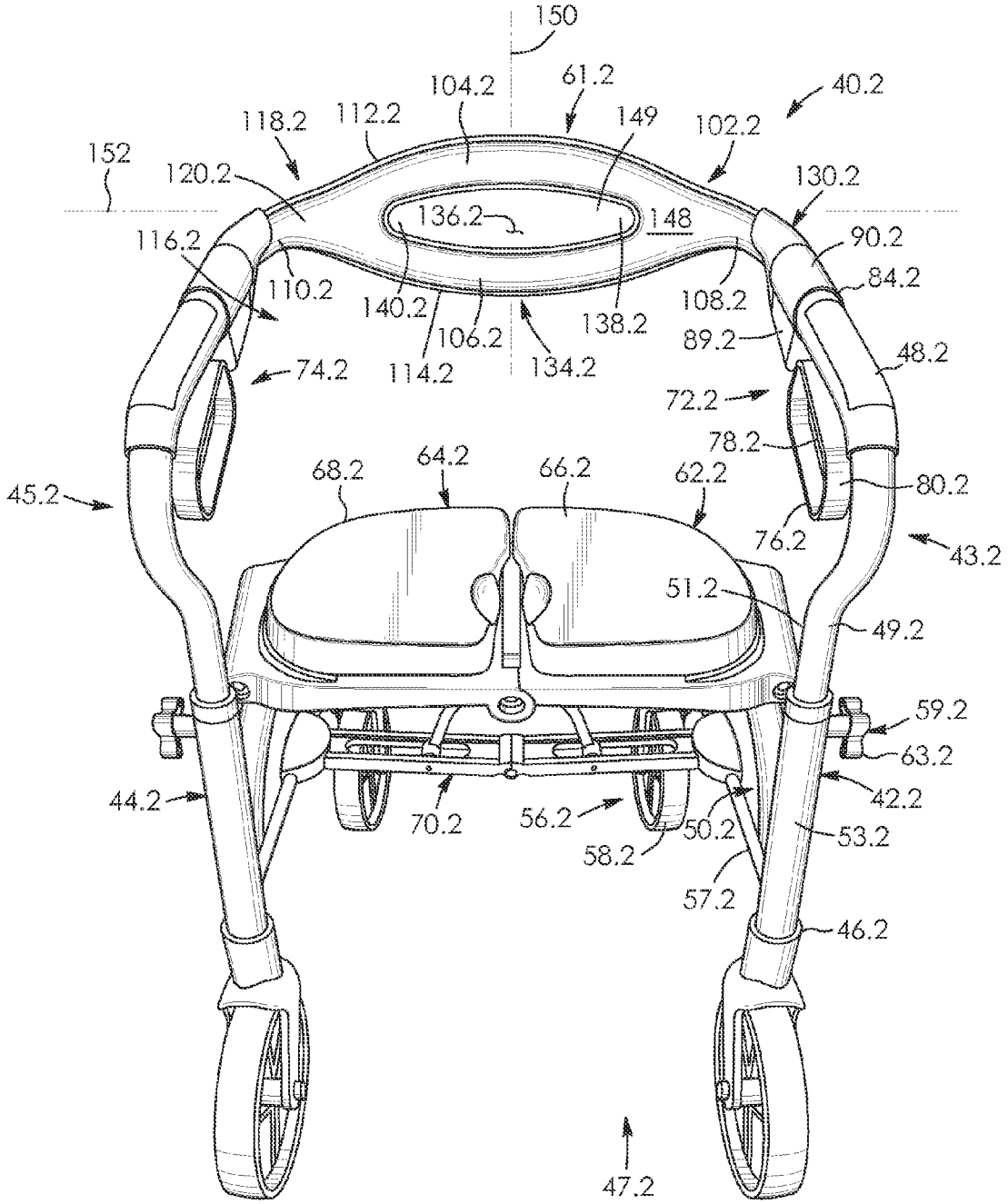
FIG. 25 is a rear perspective view of a walker apparatus having a backrest according to a third aspect.
Figure 26:
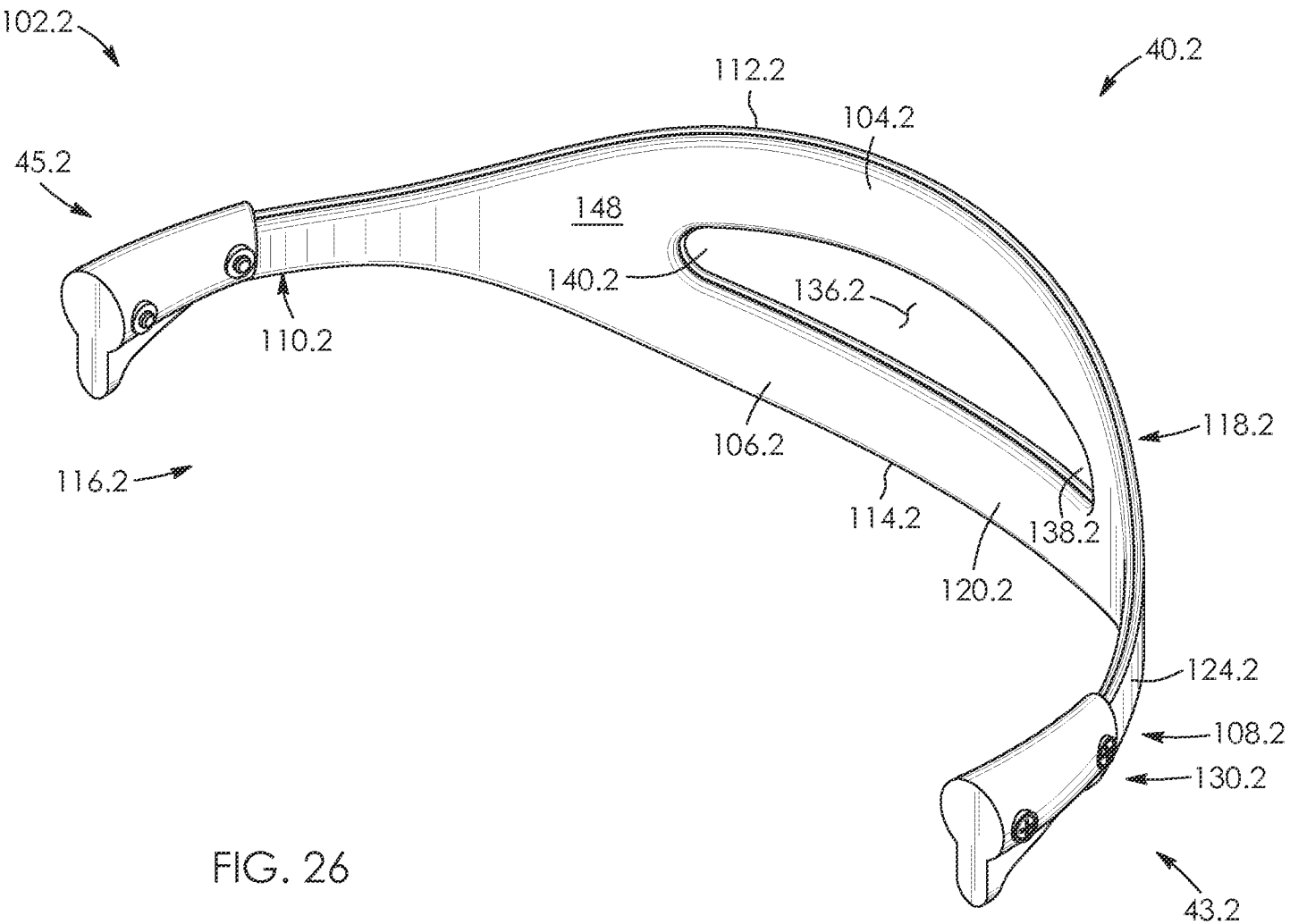
FIG. 26 is a rear, side perspective view of the backrest of the walker apparatus of FIG. 25.
Figure 27:
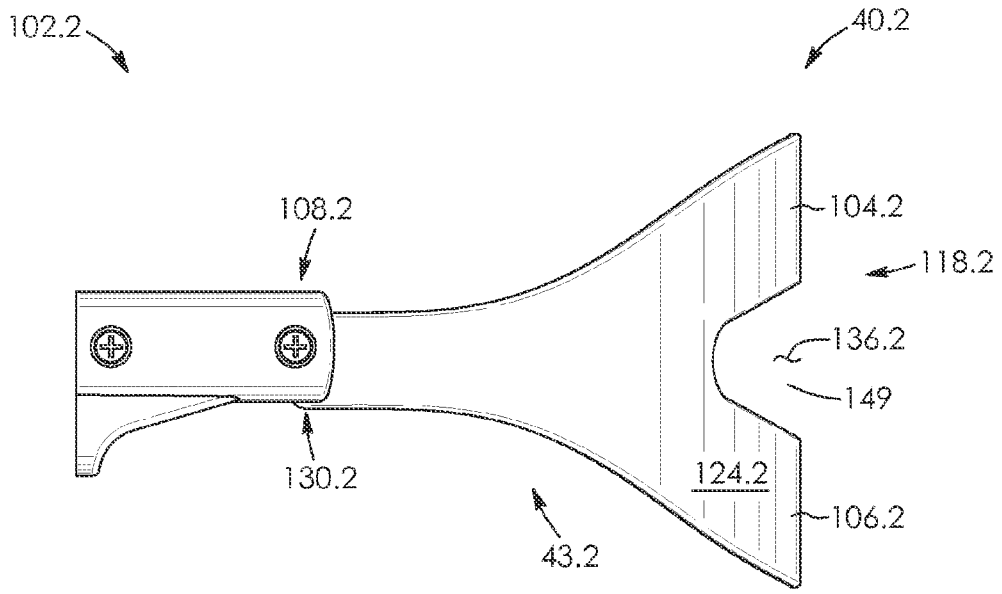
FIG. 27 is a first side elevation view thereof.
Figure 28:
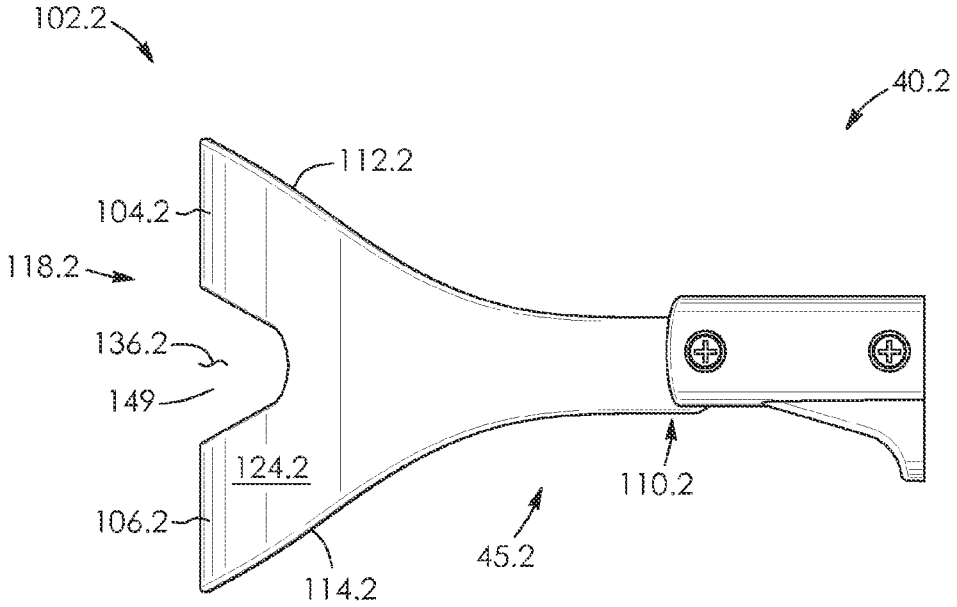
FIG. 28 is a second side elevation view thereof.
Figure 29:
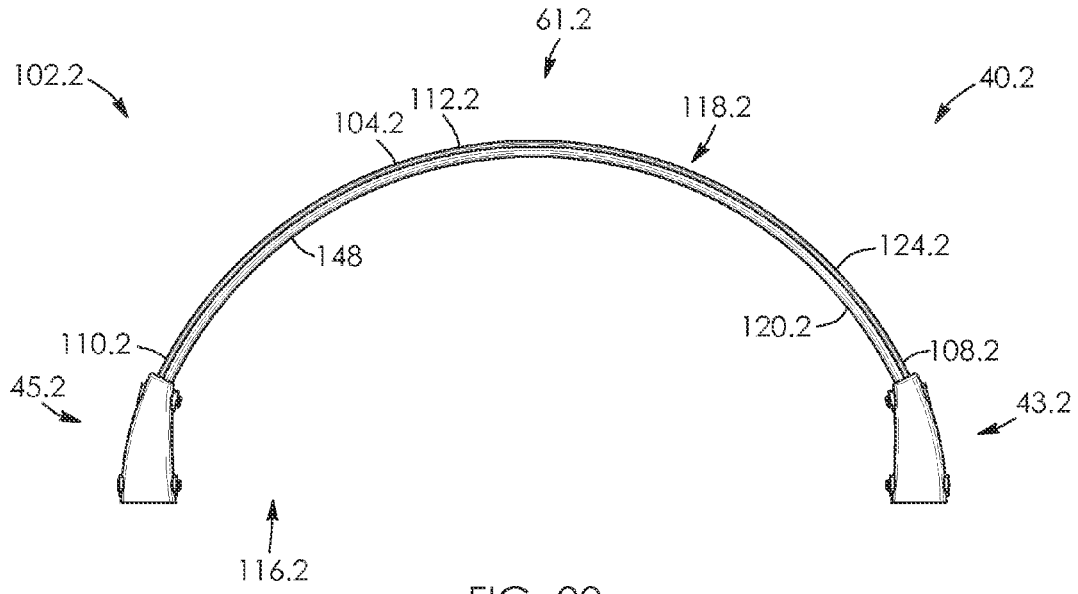
FIG. 29 is a top plan view thereof.
Figure 30:
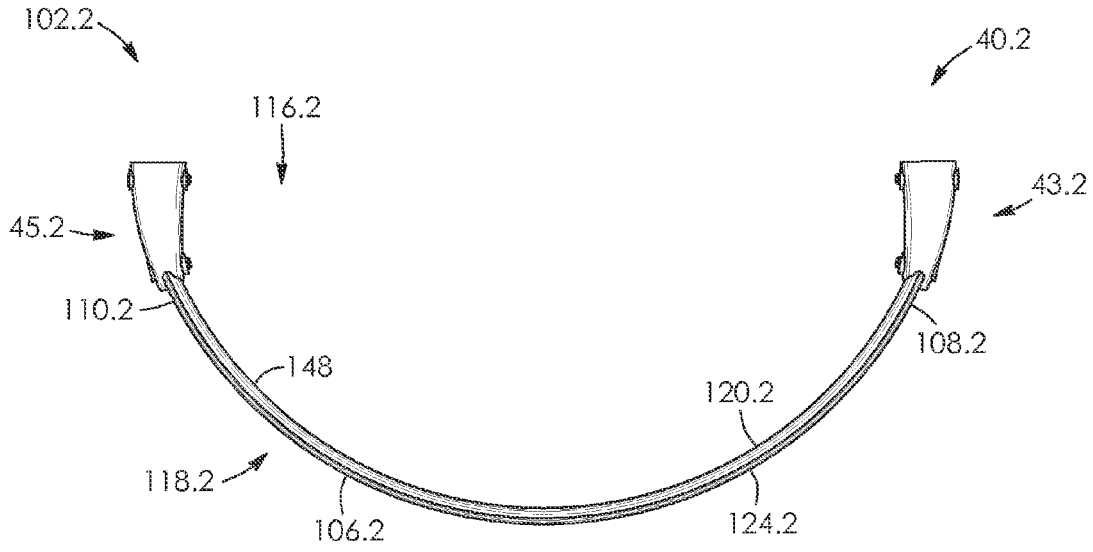
FIG. 30 is a bottom plan view thereof.
Figure 31:
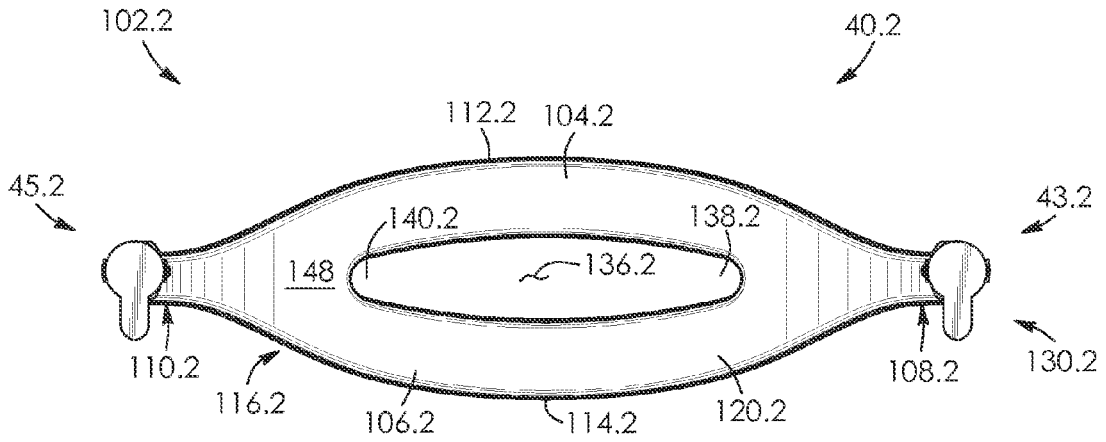
FIG. 31 is a front elevation view thereof.
Figure 32:
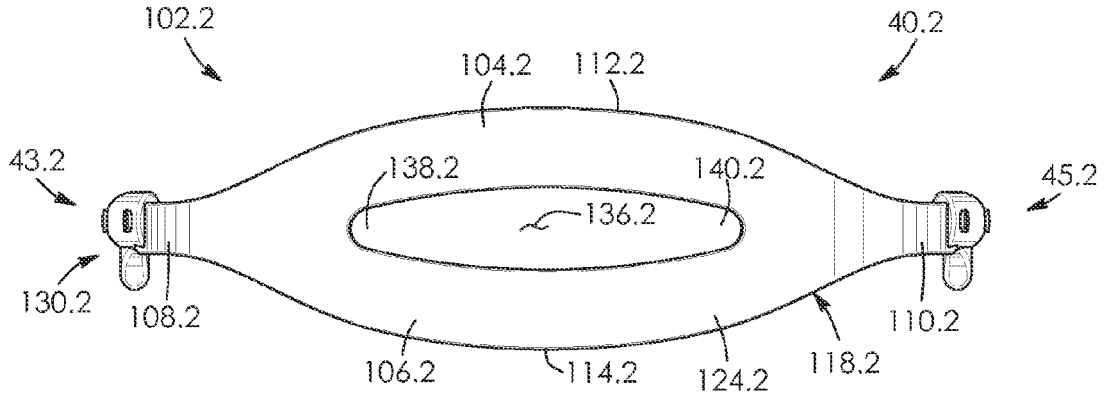
FIG. 32 is a rear elevation view thereof.
Figure 33:
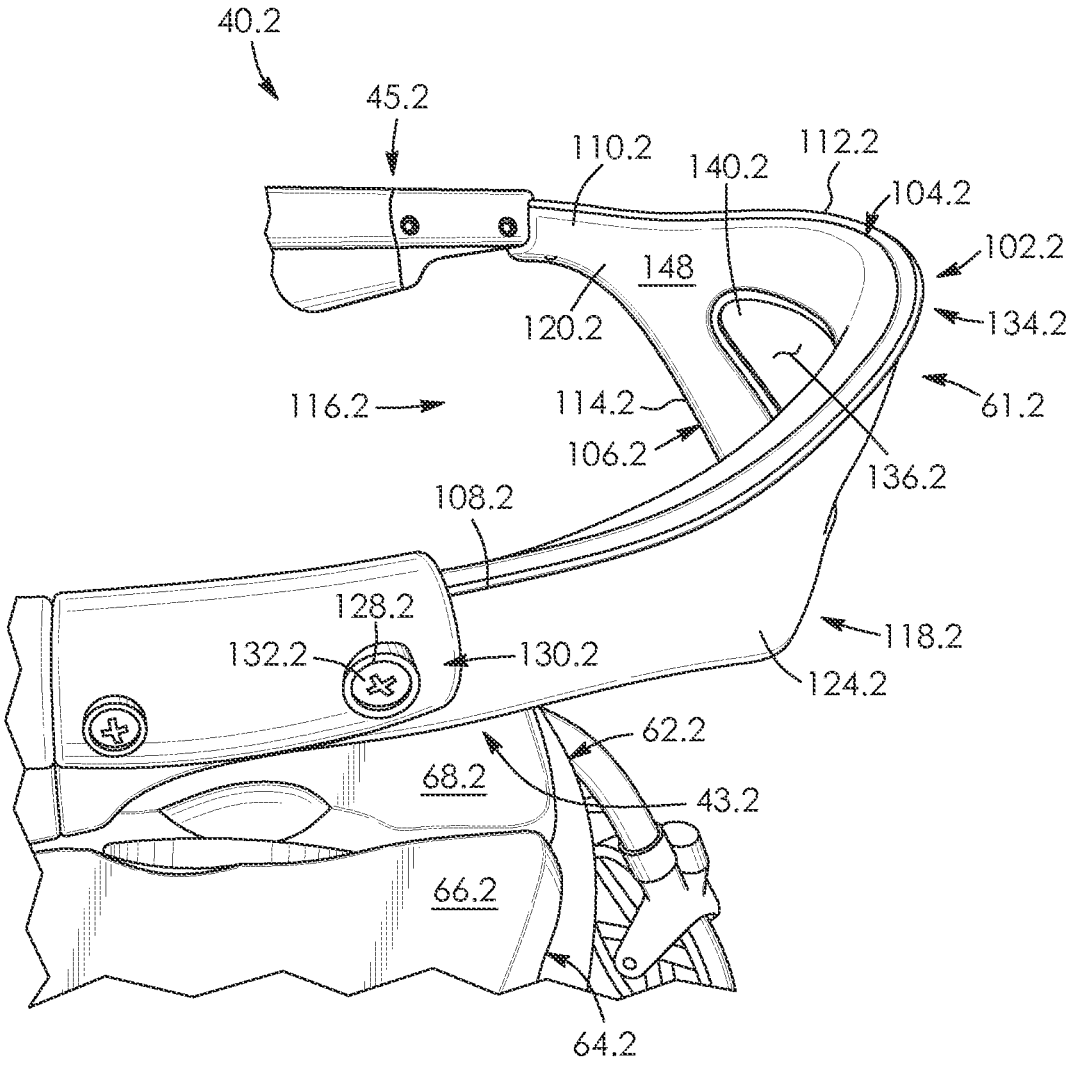
FIG. 33 is a fragmentary, side perspective view of the walker apparatus of FIG. 25 showing its handle brake assemblies and backrest connected thereto.

FIGS. 25 to 33 show a walker apparatus 40.2 according to a third aspect. Like parts have like numbers and functions as the apparatus shown in FIGS. 1 to 21 with the addition of decimal extension "0.2". Walker apparatus 40.2 is generally similar to walker apparatus 40 shown in FIGS. 1 to 21, with backrest 102.2 being cantilevered to upper ends 48.2 of frame members 42.2 and 44.2 and having an aperture 136.2 extending therethrough, but with the apparatus having at least the following exceptions. In this case, straps 104.2 and 106.2 extend along the front 61.2 of the walker apparatus, as best seen in FIG. 33. The backrest 102.2 includes a cushioning member 148 located at, and positioned within, the concave-shaped interior 116.2 of the backrest. As seen in FIG. 25, the cushioning member has an aperture 149 that coincides with aperture 136.2 of the backrest. As seen in FIG. 25, ends 138.2 and 140.2 of aperture 136.2 are inwardly spaced-apart from proximal ends 108.2 and 110.1 of the backrest 102.2 and frame members 42.2 and 44.2. Backrest 102.2, straps 104.2 and 106.2 and aperture 136.2 are substantially symmetrical about the vertical, central axis 150 of the backrest and are substantially symmetrical about the horizontal axis 152 of the backrest in this case. The horizontal axis of the backrest and the upper ends 48.2 of the frame members 42.2 and 44.4 align within a horizontal plane in this example and straps 104.2 and 106.2 extend upwards and downwards from said horizontal plane, respectively, in this example as they extend towards the central portion 134.2 of the backrest.

Figure 34:
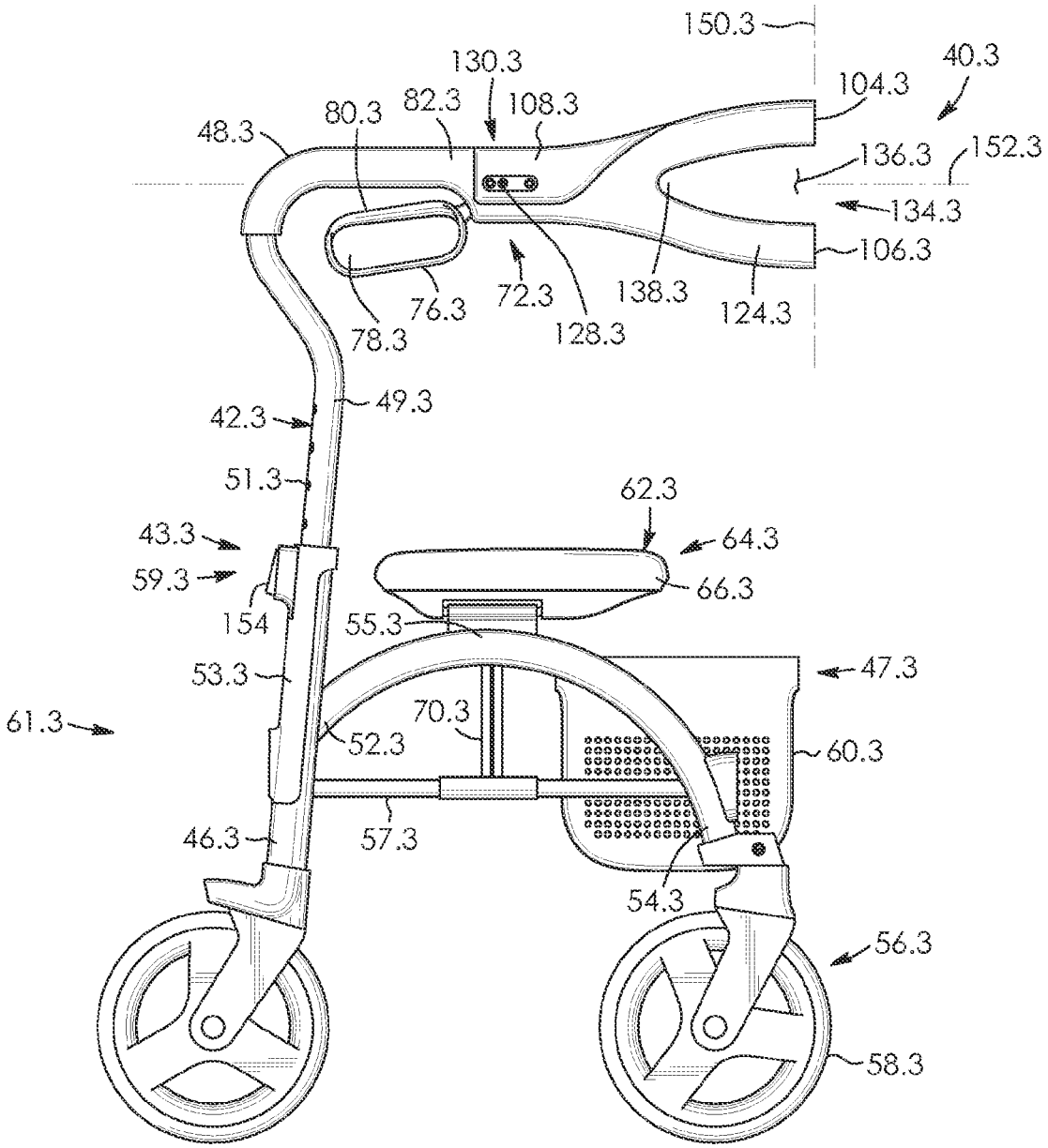
FIG. 34 is a side elevation view of a walker apparatus according to a fourth aspect.
Figure 35:
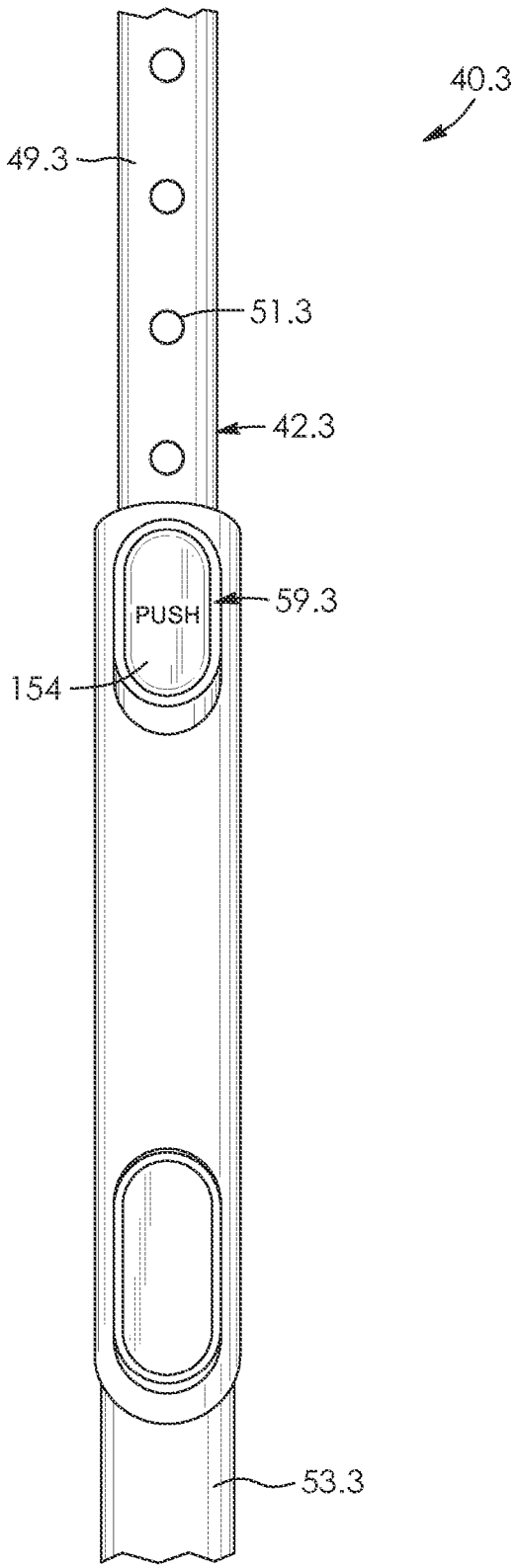
FIG. 35 is a fragmentary, rear elevation view of a frame member of the walker apparatus of FIG. 34.

FIGS. 34 and 35 show a walker apparatus 40.3 according to a fourth aspect. Like parts have like numbers and functions as the apparatus shown in FIGS. 1 to 21 with the addition of decimal extension "0.3". Walker apparatus 40.3 is generally similar to walker apparatus 40 shown in FIGS. 1 to 21, with backrest 102.3 being cantilevered to upper ends 48.3 of frame members 42.3 and 44.3 and having an aperture 136.3 extending therethrough, but with the apparatus having at least the following exceptions.

In this case, as seen in FIG. 34, the straps 104.3 and 106.3 extend from the frame members 42.3 in an elliptical manner. In this example, the backrest 102.3 is y-shaped viewed from the side as it extends from the frame members. Similar to the backrest 102.2 shown in FIGS. 25 to 33, backrest, straps 104.3 and 106.3 and aperture 136.3 are substantially symmetrical about the vertical, central axis 150 of the backrest and are substantially symmetrical about the horizontal axis 152 of the backrest in this case.

The walker apparatus 40.3 includes a height-adjustment mechanism 59.3 for selectively adjusting and locking telescoping tubes 49.3 and 53.3 together. In this example, the adjustment mechanism includes a push button 154, instead of a thumb screw, for selecting adjusting the height of the walker apparatus.

Figure 36:
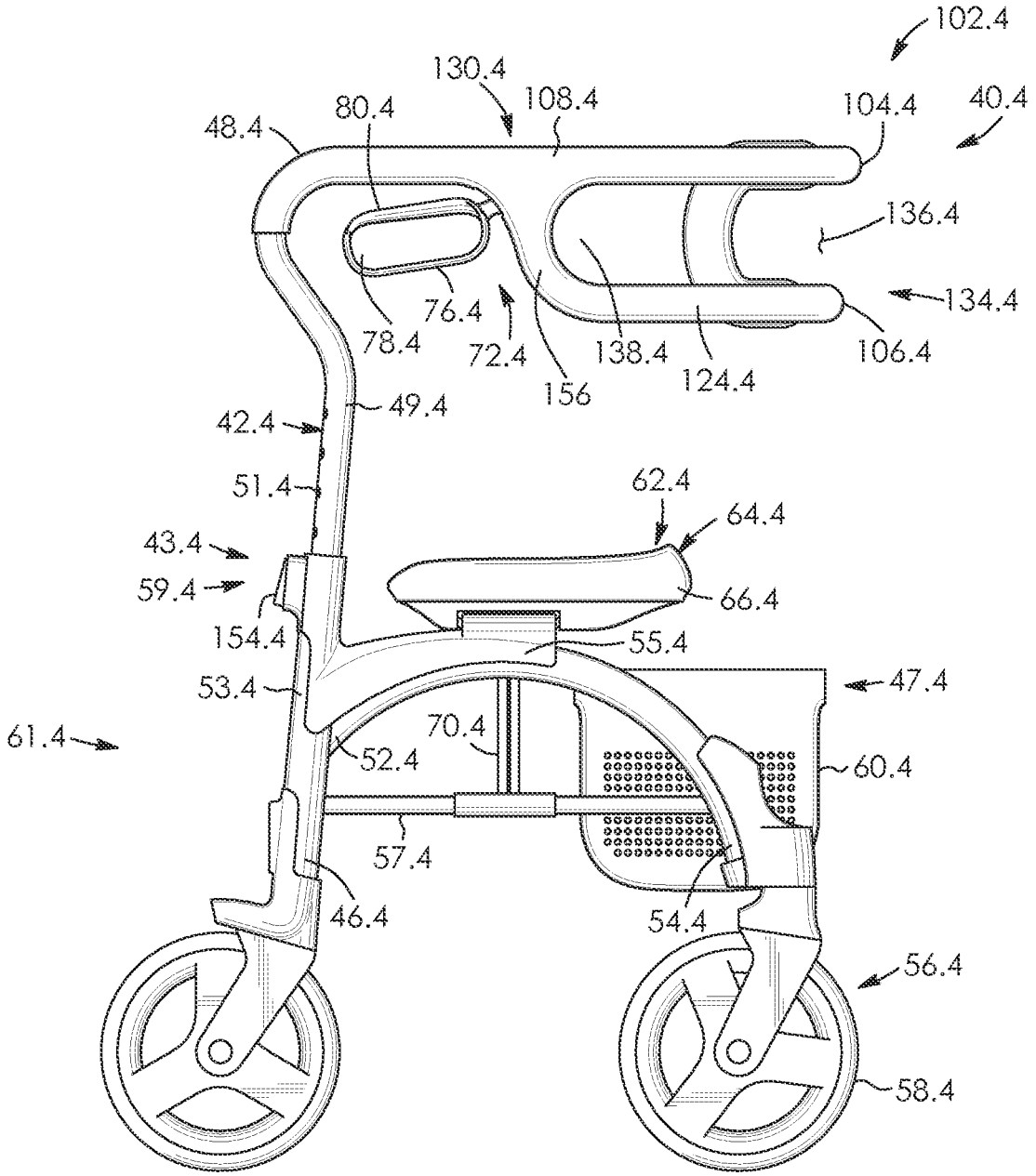
FIG. 36 is a side elevation view of a walker apparatus according to a fifth aspect.
Figure 37:
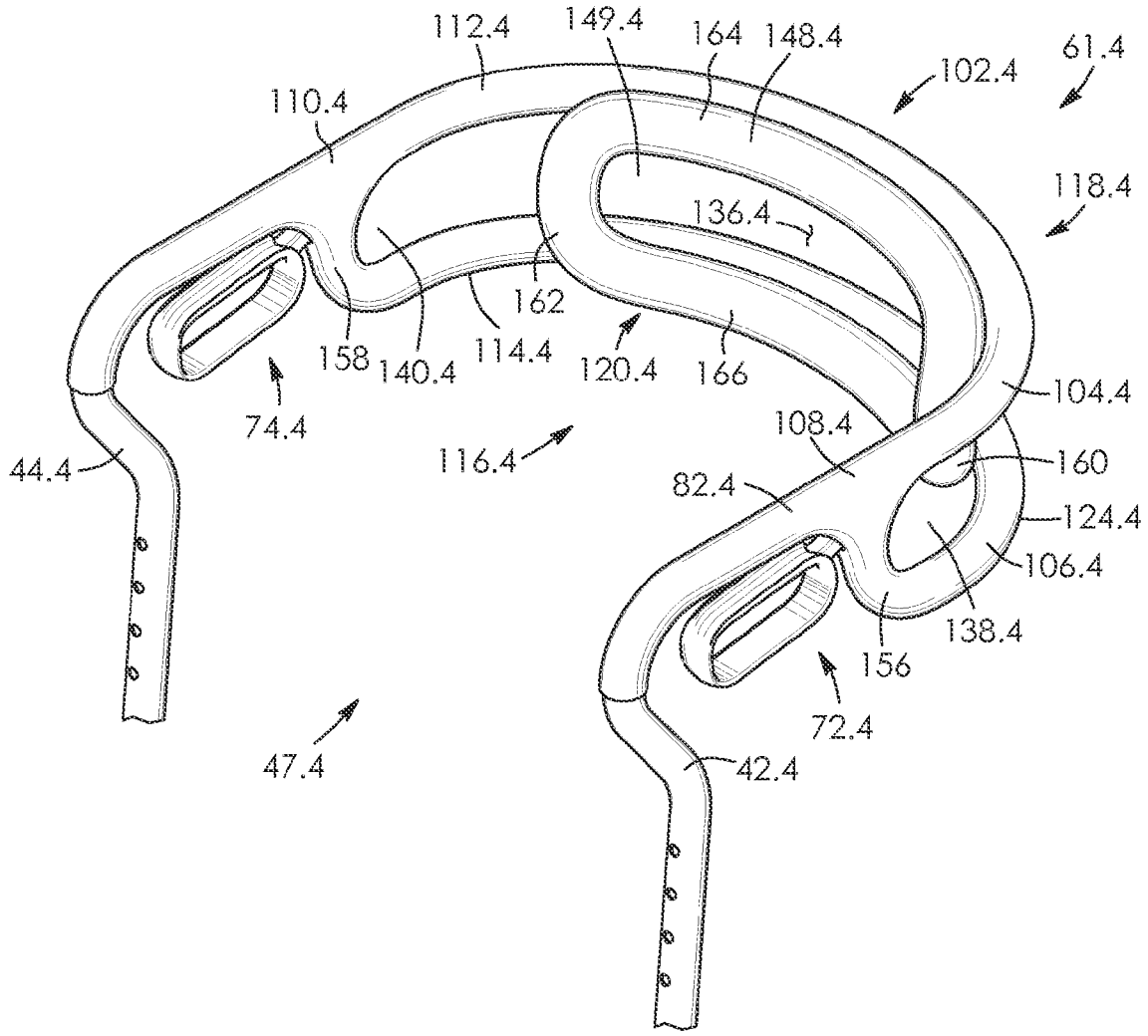
FIG. 37 is a top, rear perspective view of the walker apparatus of FIG. 36, the walker apparatus being shown in fragment.

FIGS. 36 and 37 show a walker apparatus 40.4 according to a fifth aspect. Like parts have like numbers and functions as the apparatus shown in FIGS. 34 and 35 with decimal extension "0.4" replacing previous decimal extension "0.3" and being added for numbers not previously having a decimal extension. Walker apparatus 40.4 is generally similar to walker apparatus 40.3 shown in FIGS. 34 and 35, with backrest 102.4 being cantilevered to upper ends 48.4 of frame members 42.4 and 44.4 and having an aperture 136.4 extending therethrough, but with the apparatus having at least the following exceptions.

In this example, backrest 102.4 is u-shaped when viewed from the side as it extends from the frame members 42.4. As seen in FIGS. 36 and 37, strap 104.4 aligns with and tangentially extends from the upper ends 48.4 of the frame members 42.4 and 44.4. Strap 104.4 is spaced-apart from and parallel to strap 106.4 in this example. Strap 106.4 and aperture 136.4 are spaced-apart below the upper ends of the frame members 42.4. As seen in FIG. 37, backrest 102.4 further includes a pair of arc-shaped connecting members 156 and 158 that connect the upper and lower straps together. Straps 104.4 and 106.4 connect to and extend tangentially from the arc-shaped connecting members. As seen in FIG. 37, the arc-shaped connecting members 156 and 158 and apertures 138.4 and 140.4 are semi-circular in this example and are positioned adjacent to handles 76.4. Strap 106.4 is positioned below the handles.

Similar to walker apparatus 40.2 of FIGS. 25 to 33, the walker apparatus 40.4 of FIG. 37 includes a cushioning member 148.4 located at the concave-shaped interior 116.4 of the backrest 102.4. The cushioning member connects to and extends from the backrest. The cushioning member 148.4 is loop-shaped, and arcuate-shaped in this example, with a first curved end 160 outwardly spaced-apart from proximal end 108.4 of the backrest and a second curved end 162 outwardly spaced-apart from proximal end 110.4 of the backrest. The cushioning member 148.4 has an upper portion 164 and a lower portion 166, each of which extends between ends 160 and 162. The upper portion of cushioning member connects to and extends inwardly from the upper strap 104.4 and the lower portion of the cushioning member connects to and extends inwardly from the lower strap 106.4 in this example. Aperture 149.4 of the cushioning member is oval-shaped in this example overlaps with aperture 136.4 of the backrest 102.4.

Figure 38:
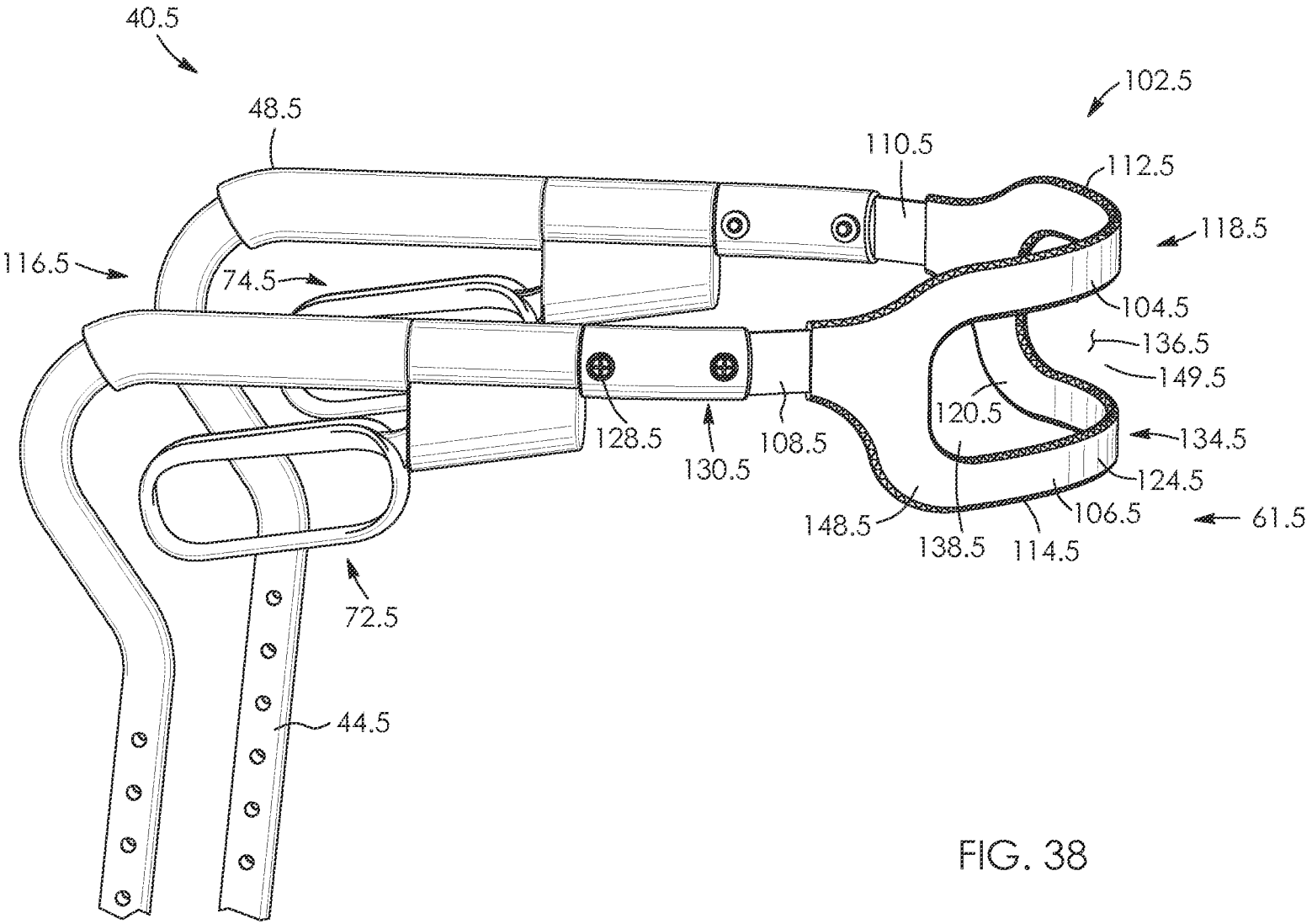
FIG. 38 is a fragmentary, side perspective view of a walker apparatus according to a sixth aspect.

FIG. 38 shows a walker apparatus 40.5 according to a sixth aspect. Like parts have like numbers and functions as the apparatus shown in FIGS. 34 and 35 with decimal extension "0.5" replacing decimal extension "0.3" and being added for parts not previous having decimal extensions. Walker apparatus 40.5 is generally similar to walker apparatus 40.3 shown in FIGS. 34 and 35, with backrest 102.5 being cantilevered to upper ends 48.5 of frame members 42.5 and 44.5 and having an aperture 136.5 extending therethrough, but with the apparatus having at least the following exceptions.

Backrest 102.5 includes a cushioning member 148.5 that extends substantially around the straps 104.5 and 106.5. In this example, the cushioning member is in the form of a neoprene cover sewn around the straps, though this is not strictly required and the cushioning member may be made other materials in other embodiments.

The backrest is u-shaped from the side as the backrest extends from the frame members 44.5. Strap 104.5 is extends above the upper ends 48.5 of the frame members 44.5 and strap 106.5 is extends below the upper ends of the frame members.

Figure 39:
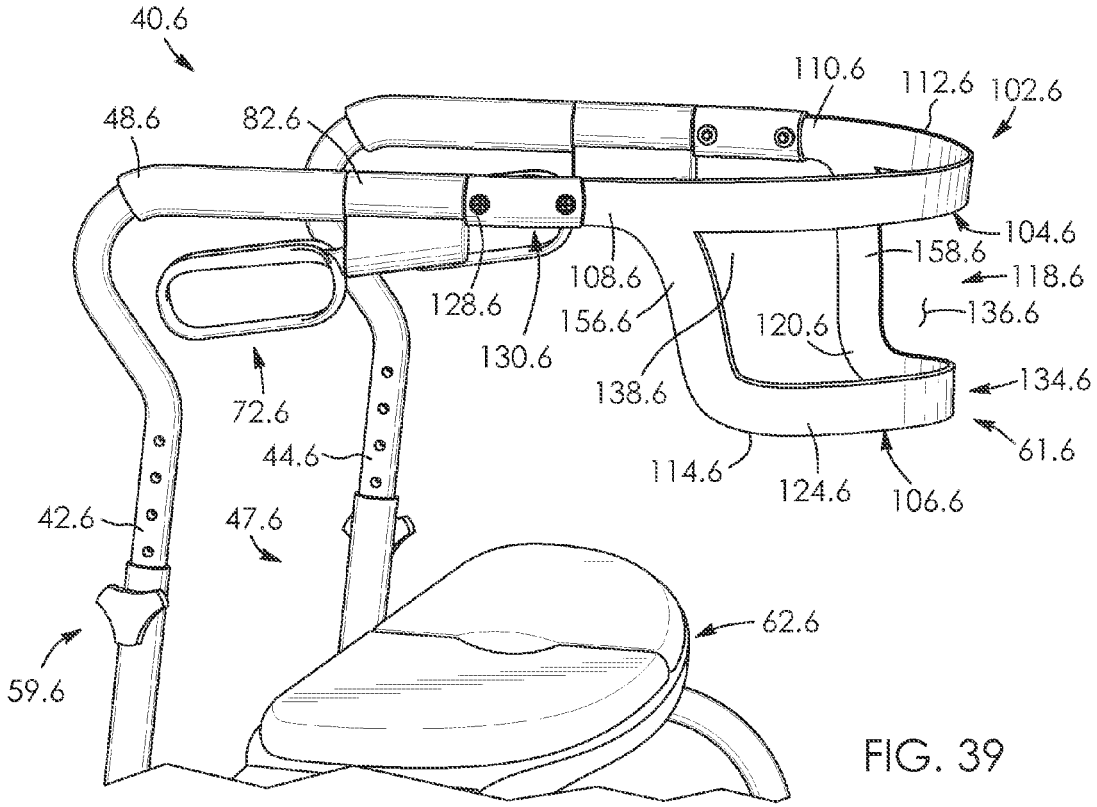
FIG. 39 is a fragmentary, side perspective view of a walker apparatus according to a seventh aspect.
Figure 40:
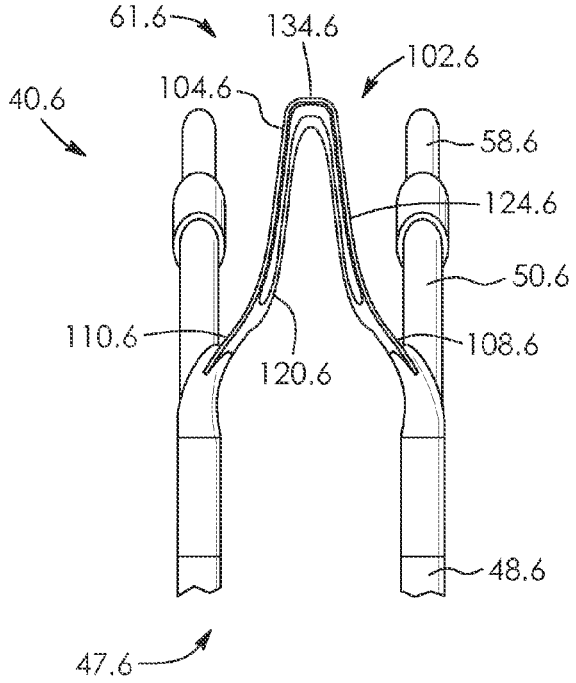
FIG. 40 is a fragmentary, top plan view thereof.
Figure 41:
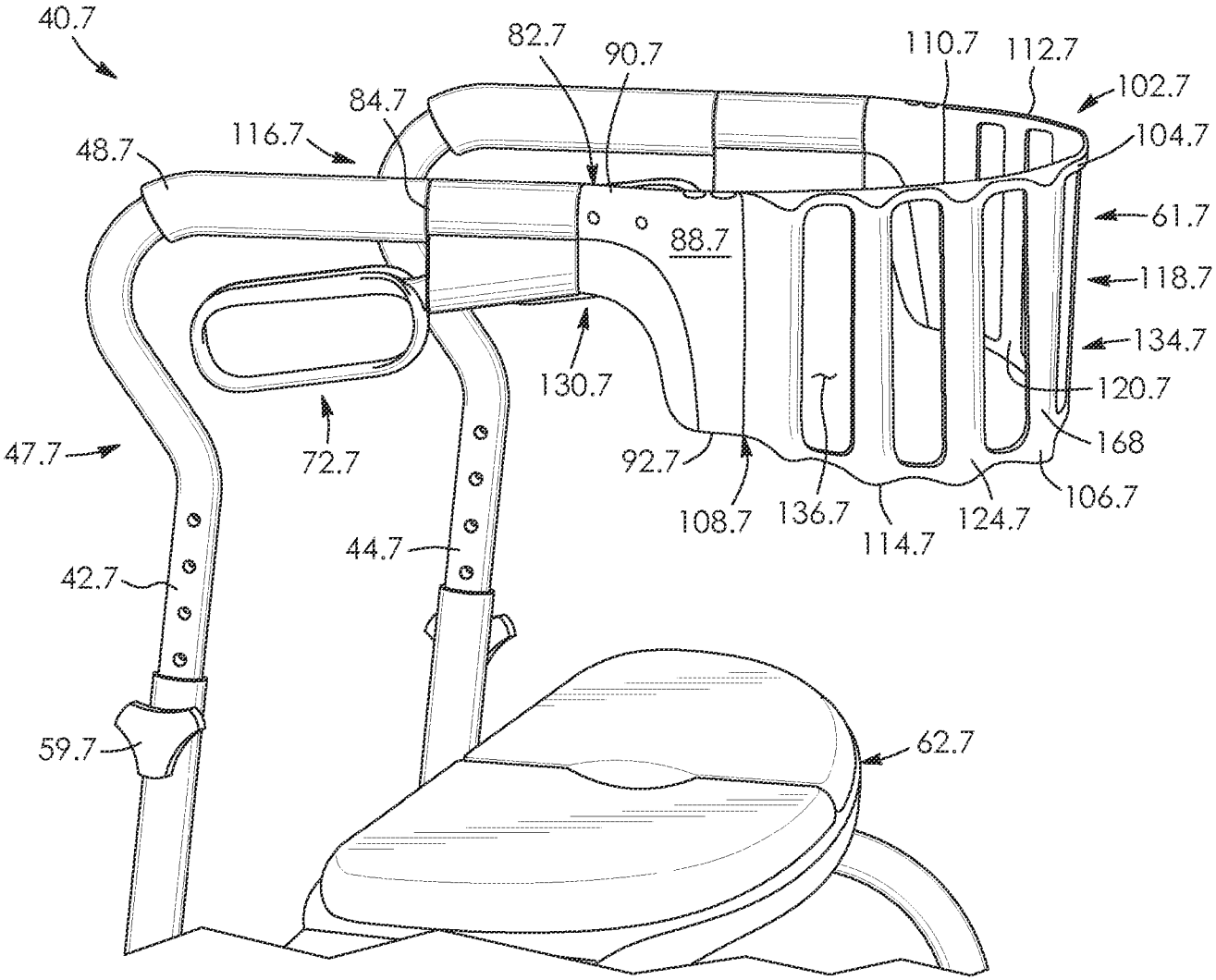
FIG. 41 is a fragmentary, side perspective view of a walker apparatus according to an eighth aspect.

FIGS. 39 and 40 show a walker apparatus 40.6 according to a seventh aspect. Like parts have like numbers and functions as the apparatus shown in FIGS. 36 and 37 with decimal extension "0.6" replacing decimal extension "0.4" and being added for parts not previous having decimal extensions. Walker apparatus 40.6 is generally similar to walker apparatus 40.4 shown in FIGS. 36 and 37, with backrest 102.6 being cantilevered to upper ends 48.6 of frame members 42.6 and 44.6 and having an aperture 136.6 extending therethrough, but with the apparatus having at least the following exceptions.

Connecting members 156.6 and 158.6, which connect upper strap 104.6 and lower strap 106.6 together, are generally s-shaped in this example. Ends 138.6 and 140.6 of aperture 136.6 are tapered in this example, with strap 104.6 extending from connectors 156.6 at acute angles a relative to the connectors. As seen in FIG. 40, the backrest 102.6 shaped to form a substantially v-shape in this example when the walker apparatus is folded laterally, with the straps 104.6 being substantially inwardly spaced-apart from support members 50.6.

FIGS. 41 to 45 show a walker apparatus 40.7 according to an eighth aspect. Like parts have like numbers and functions as the apparatus shown in FIGS. 1 to 21 with the addition of decimal extension "0.7". Walker apparatus 40.7 is generally similar to walker apparatus 40 shown in FIGS. 1 to 21, with backrest 102.7 being cantilevered to upper ends 48.7 of frame members 42.7 and 44.7 and including at least one aperture 136.7 extending therethrough, but with the apparatus having at least the following exceptions.

Backrest 102.7 comprises a plurality of spaced-apart, vertically-extending columns or ribs 168 each of which may be rigid and generally in the shape of a rectangular prism in this example. The backrest is shaped to extend downwards sufficiently far so that it may function to support the lumbar of the user.

Figure 45:
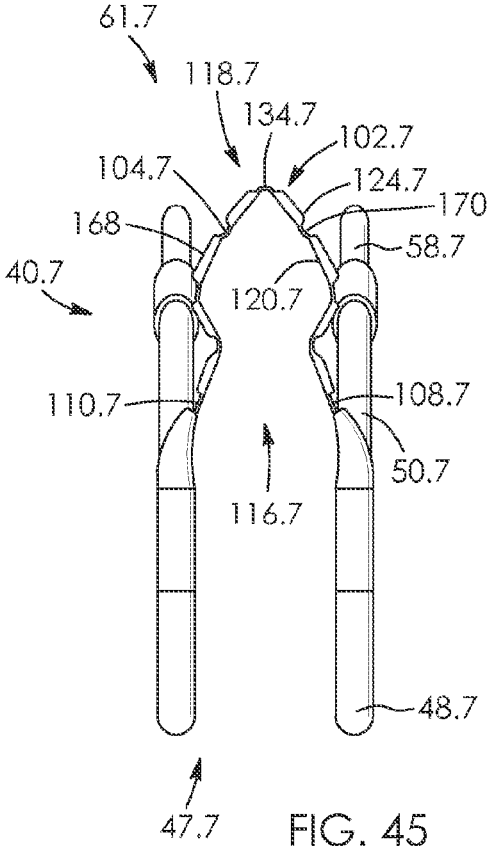
FIG. 45 is a fragmentary, top plan view of the walker apparatus of FIG. 41.

The backrest 102.7 further includes a pair of substantially-horizontal upper and lower bridging members 104.7 and 106.7 which are arcuate-shaped when the walker apparatus 40.7 is in its unfolded mode. Ribs 168 connect to and extend between the bridging members. The ribs extend outwards relative to the bridging members 104.7 and 106.7, as seen in FIG. 45. The bridging members are narrower in cross-section compared to the ribs 168 in this example.

Referring back to FIG. 41, the backrest 102.7 includes a plurality of spaced-apart openings which extend substantially vertically, in this example in the form of a plurality of vertically-extending apertures 136.7 interposed between adjacent ribs 168. The backrest may thus be said to have a skeleton-like structure.

As seen in FIG. 45, the backrest 102.7 has a plurality of u-shaped recesses at its interior 116.7 and exterior 118.7, as seen by recess 170, adjacent to the bridging members 104.7 and 106.7 and which are interposed between adjacent ribs 168. The recesses facilitate folding of the backrest and may function as vertically-extending bending regions to facilitate laterally folding the walker apparatus 40.7, as seen in FIG. 45.

Figure 44:
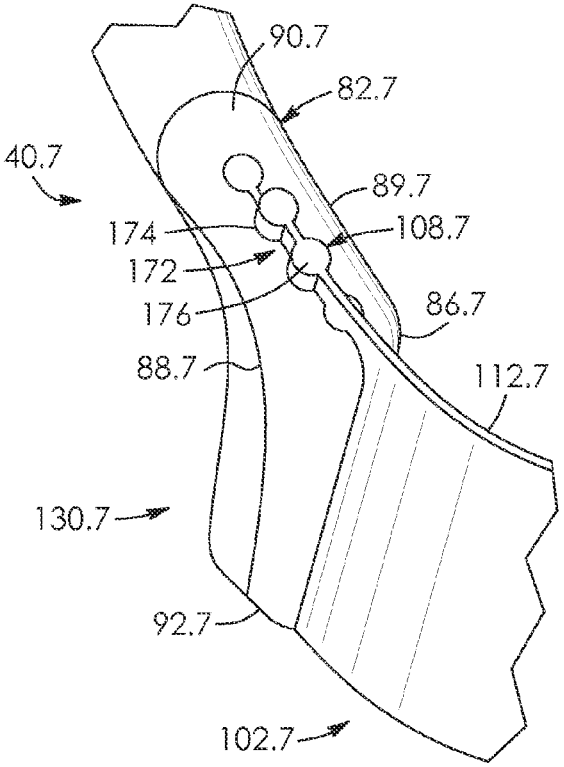
FIG. 44 is a fragmentary, side perspective view of the proximal end of the backrest of FIG. 43 engaging with the housing of the walker apparatus of FIG. 42 for connecting the backrest to the rest of the walker apparatus thereby.

As seen in FIG. 44, housings 82.7 are generally L-shaped in profile, with L-shaped sides 88.7 and bottoms 92.7 that curve downwards in a concave-manner, in this example, as the housings extend outwards from upper ends 48.7 of the frame members 42.7 and 44.7.

Figure 42:
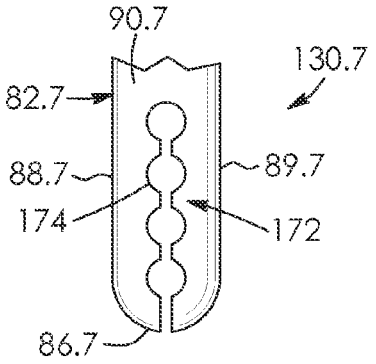
FIG. 42 is a fragmentary, plan view of housing which forms part of an adjustment assembly for the walker apparatus of FIG. 41.
Figure 43:
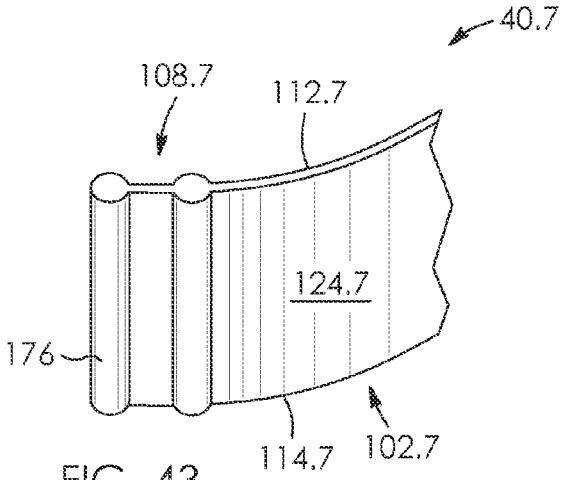
FIG. 43 is a fragmentary, side perspective view of a proximal end of a backrest of the walker apparatus of FIG. 41, the proximal ends of the backrest forming further parts of the adjustment assembly for the walker apparatus.

Referring to FIGS. 42 to 44, adjustment mechanism 130.7 has female connectors in the form slots 172 each extending inwards from a respective distal end 86.7 of its housing 82.7. Each slot extends from top 90.7 to bottom 92.7 of its housing in this example. Each slot 172 further includes a plurality of horizontally-spaced recesses, in this example in the form of four recesses, as seen by recess 174, positioned therewithin. The recesses are wider than the slots. Adjustment mechanism 130.7 further includes a plurality of vertically extending protrusions, in this example a pair of protrusions, as seen by protrusion 176, located adjacent to respective ones of the distal ends 108.7 of the backrest 102.7. The protrusions are receivable within slots 172 and selective ones of the recesses 174.

Figure 46:
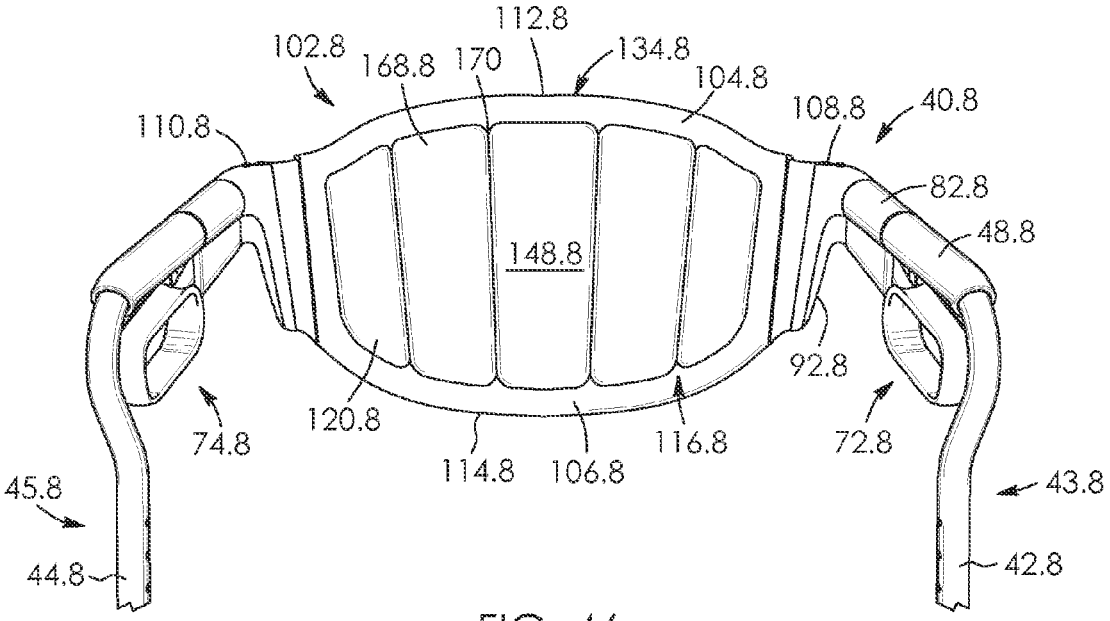
FIG. 46 is a fragmentary, rear perspective view of a walker apparatus according to a ninth aspect.

FIG. 46 shows a walker apparatus 40.8 according to a ninth aspect. Like parts have like numbers and functions as the apparatus shown in FIGS. 41 to 45 with decimal extension "0.8" replacing decimal extension "0.7" and being added for numerals of corresponding parts not previously having a decimal extensions. Walker apparatus 40.8 is generally similar to walker apparatus 40.7 shown in FIGS. 41 to 45, with backrest 102.8 being cantilevered to upper ends 48.8 of frame members 42.8 and 44.8, but with the apparatus having at least the following exceptions. In this example a cushioning member 148.8 substantially extends around ribs 168.8 and bridging members 104.8 and 106.8 extend between the ribs. The cushioning member, or outer coat, may be made of neoprene or EVA foam (ethylene vinyl acetate) wrapped in polyester, according to some examples; however, here too these materials are not strictly required and other materials may be used in other embodiments.

Bridging member 104.8 is upwardly curved as the backrest extends towards central portion 134.8 of the backrest. Bridging member 106.8 downwardly curves as the backrest extends towards the central portion of the backrest.

Figure 47:
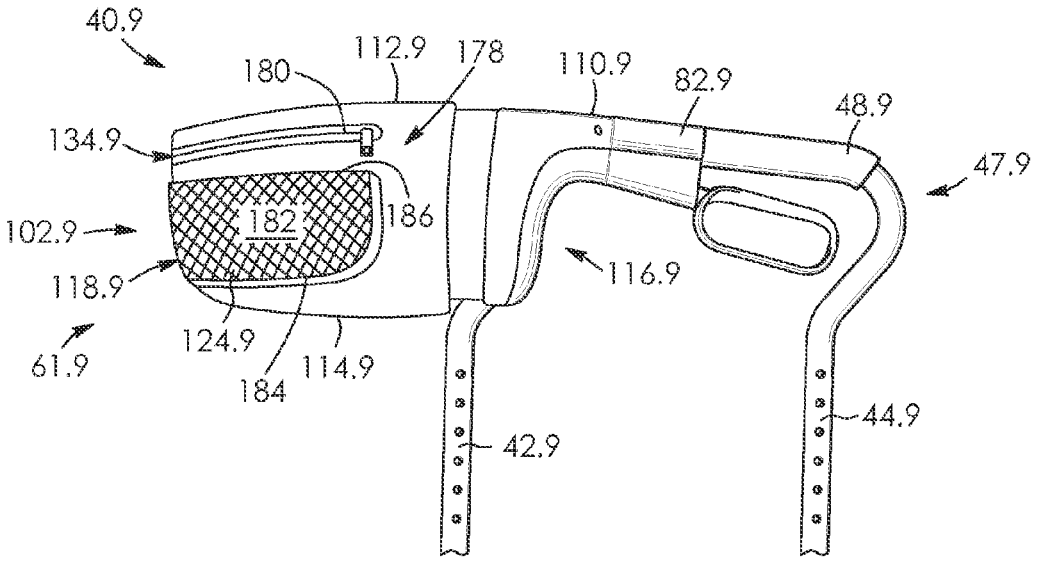
FIG. 47 is a fragmentary, side perspective view of a walker apparatus according to a tenth aspect.

FIG. 47 shows a walker apparatus 40.9 according to a tenth aspect. Like parts have like numbers and functions as the apparatus shown in FIG. 47 with decimal extension "0.9" replacing decimal extension "0.8" and being added for numerals of corresponding parts not previously having a decimal extensions. Walker apparatus 40.9 is generally similar to walker apparatus 40.8 shown in FIG. 46, with backrest 102.9 being cantilevered to upper ends 48.9 of frame members 42.7 and 44.7, but with the apparatus having at least the following exceptions. In this case, backrest 102.9 is substantially rectangular in section.

Also, the backrest includes a receptacle 178 extending across the back of the backrest for storing objects. The receptacle is positioned on the exterior 118.9 of the backrest 102.9. The receptacle in this example includes a zipper assembly 180 for selectively opening and closing the receptacle. The backrest 102.9 further includes an outer netting 182 having a closed bottom 184 and open top 186 for further easy storing of objects. The netting is also positioned on the exterior 118.9 of the backrest in this example.

Figure 48:
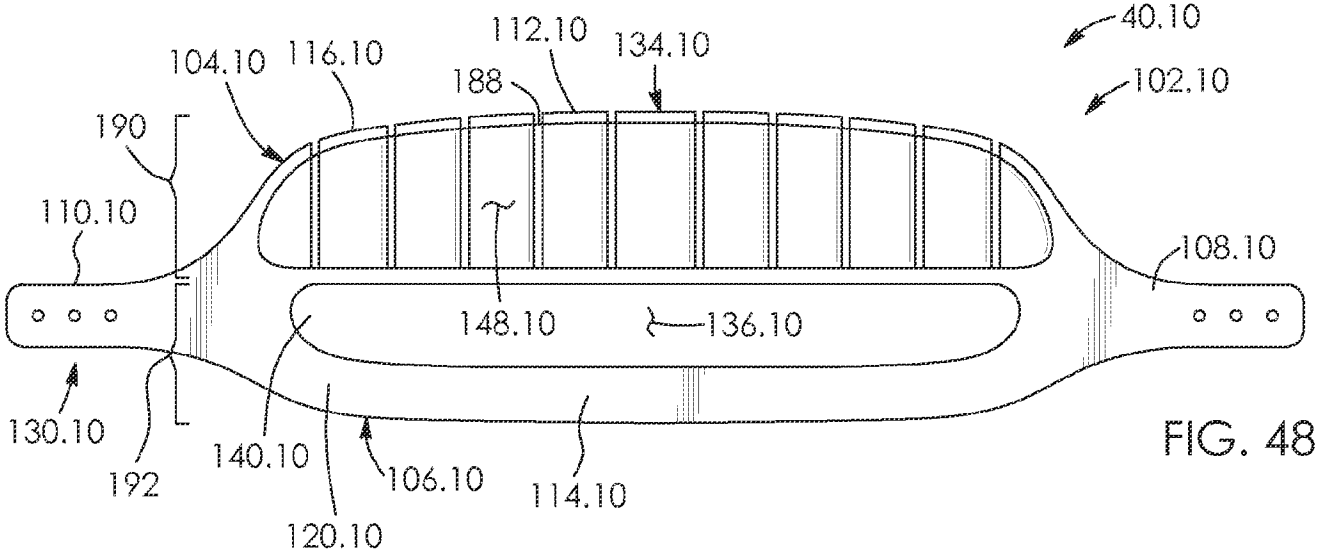
FIG. 48 is a front elevation view of a backrest for a walker apparatus according to an eleventh aspect.
Figure 49:
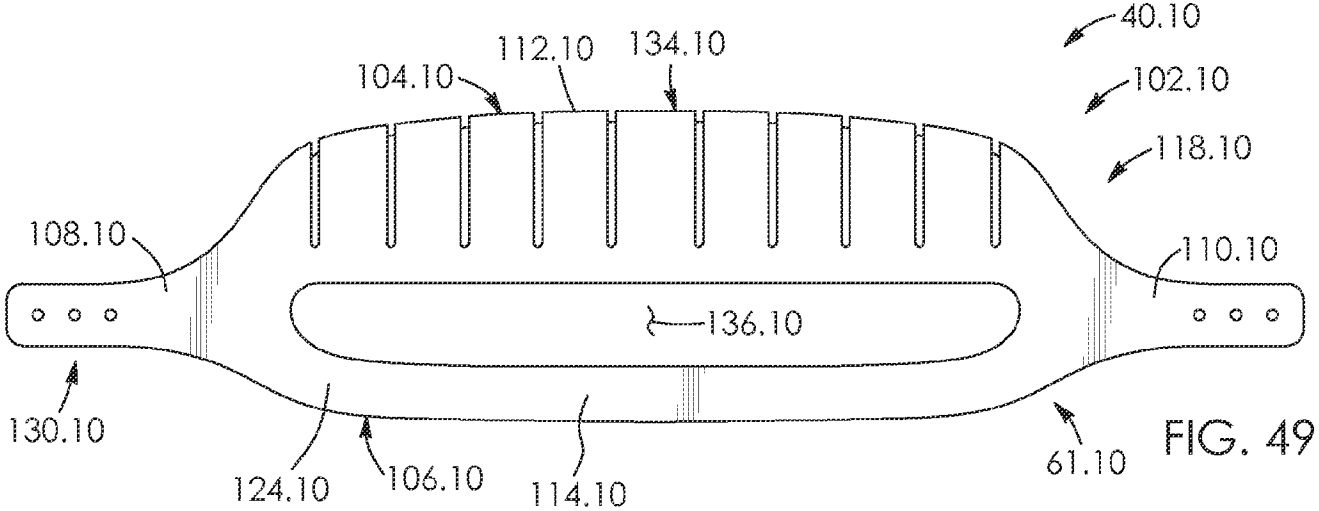
FIG. 49 is a rear elevation view thereof.

FIGS. 48 and 49 show a walker apparatus 40.10 according to an eleventh aspect. Like parts have like numbers and functions as the apparatus shown in FIGS. 39 and 40 with decimal extension "0.10" replacing decimal extension "0.6" and being added for features not previously having decimal extensions. Walker apparatus 40.10 is generally similar to walker apparatus 40.6 shown in FIGS. 39 and 40, with backrest 102.10 being cantilevered to the upper ends of the frame members 42, such as the upper ends 48.6 of frame members 42.6 and 44.6 seen in FIG. 39, including at least one aperture 136.10 extending therethrough, but with apparatus 40.10 having at least the following exceptions.

Aperture 136.10 of the backrest 102.10 aligns with the upper ends of the frame members, such as the upper ends 48.6 of frame members 42.6 and 44.6 seen in FIG. 39, with the upper strap 104.10 being substantially positioned above the upper ends of the frame members and lower strap 106.10 being substantially positioned below the upper ends of the frame members in this example. Upper strap 104.10 includes a plurality of spaced-apart slits or grooves 188 partially extending therethrough which extend downwards from the top 112.10 of the backrest. The grooves extend substantially vertically in this example and are circumferentially spaced-apart when the backrest is in its unfolded, arcuate-shaped mode.

The upper strap comprises an upper half 190 of the backrest 102.10. Cushioning member 148.10 substantially extends along the upper half of the backrest adjacent to the interior 116.10 of the backrest. Aperture 136.10 of the backrest and lower strap 106.10 together comprise a lower half 192 of the backrest. Grooves 188 extend from top 112.10 and substantially through upper half 190 of the backrest towards the lower half 192 of the backrest in this example. Cushioning member 148.10 substantially extends along the grooves, leaving the grooves exposed adjacent to the top 112.10 of the backrest.

Backrest 102.10 is generally formed with flat surfaces made of polyolefins (polyethylene or polypropylene) with no reinforcement in this example, though these materials are not strictly required. The resulting backrest may bend evenly along its width.

Figure 50:
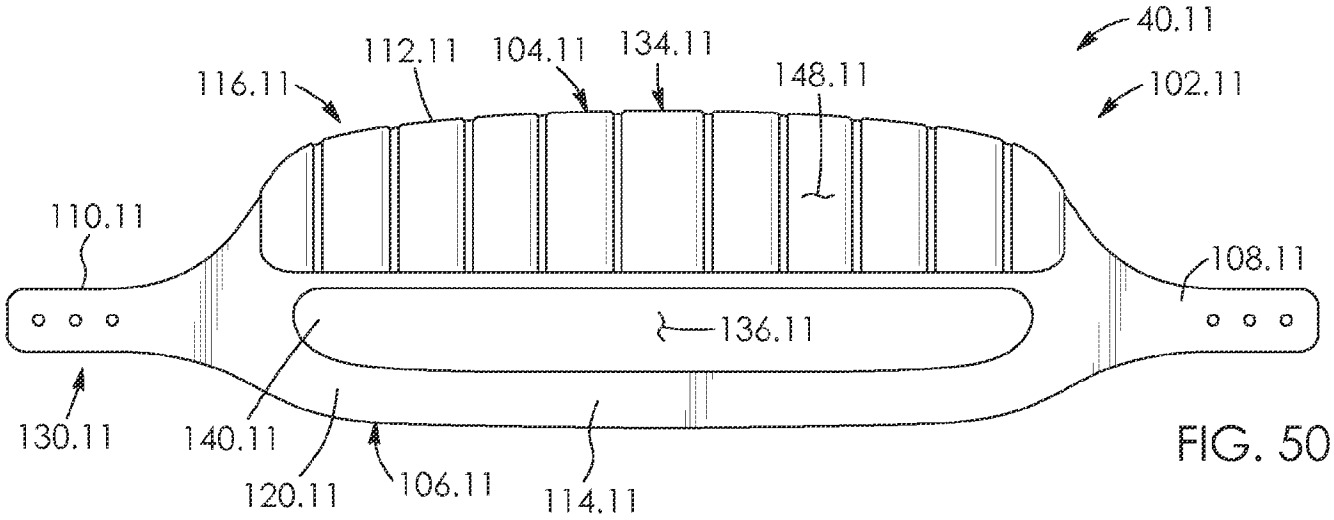
FIG. 50 is a front elevation view of a backrest for a walker apparatus according to a twelve aspect.
Figure 51:
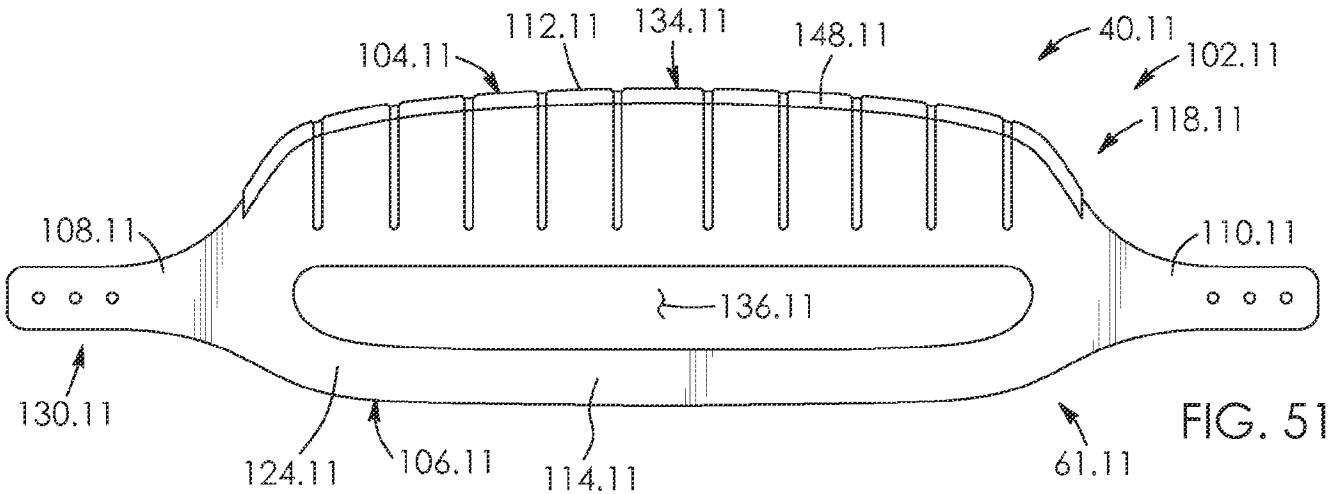
FIG. 51 is a rear elevation view thereof.

FIGS. 50 and 51 show a walker apparatus 40.11 according to a twelfth aspect. Like parts have like numbers and functions as the apparatus shown in FIGS. 48 and 49 with decimal extension "0.11" replacing decimal extension "0.10" and being added for features not previously having decimal extensions. Walker apparatus 40.11 is generally similar to walker apparatus 40.10 shown in FIGS. 48 and 49 with the exception that cushioning member 148.11 extends over the tops of grooves 188.11 on the interior side 116.11 of the backrest 102.11 and extends over top 112.11 of the backrest.

Figure 52:
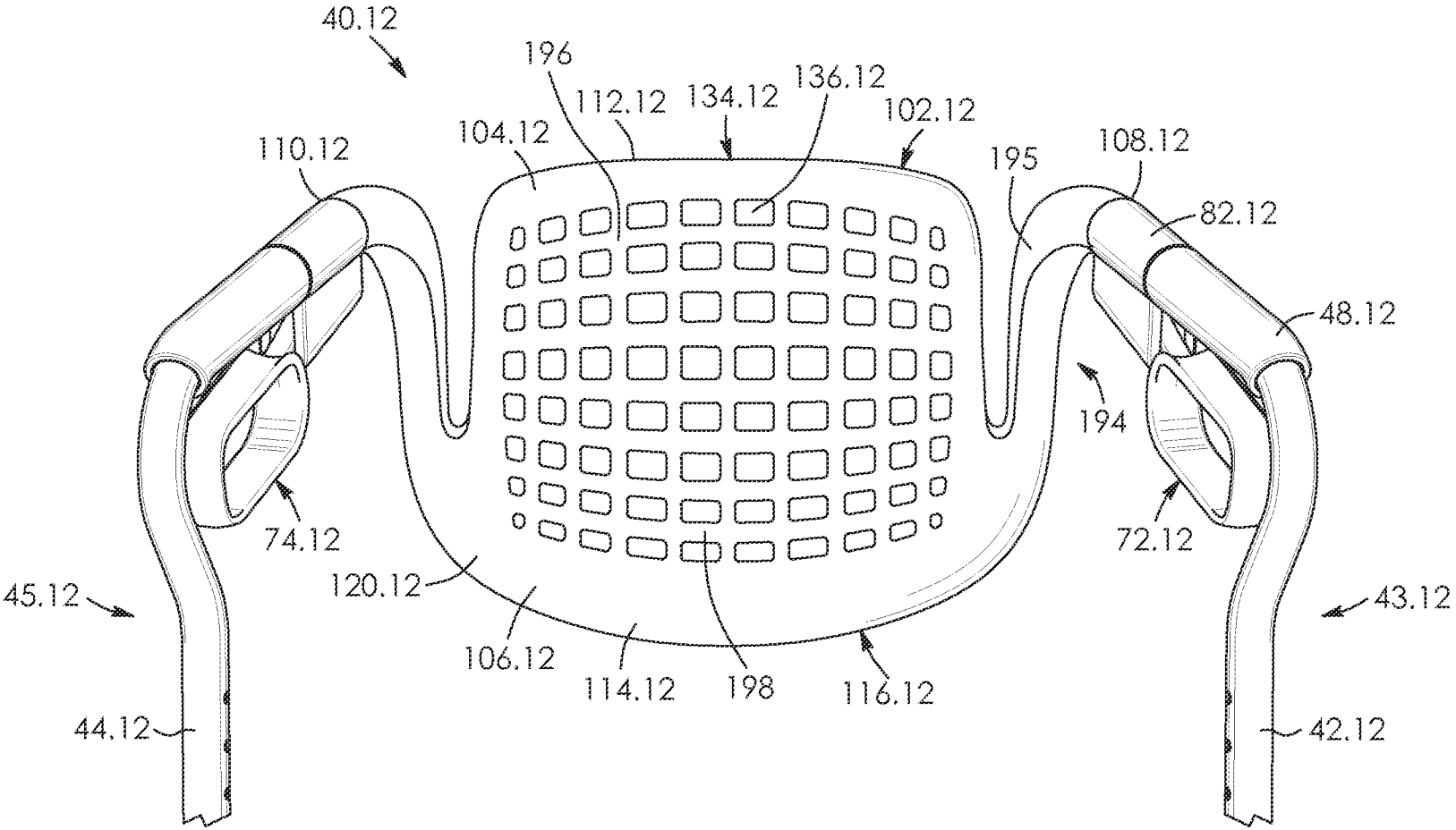
FIG. 52 is a fragmentary, rear perspective view of a walker apparatus according to a thirteenth aspect.
Figure 53:
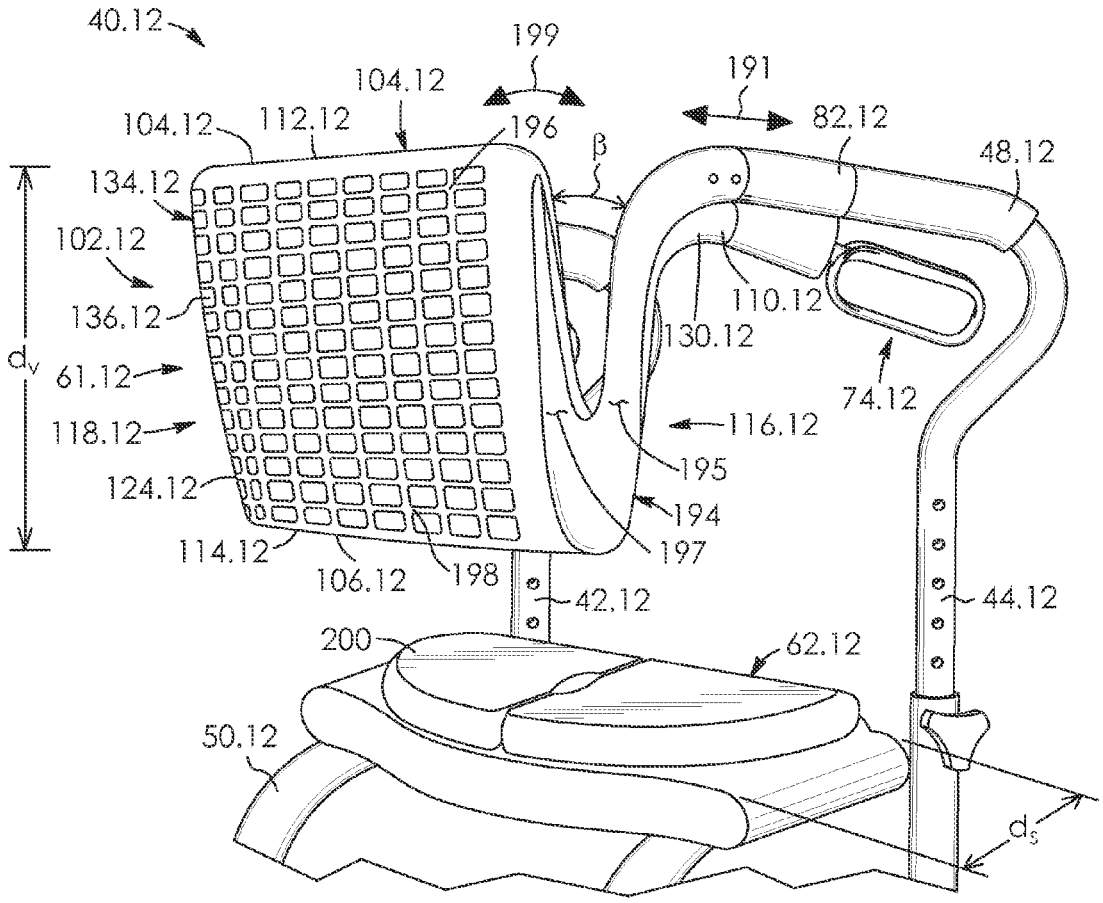
FIG. 53 is a fragmentary, side perspective view thereof.
Figure 54:
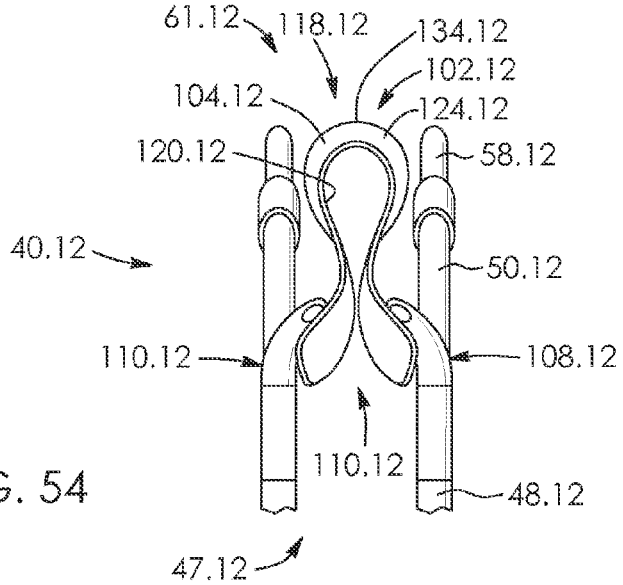
FIG. 54 is a fragmentary, top plan view thereof.

FIGS. 52 to 54 show a walker apparatus 40.12 according to a thirteenth aspect. Like parts have like numbers and functions as the apparatus shown in FIGS. 1 to 21 with the addition of decimal extension "0.12". Walker apparatus 40.12 is generally similar to walker apparatus 40 shown in FIGS. 1 to 21, with backrest 102.12 being cantilevered to the upper ends 48.12 of the frame members 42.12 and 44.12 and including at least one aperture 136.12 extending therethrough, but with the apparatus having at least the following exceptions.

Apparatus 40.12 includes a pair of u-shaped, resilient arms or connecting members, as seen by connecting member 194, that operatively connect the backrest 102.12 to upper ends 48.12 of the frame members 42.12 and 44.12, respectively, via housings 82.12 in this example. The connecting members may be made of acrylonitrile Butadiene Styrene (ABS) or hard polypropylene according to one example, though this is not strictly required and other materials may be used.

The connecting members 194 are adjustable in a horizontal direction as seen by arrow 191 in FIG. 53. First portions 195 of the connecting members extend downwards in a generally s-like shape and second portions 197 of the connecting members extend generally upwards. The second portions of the connecting members extend angularly from the first portions of the connecting members by an angle β that is acute in this example. The backrest 102.12 extends along and couples to the second portions 197 of the connecting members 194 in this example. Second portions 197 of the connecting members are at least partially flexible and are resiliently moveable relative to the first portions 195 of the connecting members, as seen by arrow of numeral 199 in FIG. 53.

The backrest 102.12 may be made of a more flexible material compared to the connecting members 194, enabling the connecting members to provide vertical support and strength and some resilience, while still ensuring that the backrest is readily foldable laterally. In this example the backrest 102.12 may be made of soft polypropylene or polyethylene, though this is not strictly required. The backrest includes a plurality of spaced-apart vertically-extending strips 196 and a plurality of spaced-apart horizontally-extending strips 198 intersecting with the vertically-extending strips in a grid-like pattern. A plurality of rows and columns of apertures 136.12 are formed thereby which are interposed between respective ones of the strips. The apertures are substantially rectangular in profile in this example. In this example, the backrest is generally rectangular in profile. Top 112.12 of the backrest aligns with the upper ends 48.12 of the frame members 42.12 and 44.12 in this example. Also, the vertically spanning distance $d_v$ of the backrest distance between the top 112.12 and bottom 114.12 of the backrest is equal to or greater than the depth $d_s$ of the seat assembly 62.12.

Backrest 102.12 so shaped is freely flexible and may fold in a wide-curl like shape as seen in FIG. 54 when the walker apparatus 40.12 is folded laterally.

Figure 55:
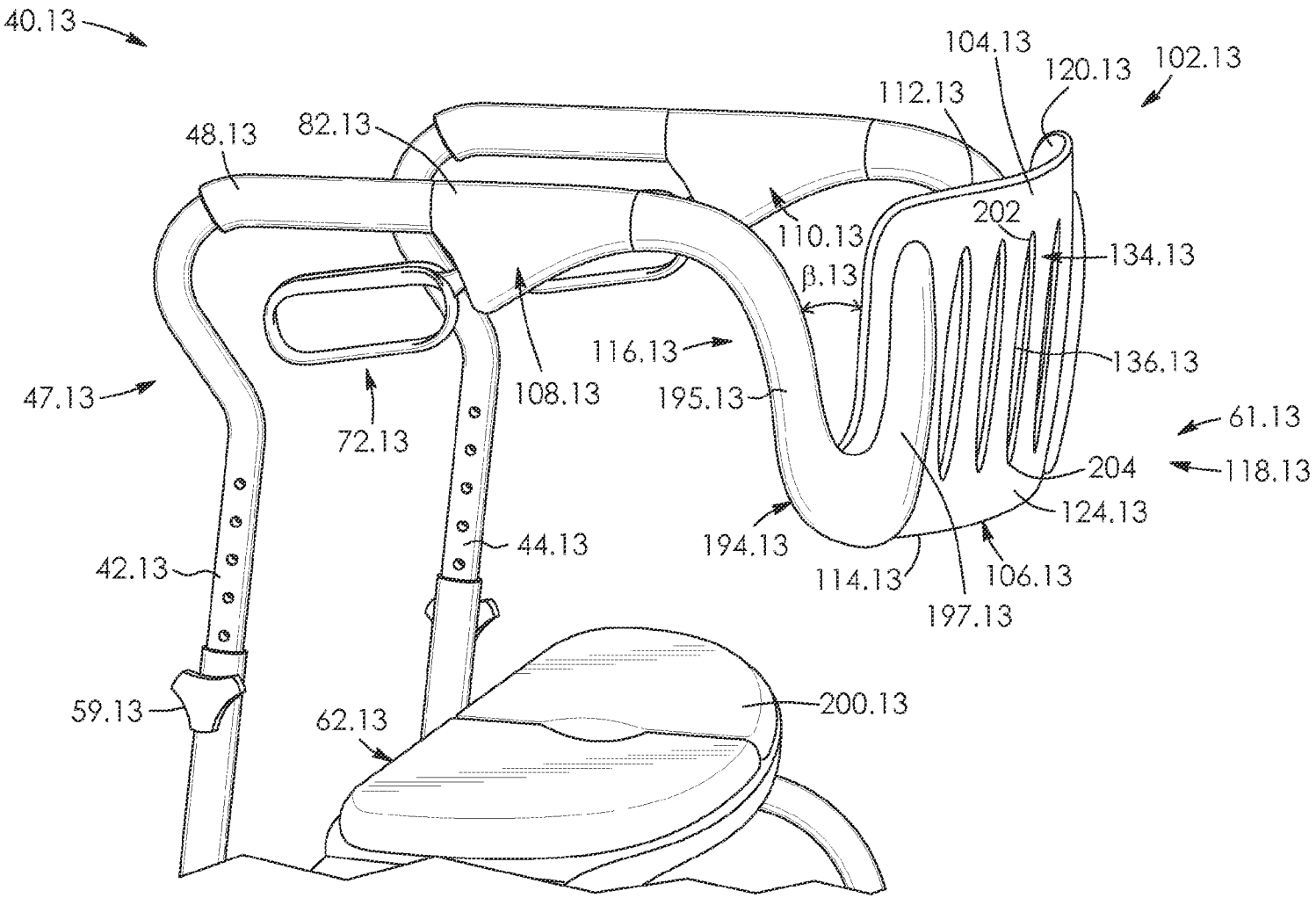
FIG. 55 is a fragmentary, side perspective view of a walker apparatus according to an fourteenth aspect.

FIG. 55 shows a walker apparatus 40.13 according to a fourteenth aspect. Like parts have like numbers and functions as the apparatus shown in FIGS. 52 to 54 with decimal extension "0.13" replacing decimal extension "0.12" and being added for features not previously having decimal extensions. Walker apparatus 40.13 is generally similar to walker apparatus 40.12 shown in FIGS. 52 to 54, with backrest 102.13 being cantilevered to the upper ends 48.13 of frame members 42.13 and 44.13 and including at least one aperture 136.13 extending therethrough, but with the apparatus having at least the following exceptions. In this example, backrest 120.13 includes a plurality of spaced-apart, vertically-extending slits 136.13 with first ends 202 adjacent to the top 112.13 of the backrest and second ends 204 adjacent to the bottom 114.13 of the backrest.

Figure 56:
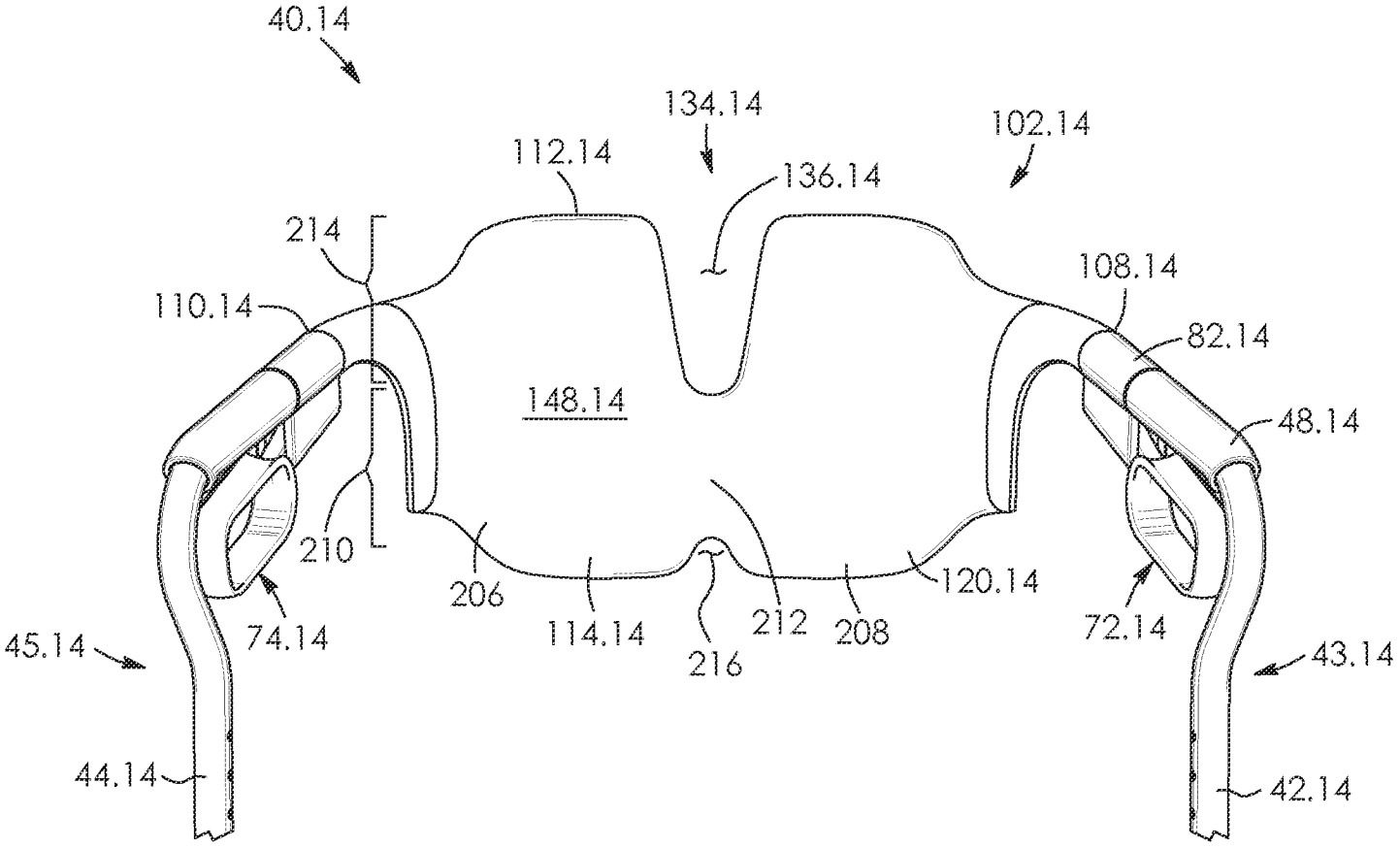
FIG. 56 is a fragmentary, rear perspective view of a walker apparatus according to a fifteenth aspect.
Figure 57:
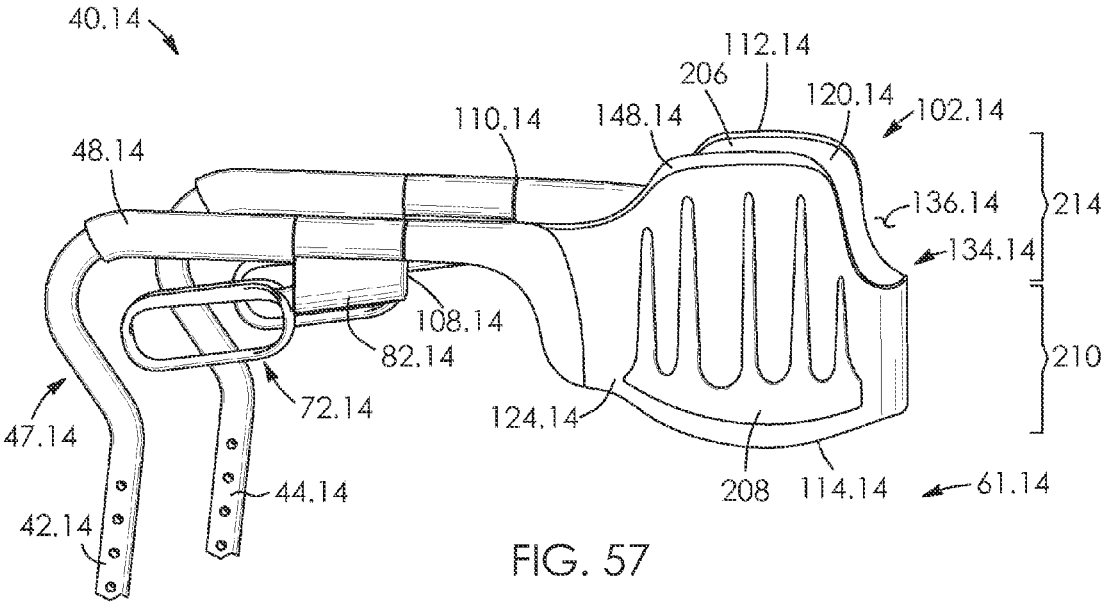
FIG. 57 is a fragmentary, side perspective view thereof.
Figure 58:
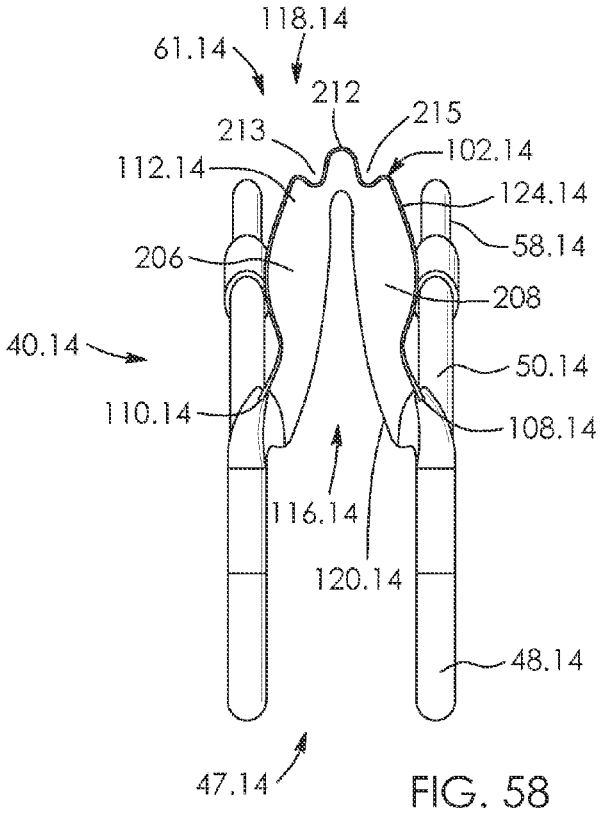
FIG. 58 is a top plan view thereof.

FIGS. 56 to 58 show a walker apparatus 40.14 according to a fifteenth aspect. Like parts have like numbers and functions as the apparatus shown in FIG. 46 with decimal extension "0.14" replacing decimal extension "0.8" and being added for features not previously having decimal extensions. Walker apparatus 40.14 is generally similar to walker apparatus 40.8 shown in FIG. 46, with backrest 102.14 being cantilevered to upper ends 48.14 of frame members 42.14 and 44.14 and including at least one opening or recessed portion 136.14 extending therethrough, but with the apparatus having at least the following exceptions. In this example, backrest 102.14 comprises a pair of substantially rectangular portions 206 and 208 coupled together at lower halves 210 thereof. As best seen in FIG. 58, a centrally positioned, vertically-extending rib 212 couples the rectangular portions of the backrest together in this example. The backrest includes a pair of vertically extending recessed portions 213 and 215 interposed between the rectangular portions 206 and 208 and rib 212, respectively. The backrest 102.14 at these central locations are thinner compared to the rectangular portions and rib and may function to facilitate ready folding of the walker apparatus. Rib 212 may be also be thinner than the rectangular portions 206 and 208 and may be made of polyurethane or double injection hard plastic for example, though this is not strictly required.

Referring to FIG. 56, the backrest 102.14 includes an upper opening in the form of recessed portion 136.14 centrally extending downwards from the top 112.14 of the backrest which separates two side-by-side portions 206 and 208 of the backrest. The recessed portion of the backrest extends from an upper half 214 of the backrest to the lower half 210 of the backrest and is generally u-shaped in this example. The backrest 102.14 in this example further includes a centrally-disposed bottom recessed portion 216, seen in FIG. 56, extending upwards from the bottom 114.14 of the backrest 102.14 to rib 212. The bottom recessed portion 216 is also u-shaped in this example and is smaller than the upper recessed portion 136.14 in this example.

Additional Description

There is provided a walker apparatus having a backrest cantilevered to its upright frame members. The backrest has at least one opening extending therethrough for permitting a user's vision past the backrest when the user grips the upright frame members.

Examples of a walker apparatus and a backrest therefor have been described. The following clauses are offered as further description.

(1) A walker apparatus having a backrest cantilevered to its upright frame members, the backrest having at least one opening extending therethrough for permitting visibility past the backrest when a user grips the upright frame members.

(2) The apparatus of clause 1 further including a seat operatively connected to the upright frame members.

(3) The apparatus of at least one of the preceding clauses wherein the backrest is flexible and arcuate.

(4) The apparatus of at least one of the preceding clauses wherein the backrest is horizontally split.

(5) The apparatus of at least one of the preceding clauses wherein the backrest includes a pair of spaced-apart straps.

(6) The apparatus of at least one of the preceding clauses wherein the straps connect together at common ends.

(7) The apparatus of at least one of the preceding clauses wherein an upper one of the straps is U-shaped in cross-section.

(8) The apparatus of at least one of the preceding clauses wherein an upper one of the straps is upwardly-convex in cross-section.

(9) The apparatus of at least one of the preceding clauses wherein the frame members have upper ends and wherein an upper one of the straps extends upwardly from the upper ends of the frame members.

(10) The apparatus of at least one of the preceding clauses wherein an upper one of the straps operatively extends in an upwardly curved manner from the frame members.

(11) The apparatus of at least one of the preceding clauses wherein the straps extend from the frame members in outwardly divergent directions relative to each other.

(12) The apparatus of at least one of the preceding clauses wherein an upper one of the straps extends from the frame members in an upward direction and wherein a lower one of the straps extends from the frame members in a downward direction.

(13) The apparatus of at least one of the preceding clauses wherein an upper one of the straps extends from the frame members in an upwardly-concave manner and wherein a lower one of the straps extends from the frame members in a downwardly-concave manner.

(14) The apparatus of at least one of the preceding clauses wherein the backrest has a central portion positioned between the frame members and wherein the straps are further spaced-apart as the straps move away from the frame members towards to the central portion of the backrest.

(15) The apparatus of at least one of the preceding clauses wherein the walker apparatus has a pair of sides and wherein the backrest has extending therethrough an oval-shaped aperture with tapered ends positioned adjacent to the sides of the walker apparatus, the aperture being positioned between the straps.

(16) The apparatus of at least one of the preceding clauses wherein the walker apparatus includes a folding mechanism operatively connected to and interposed between the frame members, the folding mechanism enabling the walker apparatus to be laterally-foldable along a folding axis, the straps being furthest spaced-apart relative to each other in a region aligning with the folding axis.

(17) The apparatus of at least one of the preceding clauses further including an adjustment mechanism that enables the extent to which the backrest extends from the frame members to be adjustable.

(18) The apparatus of at least one of the preceding clauses further including a handle brake assembly and wherein the adjustment mechanism comprises at least one female connector having a plurality of horizontally spaced-apart apertures extending therethrough and at least one male connector, the at least one male connector being receivable with respective ones of the apertures of the at least one female connector, the at least one female connector being a part of a first one of the handle brake assembly and distal ends of the backrest and the at least one male connector coupling to a second one of the handle brake assembly and distal ends of the backrest.

(19) The apparatus of at least one of the preceding clauses wherein the adjustment mechanism includes a pair of female connectors operatively connected to respective ones of the frame members, each female connector including a slot extending therein and each female connector including a plurality of horizontally-spaced recesses positioned within said slot, and wherein the adjustment mechanism includes vertically extending protrusions located adjacent to respective ones of the distal ends of the backrest, the protrusions being receivable within selective ones of said recesses of the female connectors.

(20) The apparatus of at least one of the preceding clauses further including a pair of slide rail assemblies, the backrest operatively connecting to and being extendable relative to the frame members via the slide rail assemblies.

(21) The apparatus of at least one of the preceding clauses wherein the straps extend along the front and sides of the walker apparatus.

(22) The apparatus of at least one of the preceding clauses wherein the straps extend along the front of the walker apparatus.

(23) The apparatus of at least one of the preceding clauses wherein the straps are symmetrical about the vertical and horizontal axes of the backrest.

(24) The apparatus of at least one of the preceding clauses wherein the backrest is arcuate with an inner portion formed of polypropylene and an outer portion formed of thermoplastic polyurethane.

(25) The apparatus of at least one of the preceding clauses wherein the backrest is elliptical from the side as the backrest extends from the frame members.

(26) The apparatus of at least one of the preceding clauses wherein the backrest is y-shaped from the side as the backrest extends from the frame members.

(27) The apparatus of at least one of the preceding clauses wherein the backrest is u-shaped from the side as the backrest extends from the frame members.

(28) The apparatus of at least one of the preceding clauses wherein an upper one of the straps aligns with and tangentially extends from upper ends of the frame members and wherein a lower one of the straps extends in a spaced-apart and parallel manner relative to the upper one of the straps.

(29) The apparatus of at least one of the preceding clauses further including a pair of arc-shaped connecting members that connect the upper and lower ones of the straps together.

(30) The apparatus of at least one of the preceding clauses wherein the upper and lower ones of the straps connect to and extend tangentially from the arc-shaped connecting members.

(31) The apparatus of at least one of the preceding clauses further including a pair of s-shaped connecting members that connect the upper and lower ones of the straps together.

(32) The apparatus of at least one of the preceding clauses wherein an upper one of the straps aligns with and tangentially extends from upper ends of the frame members and wherein a lower one of the straps is spaced-apart below the upper ends of the frame members.

(33) The apparatus of at least one of the preceding clauses wherein the backrest includes a concave-shaped interior and a cushioning member positioned within said interior.

(34) The apparatus of at least one of the preceding clauses wherein the cushioning member has an aperture extending therethrough.

(35) The apparatus of at least one of the preceding clauses wherein the cushioning member is loop-shaped.

(36) The apparatus of at least one of the preceding clauses wherein the backrest includes a cushioning member that substantially extends around the straps.

(37) The apparatus of at least one of the preceding clauses wherein the backrest includes a concave-shaped interior and a cushioning member positioned within said interior, the cushioning member connecting to and extending from one of the straps.

(38) The apparatus of at least one of the preceding clauses wherein an upper one of the straps is spaced-apart above upper ends of the frame members and wherein a lower one of the straps is spaced-apart below the upper ends of the frame members.

(39) The apparatus of at least one of the preceding clauses wherein each of the frame members is telescopic and includes a push button for selecting adjusting the height thereof.

(40) The apparatus of at least one of the preceding clauses wherein said at least one opening extends in a substantially horizontal direction.

(41) The apparatus of at least one of the preceding clauses wherein said at least one opening extends in a substantially vertical direction.

(42) The apparatus of at least one of the preceding clauses wherein the backrest has at least one aperture extending therethrough which extends in a substantially horizontal direction and at least one aperture extending therethrough which extends in a substantially vertical direction.

(43 ) The apparatus of at least one of the preceding clauses wherein the backrest comprises a plurality of spaced-apart, vertically-extending ribs with a plurality of vertically-extending apertures interposed between respective ones of the ribs.

(44) The apparatus of at least one of the preceding clauses wherein the backrest further includes a pair of substantially-horizontal upper and lower bridging members, the ribs connecting to and extending between the bridging members.

(45) The apparatus of at least one of the preceding clauses wherein the ribs radially extend outwards relative to the bridging members.

(46) The apparatus of at least one of the preceding clauses wherein the backrest has a convex-shaped exterior and a receptacle for storing objects, the receptacle connecting to the exterior of the backrest.

(47) The apparatus of at least one of the preceding clauses wherein an upper one of the straps includes a plurality of spaced-apart grooves partially extending therethrough.

(48) The apparatus of at least one of the preceding clauses wherein the opening is in the form of a substantially-horizontally extending aperture which aligns upper ends of the frame members, the upper one of the straps being positioned above the upper ends of the frame members and a lower one of the straps being positioned below the upper ends of the frame members.

(49) The apparatus of at least one of the preceding clauses wherein the upper one of the straps comprises an upper half of the backrest and wherein the aperture and the lower strap comprise a lower half of the backrest.

(50) The apparatus of at least one of the preceding clauses wherein an upper one of the straps includes a plurality of spaced-apart vertically-extending slits and wherein the backrest further includes a plurality of spaced-apart, vertically-extending ribs coupled to the upper one of the straps with the plurality of vertically-extending slits being interposed between respective ones of the ribs.

(51) The apparatus of at least one of the preceding clauses further including a pair of u-shaped, resilient connecting members that operatively connect the backrest to upper ends of the frame members, respectively.

(52) The apparatus of at least one of the preceding clauses wherein the backrest is substantially rectangular in profile.

(53) The apparatus of at least one of the preceding clauses wherein the backrest includes a plurality of spaced-apart vertically-extending strips and a plurality of spaced-apart horizontally-extending strips intersecting with the vertically-extending strips.

(54) The apparatus of at least one of the preceding clauses wherein the backrest includes a plurality of spaced-apart, vertically-extending slits.

(55) The apparatus of at least one of the preceding clauses wherein the backrest includes a top and wherein the at least one opening is a recessed portion centrally extending downwards from the top of the backrest.

(56) The apparatus of at least one of the preceding clauses wherein the recessed portion of the backrest extends from an upper half of the backrest to a lower half of the backrest.

(57) The apparatus of at least one of the preceding clauses wherein the backrest includes a top, an upper recessed portion extending downwards from the top of the backrest, a bottom spaced-apart from the top, and a bottom recessed portion extending upwards from the bottom of the backrest.

(58) The apparatus of at least one of the preceding clauses wherein the backrest has a central portion located between the frame members, the recessed portions being positioned within said central portion of the backrest.

(59) The apparatus of at least one of the preceding clauses wherein the backrest comprises a pair of substantially rectangular portions coupled together at lower halves thereof

(60) The apparatus of at least one of the preceding clauses wherein a centrally positioned, vertically-extending rib couples the rectangular portions of the backrest together.

(61) The apparatus of at least one of the preceding clauses wherein the backrest is shaped to form a substantially v-shape when the walker apparatus is folded laterally.

(62) The apparatus of at least one of the preceding clauses wherein the straps are substantially inwardly spaced-apart from support members when the apparatus is folded laterally.

(63) A walker apparatus comprising: a pair of spaced-apart, upright frame members; a seat operatively connected to the upright frame members; and a backrest cantilevered from the frame members, the backrest including a plurality of spaced-apart, vertically-extending ribs and a pair of substantially-horizontal upper and lower bridging members, the ribs connecting to and extending between the bridging members.

(64) The apparatus of at least one of the preceding clauses wherein the upper bridging member upwardly curves as the backrest extends towards its central portion.

(65) The apparatus of at least one of the preceding clauses wherein the lower bridging member downwardly curves as the backrest extends towards its central portion.

It will be appreciated that many variations are possible within the scope of the invention described herein. It will be further understood by someone skilled in the art that many of the details provided above are by way of example only and are not intended to limit the scope of the invention which is to be determined with reference to at least the following claims.

What is claimed is:

1. A laterally-foldable walker apparatus comprising:

a pair of spaced-apart, upright frame members;

a seat operatively connected to the upright frame members; and a backrest cantilevered from the frame members, the backrest having at least one opening extending therethrough for permitting a user's vision past the backrest when the user grips the upright frame members, the backrest including a pair of spaced-apart upper and lower straps, the straps connecting together at common ends and the straps being outwardly divergent relative to one another.

2. The laterally-foldable walker apparatus as claimed in claim 1 wherein the backrest is horizontally split.

3. The laterally-foldable walker apparatus as claimed in claim 1 wherein the upper strap is U-shaped in cross-section.

4. The laterally-foldable walker apparatus as claimed in claim 1 wherein the frame members have upper ends and wherein the upper strap extends upwardly from the upper ends of the frame members.

5. The laterally-foldable walker apparatus as claimed in claim 1 wherein the upper strap extends from the frame members in an upwardly-concave manner and wherein the lower strap extends from the frame members in a downwardly-concave manner.

6. The laterally-foldable walker apparatus as claimed in claim 1 wherein the walker apparatus has a pair of sides and wherein the opening of the backrest is an oval-shaped aperture extending through the backrest, the aperture having tapered ends positioned adjacent to the sides of the walker apparatus, and the aperture being positioned between the straps.

7. The laterally-foldable walker apparatus as claimed in claim 1 wherein the walker apparatus includes a folding mechanism operatively connected to and interposed between the frame members, the folding mechanism enabling the walker apparatus to be laterally-foldable along a folding axis, the straps being furthest spaced-apart near the folding axis.

8. The laterally-foldable walker apparatus as claimed in claim 1 further including an adjustment mechanism that enables the extent to which the backrest extends from the frame members to be adjusted.

9. The laterally-foldable walker apparatus as claimed in claim 1 further including a pair of slide rail assemblies, the backrest operatively connecting to and being extendable relative to the frame members via the slide rail assemblies.

10. The laterally-foldable walker apparatus as claimed in claim 1 wherein the straps are symmetrical about the vertical and horizontal axes of the backrest.

11. The laterally-foldable walker apparatus as claimed in claim 1 wherein the backrest is elliptical when viewed from the rear of the backrest.

12. The laterally-foldable walker apparatus as claimed in claim 1 wherein the backrest is y-shaped when viewed from the side as the backrest extends from the frame members.

13. The laterally-foldable walker apparatus as claimed in claim 1 wherein the upper strap aligns with and tangentially extends from upper ends of the frame members and wherein the lower strap is spaced-apart below the upper ends of the frame members.

14. The laterally-foldable walker apparatus as claimed in claim 13 further including a pair of arc-shaped connecting members that connect the upper and lower straps together, the upper and lower straps connect to and extend tangentially from the arc-shaped connecting members.

15. The laterally-foldable walker apparatus as claimed in claim 13 further including a pair of s-shaped connecting members that connect the upper and lower straps together.

16. The laterally-foldable walker apparatus as claimed in claim 1 wherein the backrest includes a concave-shaped interior and a cushioning member positioned within said interior.

17. The laterally-foldable walker apparatus as claimed in claim 16 wherein the cushioning member has an aperture extending therethrough.

18. The laterally-foldable walker apparatus as claimed in claim 1 wherein the upper strap is spaced-apart above upper ends of the frame members and wherein the lower strap is spaced-apart below the upper ends of the frame members.

19. The laterally-foldable walker apparatus as claimed in claim 1 wherein each of the frame members is telescopic and includes a push button for selectively adjusting the height thereof.

20. The laterally-foldable walker apparatus as claimed in claim 1 wherein said at least one opening extends in a substantially horizontal direction.

21. The laterally-foldable walker apparatus as claimed in claim 1 wherein said at least one opening extends in a substantially vertical direction.

22. The laterally-foldable walker apparatus as claimed in claim 1 wherein the backrest has at least one aperture extending therethrough which extends in a substantially horizontal direction and at least one aperture extending therethrough which extends in a substantially vertical direction.

23. The laterally-foldable walker apparatus as claimed in claim 1 wherein the backrest comprises a plurality of spaced-apart, vertically-extending ribs with a plurality of vertically-extending apertures interposed between adjacent said ribs.

24. The laterally-foldable walker apparatus as claimed in claim 23 wherein the backrest further includes a pair of substantially-horizontal upper and lower bridging members, the ribs connecting to and extending between the bridging members.

25. The laterally-foldable walker apparatus claimed in claim 1 wherein the backrest has a convex-shaped exterior and a receptacle for storing objects, the receptacle being adjacent to the exterior of the backrest.

26. The laterally-foldable walker apparatus as claimed in claim 1 wherein the upper strap includes a plurality of spaced-apart grooves partially extending therethrough.

27. The laterally-foldable walker apparatus as claimed in claim 1 wherein the opening is in the form of a substantially-horizontally extending aperture which aligns with upper ends of the frame members, and wherein the upper strap is positioned above the upper ends of the frame members and the lower strap is positioned below the upper ends of the frame members.

28. The laterally-foldable walker apparatus as claimed in claim 27, wherein the upper strap comprises an upper half of the backrest and wherein the aperture and the lower strap comprise a lower half of the backrest.

29. The laterally-foldable walker apparatus as claimed in claim 1, further including a pair of u-shaped, resilient connecting members that connect the backrest to upper ends of the frame members, respectively.

30. The laterally-foldable walker apparatus as claimed in claim 29 wherein the backrest is substantially rectangular in section.

31. The laterally-foldable walker apparatus as claimed in claim 1 wherein the backrest includes a top and wherein the at least one opening is a recessed portion centrally extending downwards from the top of the backrest.

32. The laterally-foldable walker apparatus as claimed in claim 31 wherein the recessed portion of the backrest extends from an upper half of the backrest to a lower half of the backrest.

33. The laterally-foldable walker apparatus as claimed in claim 1, wherein the backrest comprises a pair of substantially rectangular portions coupled together at lower halves thereof.

34. The laterally-foldable walker apparatus as claimed in claim 1, wherein the spaced-apart upper and lower straps define the opening therebetween.

* * * * *